US009649846B2

(12) United States Patent
Kimura et al.

(10) Patent No.: US 9,649,846 B2
(45) Date of Patent: May 16, 2017

(54) TANK, TANK UNIT, LIQUID EJECTION SYSTEM, AND LIQUID EJECTION APPARATUS

(71) Applicant: SEIKO EPSON CORPORATION, Tokyo (JP)

(72) Inventors: Naomi Kimura, Nagano (JP); Munehide Kanaya, Nagano (JP); Yuichi Nishihara, Nagano (JP); Masaki Tsukida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/060,017

(22) Filed: Mar. 3, 2016

(65) Prior Publication Data

US 2016/0263905 A1 Sep. 15, 2016

(30) Foreign Application Priority Data

Mar. 12, 2015 (JP) ..... 2015-049480
Feb. 2, 2016 (JP) ..... 2016-018074

(51) Int. Cl.
*B41J 2/175* (2006.01)
*B41J 29/13* (2006.01)

(52) U.S. Cl.
CPC ..... *B41J 2/17523* (2013.01); *B41J 2/1752* (2013.01); *B41J 2/17503* (2013.01); *B41J 2/17509* (2013.01); *B41J 2/17513* (2013.01); *B41J 2/17553* (2013.01); *B41J 2/17566* (2013.01); *B41J 29/13* (2013.01); *B41J 2002/17579* (2013.01)

(58) Field of Classification Search
CPC . B41J 2/17503; B41J 2/17513; B41J 2/17566
See application file for complete search history.

(56) References Cited

U.S. PATENT DOCUMENTS 5,689,290 A * 11/1997 Saito ..... B41J 2/17513 250/577
2003/0071862 A1* 4/2003 Tsukada ..... B41J 2/17513 347/7
2003/0214545 A1* 11/2003 Eguchi ..... B41J 2/17566 347/19
2005/0168543 A1* 8/2005 Silverbrook ..... B41J 2/14427 347/85

FOREIGN PATENT DOCUMENTS

JP 06-218944 A 8/1994
JP 2007-090558 A 4/2007
JP 2014-184594 A 10/2014

* cited by examiner

*Primary Examiner* — Julian Huffman
(74) *Attorney, Agent, or Firm* — Global IP Counselors, LLP

(57) ABSTRACT

An ink tank 25A includes an ink containing portion 120, an ink injection portion 113, an ink supply portion 117, and a pair of electrode pins 140*a* and 140*b*. The ink containing portion 120 has a visual check portion 114 that enables the position of the liquid surface of ink contained in the ink containing portion 120 to be visually checked from the outside in a reference posture, which is a posture at the time when the ink is supplied from the ink tank 25 to the print head portion 32. The ink supply portion 117 is connected to a lower portion 122A located below a lower end of the visual check portion 114 in the reference posture. Leading end portions 143*a* and 143*b* of the electrode pins 140*a* and 140*b* are arranged in the lower portion 122A.

18 Claims, 28 Drawing Sheets

TANK, TANK UNIT, LIQUID EJECTION SYSTEM, AND LIQUID EJECTION APPARATUS

BACKGROUND

1. Technical Field

The present invention relates to tanks, tank units, liquid ejection systems, and liquid ejection apparatuses.

2. Related Art

As a mode of a tank, an ink tank capable of containing ink that is to be supplied to a print head portion of an inkjet printer (hereinafter referred to simply as "a printer") is known. A printer is a mode of a liquid ejection system or a liquid ejection apparatus. There are cases where, in an ink tank, an electrode that is used for detecting the amount of remaining ink is attached to the inside of an ink containing portion in which ink is contained (e.g., JP-A-2014-184594 and JP-A-2007-090558, etc.).

A printer may be used in an inclined state relative to a prescribed arrangement posture in some cases (usually, a printer is in a horizontal arrangement state). In such cases, in the ink tank attached to the printer, the position of the liquid surface of ink, the contact state between the electrode and the ink, and the like are different from those when in the prescribed arrangement posture. It is favorable in the printer and the ink tank that a user can more correctly understand the amount of remaining ink even in such a situation. Some printers include a plurality of ink tanks that have different ink capacities. In such printers, it is favorable that a user can equally understand, as much as possible, the amounts of remaining ink in the respective ink tanks regardless of the capacities thereof. In not only the ink tanks but other kinds of tanks capable of containing liquid, it is favorable that the user can more correctly understand the amount of remaining liquid contained in these tanks regardless of various conditions.

SUMMARY

The invention has been made in order to solve at least some of the foregoing problems regarding a tank capable of containing liquid that is to be supplied to a liquid ejection head. Embodiments of this invention are not limited to ink tanks, and can be achieved in the following modes, for example.

[1] According to a first mode of the invention, a tank is provided. With the tank in this mode, liquid may be able to be supplied to a liquid ejection head. The tank may include a liquid containing portion, a liquid supply portion, and an electrode member. The liquid containing portion may be capable of containing the liquid. With the liquid supply portion, the liquid may be able to be supplied to the liquid ejection head. The electrode member may be used for detecting the liquid contained in the liquid containing portion. The liquid containing portion may have a visual check portion that enables a position of a liquid surface of the liquid contained in the liquid containing portion to be visually checked from the outside in a liquid supply posture, which is a posture at the time of supplying the liquid from the tank to the liquid ejection head in a case of ejecting the liquid. The liquid supply portion may be connected to a lower portion of the liquid containing portion, the lower portion being located below a lower end of the visual check portion in the liquid supply posture. At least a part of the electrode member may be arranged in the lower portion. With the tank in this mode, it is possible to detect the liquid in the lower portion in which it is difficult to visually check the liquid from the outside, and a user can more correctly understand the amount of remaining liquid.

[2] In the tank in the above mode, the lower portion may be constituted by a step portion in which, in the liquid supply posture, a cross-sectional area of an internal space in a horizontal cross-section becomes small stepwise in a gravity direction, or an inclined portion in which the cross-sectional area becomes smaller on a lower side in the gravity direction, and at least a part of the electrode member may be arranged below an upper end of the step portion or below an upper end of the inclined portion in the liquid supply posture. With the tank in this mode, a change of the liquid surface position of the liquid in the lower portion is suppressed even in the case of an undesirable installation condition of the tank, e.g., in the case where the tank is arranged in an inclined manner, or in the case where the tank is arranged in a location where a vibration occurs. Accordingly, erroneous detection of whether or not the liquid is present in the lower portion of the tank is suppressed, and the detection accuracy is increased.

[3] In the tank in the above mode, the liquid containing portion may have a bottom wall portion that inclines downward in the liquid supply posture as a wall portion constituting the inclined portion, and the liquid supply portion may be connected to the liquid containing portion at a lower end portion of the bottom wall portion. With the tank in this mode, the liquid can be collected on the liquid supply portion side by means of the bottom wall portion, and the liquid remaining in the liquid containing portion is suppressed.

[4] In the tank in the above mode, the liquid containing portion may have a first side wall portion and a second side wall portion that oppose each other in a horizontal direction with the bottom wall portion therebetween, and the bottom wall portion may have a portion that inclines downward in a direction extending from the first side wall portion toward the second side wall portion. With the tank in this mode, the liquid can be collected on the second side wall portion side in the liquid containing portion.

[5] In the tank in the above mode, the visual check portion may be provided in the first side wall portion, and at least a part of the electrode member may be located below a lower end portion of the first side wall portion in the liquid supply posture. With the tank in this mode, the liquid is collected in a region on the side opposite to the visual check portion, and the liquid is likely to be out of the visual field of the user. Therefore, it is possible to let the user recognize, at an earlier stage, that the liquid needs to be supplied.

[6] In the tank in the above mode, the electrode member may be arranged between the second side wall portion and an intermediate position between the first side wall portion and the second side wall portion. With the tank in this mode, since the electrode member is arranged in a region where the liquid is collected, the liquid detection accuracy is increased.

[7] In the tank in the above mode, the electrode member may extend from above the lower portion toward the lower portion in the liquid supply posture. With the tank in this mode, the liquid attached to the electrode member above the liquid surface in the liquid containing portion is guided downward by the gravity. Accordingly, a decrease in the liquid detection accuracy due to the attachment of unnecessary liquid to the electrode member is suppressed.

[8] In the tank in the above mode, in the liquid supply posture, the electrode member may be held by an upper wall portion extending in a direction intersecting the gravity direction above the liquid containing portion, and extends toward the lower portion from the upper wall portion. With the tank in this mode, the liquid attached to a portion where the electrode member is held is guided in a direction of falling down due to the gravity. Accordingly, a decrease in the liquid detection accuracy due to the attachment of the liquid to the portion where the electrode member is held is suppressed.

[9] In the tank in the above mode, the electrode member may include a first electrode member and a second electrode member, a lower end portion of the first electrode member and a lower end portion of the second electrode member may be arranged in the lower portion, and the lower end portion of the second electrode member may be located above the lower end portion of the first electrode member in the liquid supply posture. With the tank in this mode, the liquid detection accuracy can be increased by the two electrode members that have the lower end portions with different height positions.

[10] In the tank in the above mode, the first electrode member and the second electrode member may be metal pins that have different lengths, the first electrode member and the second electrode member may be inserted in the liquid containing portion from above the liquid containing portion in the liquid supply posture, and an upper end portion of the first electrode member and an upper end portion of the second electrode member that are arranged above the liquid containing portion may be located at the same height position in the liquid supply posture. With the tank in this mode, connectability to the first electrode member and the second electrode member is increased.

[11] In the tank in the above mode, the first electrode member and the second electrode member may be metal pins that have the same length, the first electrode member and the second electrode member may be inserted in the liquid containing portion from above the liquid containing portion in the liquid supply posture, and an upper end portion of the first electrode member and an upper end portion of the second electrode member that are arranged above the liquid containing portion may be located at different height positions in the liquid supply posture. With the tank in this mode, since the first electrode member and the second electrode member can be constituted by parts having the same shape, manufacturing efficiency can be increased.

[12] According to a second mode of the invention, a tank unit is provided. With the tank unit in this mode, first liquid and second liquid may be able to be supplied to a liquid ejection head. The tank unit may include a first tank, a second tank, and an exterior portion. With the first tank, the first liquid may be able to be supplied to the liquid ejection head. With the second tank, the second liquid may be able to be supplied to the liquid ejection head. The exterior portion may be capable of housing the first tank and the second tank. The first tank may include: a first liquid containing portion that contains the first liquid; and a first electrode member and a second electrode member that are housed in the first liquid containing portion, used for detecting the first liquid, and extend downward from above in a first liquid supply posture, which is a posture at the time when the first liquid is supplied from the first tank to the liquid ejection head in a case of ejecting the first liquid. The second tank may include: a second liquid containing portion that contains the second liquid; and a third electrode member and a fourth electrode member that are housed in the second liquid containing portion, used for detecting the second liquid, and extend downward from above in a second liquid supply posture, which is a posture at the time when the second liquid is supplied from the second tank to the liquid ejection head in a case of ejecting the second liquid. In the first liquid supply posture, a lower end portion of the first electrode member may be located below a lower end portion of the second electrode member. In the second liquid supply posture, a lower end portion of the third electrode member may be located below a lower end portion of the fourth electrode member. A volume of the second liquid containing portion may be larger than a volume of the first liquid containing portion. A distance in a gravity direction between the lower end portion of the fourth electrode member and a lower end portion of the second liquid containing portion when in the second liquid supply posture may be smaller than a distance in the gravity direction between the lower end portion of the second electrode member and a lower end portion of the first liquid containing portion when in the first liquid supply posture. With the tank unit in this mode, the accuracy of the detection of the amount of remaining liquid in the first tank and the second tank is increased, and a variation in the accuracy of detection of the amount of remaining ink between the first tank and the second tank that have different capacities is suppressed. Furthermore, a variation in the liquid detection accuracy due to a variation in the height positions of the lower end portions of the electrode members in the tanks caused by a manufacturing error or the like is suppressed.

[13] According to a third mode of the invention, a tank unit is provided. With the tank unit in this mode, first liquid and second liquid may be able to be supplied to a liquid ejection head. The tank unit may include a first tank, a second tank, and an exterior member. With the first tank, the first liquid may be able to be supplied to the liquid ejection head. With the second tank, the second liquid may be able to be supplied to the liquid ejection head. The exterior portion may be capable of housing the first tank and the second tank. The first tank may include: a first liquid containing portion that contains the first liquid; and a first electrode member and a second electrode member that are housed in the first liquid containing portion, used for detecting the first liquid, and extend downward from above in a first liquid supply posture, which is a posture at the time when the first liquid is supplied from the first tank to the liquid ejection head in a case of ejecting the first liquid. The second tank may include: a second liquid containing portion that contains the second liquid; and a third electrode member and a fourth electrode member that are housed in the second liquid containing portion, used for detecting the second liquid, and extend downward from above in a second liquid supply posture, which is a posture at the time when the second liquid is supplied from the second tank to the liquid ejection head in a case of ejecting the second liquid. In the first liquid supply posture, a lower end portion of the first electrode member and a lower end portion of the second electrode member may be located at the same height position. In the second liquid supply posture, a lower end portion of the third electrode member and a lower end portion of the fourth electrode member may be located at the same height position. A volume of the second liquid containing portion may be larger than a volume of the first liquid containing portion. A distance in a gravity direction between the lower end portions of the third electrode member and the fourth electrode member and a lower end portion of the second liquid containing portion when in the second liquid supply posture may be smaller than a distance in the gravity direction between the lower end portions of the first electrode member and the second electrode member and a lower end portion of the first liquid containing portion when in the first liquid supply posture. With the tank unit in this mode, the liquid detection accuracy in the first tank and the second tank is increased, and a variation in the liquid detection accuracy between the first tank and the second tank that have different capacities is suppressed.

[14] In the tank unit in the above third mode, the first electrode member and the second electrode member may be held by a first upper wall portion that extends in a direction intersecting the gravity direction above the first liquid containing portion in the first liquid supply posture, and the third electrode member and the fourth electrode member may be held by a second upper wall portion that extends in a direction intersecting the gravity direction above the second liquid containing portion in the second liquid supply posture. With the tank unit in this mode, a decrease in the accuracy of the detection of the remaining liquid due to the liquid attached to the portion where each electrode member is held is suppressed.

[15] In the tank unit in the above mode, the first tank may have a first liquid injection portion with which the first liquid can be injected into the first liquid containing portion, and the second tank may have a second liquid injection portion with which the second liquid can be injected into the second liquid containing portion. With the tank unit in this mode, a liquid supply timing can be appropriately detected, and an occurrence of a malfunction due to a delay of the liquid supply timing is suppressed.

[16] In the tank unit in the above mode, the first tank may have a first atmosphere introduction portion with which the atmosphere can be introduced into the first liquid containing portion, and the second tank may have a second atmosphere introduction portion with which the atmosphere can be introduced into the second liquid containing portion. With the tank unit in this mode, the atmosphere is appropriately introduced into the liquid containing portion of each tank.

[17] According to a fourth mode of the invention, a liquid ejection system is provided. The liquid ejection system may include the ink tank in the above-described modes, and a liquid ejection apparatus having the liquid ejection head. With this liquid ejection system, the liquid detection accuracy in the first tank and the second tank is increased.

[18] According to a fifth mode of the invention, a liquid ejection system is provided. This liquid ejection system may include a liquid ejection head, a first tank, a second tank, and an exterior portion. The liquid ejection head may be capable of ejecting liquid. With the first tank, first liquid may be able to be supplied to the liquid ejection head. With the second tank, second liquid may be able to be supplied to the liquid ejection head. The exterior portion may be capable of housing the first tank, the second tank, and the liquid ejection head. The first tank may include: a first liquid containing portion that contains the first liquid; and a first electrode member and a second electrode member that are housed in the first liquid containing portion, used for detecting the first liquid, and extend downward from above in a first liquid supply posture, which is a posture at the time when the first liquid is supplied from the first tank to the liquid ejection head in a case of ejecting the first liquid. The second tank may include: a second liquid containing portion that contains the second liquid; and a third electrode member and a fourth electrode member that are housed in the second liquid containing portion, used for detecting the second liquid, and extend downward from above in a second liquid supply posture, which is a posture at the time when the second liquid is supplied from the second tank to the liquid ejection head in a case of ejecting the second liquid. In the first liquid supply posture, a lower end portion of the first electrode member may be located below a lower end portion of the second electrode member. In the second liquid supply posture, a lower end portion of the third electrode member may be located below a lower end portion of the fourth electrode member. A volume of the second liquid containing portion may be larger than a volume of the first liquid containing portion. A distance in a gravity direction between the lower end portion of the fourth electrode member and a lower end portion of the second liquid containing portion when in the second liquid supply posture may be smaller than a distance in the gravity direction between the lower end portion of the second electrode member and a lower end portion of the first liquid containing portion when in the first liquid supply posture. With the liquid ejection system in this mode, the liquid detection accuracy in the first tank and the second tank is increased.

[19] According to a sixth mode of the invention, a liquid ejection system is provided. This liquid ejection system may include a liquid ejection head, a first tank, a second tank, and an exterior portion. This liquid ejection head may be capable of ejecting liquid. With the first tank, first liquid may be able to be supplied to the liquid ejection head. With the second tank, second liquid may be able to be supplied to the liquid ejection head. The exterior portion may be capable of housing the first tank, the second tank, and the liquid ejection head. The first tank may include: a first liquid containing portion that contains the first liquid; and a first electrode member and a second electrode member that are housed in the first liquid containing portion, used for detecting the first liquid, and extend downward from above in a first liquid supply posture, which is a posture at the time when the first liquid is supplied from the first tank to the liquid ejection head in a case of ejecting the first liquid. The second tank may include: a second liquid containing portion that contains the second liquid; and a third electrode member and a fourth electrode member that are housed in the second liquid containing portion, used for detecting the second liquid, and extend downward from above in a second liquid supply posture, which is a posture at the time when the second liquid is supplied from the second tank to the liquid ejection head in a case of ejecting the second liquid. In the first liquid supply posture, a lower end portion of the first electrode member and a lower end portion of the second electrode member may be located at the same height position. In the second liquid supply posture, a lower end portion of the third electrode member and a lower end portion of the fourth electrode member may be located at the same height position. A volume of the second liquid containing portion may be larger than a volume of the first liquid containing portion. A distance in a gravity direction between the lower end portions of the third electrode member and the fourth electrode member and a lower end portion of the second liquid containing portion when in the second liquid supply posture may be smaller than a distance in the gravity direction between the lower end portions of the first electrode member and the second electrode member and a lower end portion of the first liquid containing portion when in the first liquid supply posture. With the liquid ejection system in this mode, the liquid detection accuracy in the first tank and the second tank is increased.

[20] In the liquid ejection system in the above mode, the first electrode member and the second electrode member may be held by a first upper wall portion that extends in a direction intersecting the gravity direction above the first liquid containing portion in the first liquid supply posture, and the third electrode member and the fourth electrode member may be held by a second upper wall portion that extends in a direction intersecting the gravity direction above the second liquid containing portion in the second liquid supply posture. With the liquid ejection system in this mode, a decrease in the liquid detection accuracy due to liquid attached to a portion where the electrode members are held is suppressed.

[21] In the liquid ejection system in the above mode, the first tank may have a first liquid injection portion with which the first liquid can be injected into the first liquid containing portion, and the second tank may have a second liquid injection portion with which the second liquid can be injected into the second liquid containing portion. With the tank unit in this mode, a liquid supply timing can be appropriately detected, and an occurrence of a malfunction due to a delay of the liquid supply timing is suppressed.

[22] In the liquid ejection system in the above mode, the first tank may have a first atmosphere introduction portion with which the atmosphere can be introduced into the first liquid containing portion, and the second tank may have a second atmosphere introduction portion with which the atmosphere can be introduced into the second liquid containing portion. With the tank unit in this mode, the atmosphere is appropriately introduced into the liquid containing portion of each tank with consumption of the liquid.

[23] According to a seventh mode of the invention, a tank is provided. With the tank, liquid may be able to be supplied to a liquid ejection head. The tank may include a liquid containing portion, a liquid supply portion, and an electrode member. The liquid containing portion may be capable of containing the liquid. With the liquid supply portion, the liquid may be able to be supplied to the liquid ejection head. The electrode member may be used for detecting the liquid contained in the liquid containing portion. The liquid containing portion may have, on a lower side in a gravity direction, a step portion in which a cross-sectional area of an internal space in a horizontal cross-section becomes small stepwise in the gravity direction, or an inclined portion in which the cross-sectional area becomes smaller on a lower side in the gravity direction in a liquid supply posture, which is a posture at the time of supplying the liquid from the tank to the liquid ejection head in a case of ejecting the liquid. At least a part of the electrode member may be arranged in the step portion or the inclined portion. With the tank in this mode, since the liquid is detected in the step portion or the inclined portion where a change of the liquid surface position is suppressed, the liquid detection accuracy is increased.

[24] According to an eighth mode of the invention, a tank is provided. With the tank, liquid may be able to be supplied to a liquid ejection head. The tank may include a liquid containing portion, a liquid supply portion, and an electrode member. The containing portion may be capable of containing the liquid. With the liquid supply portion, the liquid may be able to be supplied to the liquid ejection head. The electrode member may be used for detecting the liquid contained in the liquid containing portion. The liquid containing portion may have a first side wall portion, and a second side wall portion opposing the first side wall portion. A visual check portion may be provided in the first side wall portion, the visual check portion enabling a position of a liquid surface of the liquid contained in the liquid containing portion to be visually checked from the outside in a liquid supply posture, which is a posture at the time of supplying the liquid from the tank to the liquid ejection head in a case of ejecting the liquid. The electrode member may be arranged between the second side wall portion and an intermediate position between the first side wall portion and the second side wall portion. With the tank in this mode, the electrode member is arranged at a position closer to the second side wall portion where the visual check portion is not provided than to the first side wall portion where the visual check portion is provided. Accordingly, interruption of a visually check of the liquid via the visual check portion is suppressed, and the accuracy of liquid detection using a visual check is increased.

[25] According to a ninth mode of the invention, a tank is provided. With the tank, liquid may be able to be supplied to a liquid ejection head. The tank may include a liquid containing portion, a liquid supply portion, and an electrode member. The liquid containing portion may be capable of containing the liquid. With the liquid supply portion, the liquid may be able to be supplied to the liquid ejection head. The electrode member may be used for detecting the liquid contained in the liquid containing portion. The liquid containing portion may have an upper wall portion that is located at an upper end of the liquid containing portion and extends in a direction intersecting a gravity direction in a liquid supply posture, which is a posture at the time of supplying the liquid from the tank to the liquid ejection head in a case of ejecting the liquid. The electrode member may extend to a lower side of the liquid containing portion from the upper wall portion in the liquid supply posture. With the tank in this mode, the liquid attached to the electrode member above the liquid surface in the liquid containing portion is guided downward by the gravity. Accordingly, a decrease in the accuracy of detection of the amount of remaining liquid due to the attachment of unnecessary liquid to the electrode member is suppressed.

[26] In the tank in the above mode, the liquid containing portion may have a first side wall portion, and a second side wall portion opposing the first side wall portion, a visual check portion may be provided in the first side wall portion, the visual check portion enabling a position of a liquid surface of the liquid contained in the liquid containing portion to be visually checked from the outside in the liquid supply posture, and the electrode member may be arranged between the second side wall portion and an intermediate position between the first side wall portion and the second side wall portion. With the tank in this mode, the electrode member is arranged at a position closer to the second side wall portion where the visual check portion is not provided than to the first side wall portion where the visual check portion is provided. Accordingly, interruption of a visual check of the liquid via the visual check portion is suppressed, and the accuracy of liquid detection by means of a visual check is increased.

[27] In the tank in the above mode, the electrode member may include a first electrode member and a second electrode member, the first electrode member and the second electrode member may be arranged in the liquid containing portion and extend downward from above in the liquid supply posture, and a lower end portion of the first electrode member may be located above a lower end portion of the second electrode member in the liquid supply posture. With the tank in this mode, the liquid detection accuracy can be increased by the two electrode members that have the lower end portions having different height positions.

[28] According to a tenth mode of the invention, a liquid ejection apparatus is provided. The liquid ejection apparatus in this mode may include a liquid ejection head, a liquid container, a control portion, and a liquid detecting portion. The liquid ejection head may eject liquid. The liquid container may have a liquid containing portion which contains the liquid, and a liquid supply portion for causing the liquid that is to be supplied to the liquid ejection head to flow out, and may be fixed to the liquid ejection apparatus, and the liquid may be supplied to the liquid containing portion by a user of the liquid ejection apparatus. The control portion may execute liquid detection processing for detecting whether or not the liquid is present at a predetermined position in the liquid containing portion. The liquid detecting portion may be provided in the liquid containing portion and used for detecting whether or not the liquid is present in the liquid detection processing. The liquid container may have: a first portion in which a visual check portion is provided, the visual check portion enabling the user to view and check whether or not the liquid is present in the liquid containing portion when the liquid ejection apparatus is in a use state, which is a state of being used by the user; and a second portion in which the liquid is present even after the liquid has been consumed to an extent to which the liquid disappears from an area of the visual check portion in which the user can view the liquid. The predetermined position at which it is detected whether or not the liquid is present by the control portion may be a position included in the second portion. With the liquid ejection apparatus in this mode, it is possible to detect whether or not the liquid is present in a portion that is difficult for the user to visually check.

[29] The liquid ejection apparatus in the above tenth mode may further include a casing portion that houses the liquid container. In the liquid container, at least a wall portion that constitutes the first portion may be constituted by a material through which the position of the liquid surface of the liquid contained inside can be visually checked, the casing portion may be provided with a window portion through which the user views the visual check portion in the first portion from the outside of the casing portion, the window portion being provided in a portion that faces the first portion, and the area in which the user can view the liquid via the visual check portion may be defined by the window portion. With the liquid ejection apparatus in this mode, the user can understand the presence of the liquid in the first portion by means of a visual check via the window portion of the casing portion, and it can be detected, through liquid detection processing, whether or not the liquid is present in a portion in which it is difficult to visually check the liquid from the window portion of the casing portion.

[30] The liquid ejection apparatus in the above tenth mode the liquid detecting portion may be one of an electrode for detecting electrical resistance of the liquid in the second portion, and a displacement member that is displaced in accordance with whether or not the liquid is present in the second portion. With the liquid ejection apparatus in this mode, it can be more reliably detected whether or not the liquid is present in the second portion.

[31] In the liquid ejection apparatus in the above tenth mode, the liquid detecting portion may be the displacement member, the liquid ejection apparatus may further include an optical sensor that optically detects a displacement of the displacement member, and the control portion may detect whether or not the liquid is present at the predetermined position, using a result of the detection with the optical sensor. With the liquid ejection apparatus in this mode, the accuracy of the detection of whether or not the liquid is present in the second portion can be increased using the optical sensor.

[32] In the liquid ejection apparatus in the above tenth mode, when the liquid ejection apparatus is in the use state, the second portion may be located below the first portion in a gravity direction. With the liquid ejection apparatus in this mode, it is possible to detect whether or not the liquid is present in the second portion that is located below the first portion.

[33] The liquid ejection apparatus in the above tenth mode the liquid supply portion may be provided above the second portion in a gravity direction. With the liquid ejection apparatus in this mode, since the liquid supply portion is located above, connection to the liquid ejection head is facilitated.

[34] According to an eleventh mode of the invention, a liquid ejection apparatus is provided. The liquid ejection apparatus may include a liquid ejection head and a liquid container. The liquid ejection head may eject liquid. The liquid container may have a liquid containing portion which contains the liquid, and a liquid supply portion for causing the liquid supplied to the liquid ejection head to flow out, and may be fixed to the liquid ejection apparatus, and the liquid may be supplied to the liquid containing portion by a user of the liquid ejection apparatus. The liquid container may include a detection member used for detecting whether or not the liquid is present at a predetermined position in the liquid containing portion. The liquid containing portion may have a step portion in which a cross-sectional area of an internal space in a horizontal cross-section becomes small stepwise in a gravity direction, or an inclined portion in which the cross-sectional area becomes smaller on a lower side in the gravity direction, in a lower end area in the gravity direction when the liquid ejection apparatus is in a use state, which is a state of being used by the user. At least a part of the detection member may be arranged in the step portion or the inclined portion. With the liquid ejection apparatus in this mode, since the liquid is detected in the step portion or the inclined portion where a change of the liquid surface position is suppressed, the liquid detection accuracy is increased.

[35] In the liquid ejection apparatus in the above eleventh mode, the liquid container may be configured such that the liquid in the liquid containing portion is supplied to the liquid ejection apparatus via the liquid supply portion from the lower end area of the liquid containing portion, and in the liquid container, a position of a liquid surface of the liquid in the liquid containing portion may lower toward the lower end area as the liquid is consumed. With the liquid ejection apparatus in this mode, the accuracy of detection of the amount of remaining liquid in the liquid containing portion is increased.

Not all of the plurality of constituent elements that each of the above-described modes of the invention has are essential, and modification, deletion, replacement with other new constituent elements, and partial deletion of the limitation can be made as appropriate for some constituent elements in the plurality of constituent elements in order to solve some or all of the foregoing problems, or to achieve some or all of the effects described in the specification. It is also possible to combine some or all of the technical features included in one of the above-described modes of the invention with some or all of the technical features included in the other of the above-described modes of the invention to make an independent mode of the invention, in order to solve some or all of the foregoing problems, or to achieve some or all of the effects described in the specification.

The invention can also be achieved in various modes other than a tank with which liquid can be supplied to a liquid ejection head, and a tank unit and a liquid ejection system that include a tank. For example, the invention can also be achieved as a tank with which liquid can be supplied to an apparatus that consumes liquid other than a liquid ejection head, and a tank unit and a liquid consuming system that include this tank. Note that in this specification, the term "system" means a set of a plurality of constituent elements that are combined in a complex manner in an integrated or dispersed state such that respective functions are directly or indirectly associated with one another in order to achieve one or more functions. Accordingly, the system in this specification also includes an "apparatus" in which a plurality of constituent elements are combined in an integrated manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment:

Configuration of Printer

Figure 1:
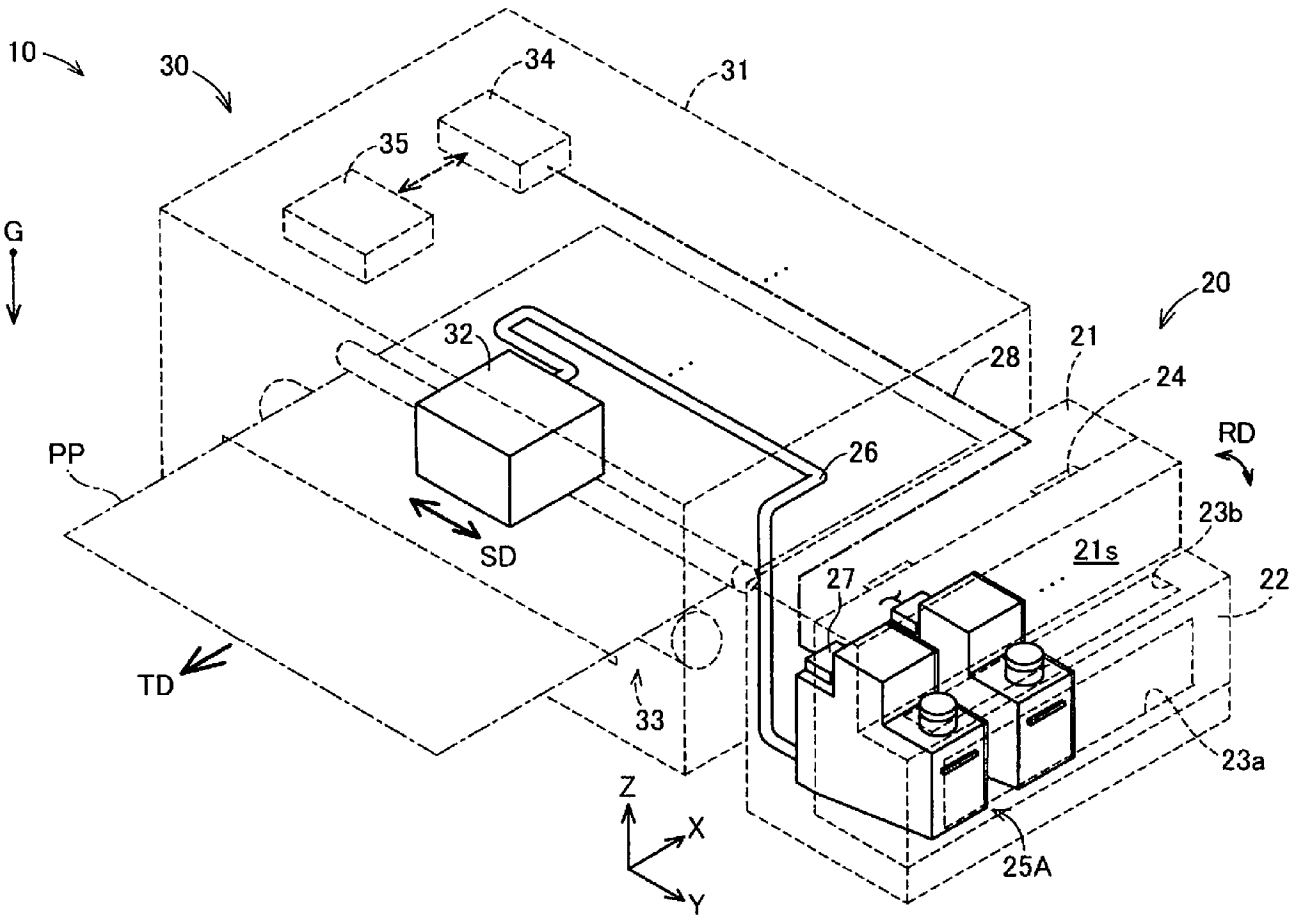
FIG. 1 is a schematic view showing a configuration of a printer according to a first embodiment.

FIG. 1 is a schematic view showing a configuration of an inkjet printer 10 (hereinafter referred to simply as a "printer 10") that includes ink tanks 25A, each of which serves as a first embodiment of the invention. In FIG. 1, an arrow G, which indicates the gravity direction, is shown. In this specification, "upper/above" and "lower/below" mean the up-down direction based on the gravity direction, unless otherwise stated. In FIG. 1, arrows X, Y, and Z, which indicate three orthogonal directions with the ink tank 25A as a reference, are also shown. The directions indicated by the arrows X, Y, and Z will be described later. The arrows G, X, Y, and Z are also shown as appropriate in the diagrams that are referenced in the following description.

The printer 10, which is an embodiment of a liquid ejection system according to the invention, discharges ink droplets to print paper PP, which is a print medium, and forms an image on a print surface of the print paper PP. The printer 10 includes a tank unit 20 and a print unit 30. The tank unit 20 includes a casing portion 21, a plurality of ink tanks 25A, a plurality of tubes 26, a plurality of connection circuit units 27, and a plurality of signal lines 28 (indicated by alternate long and short dashed lines).

Each ink tank 25A is an embodiment of a tank according to the invention. Ink of different colors is contained in the respective ink tanks 25A. The ink contained in the ink tanks 25A is supplied to a print head portion 32 of a print portion 30 via flexible resin tubes 26 connected to the ink tanks 25A in one-to-one correspondence.

Electrode pins (not shown in the diagram), which are terminals used for detecting contained ink, are attached to each ink tank 25A, and these electrode pins are electrically connected to the connection circuit unit 27. The connection circuit units 27 are electrically connected to an ink detecting portion 34 of the print portion 30 via the signal lines 28. Details of a configuration of the ink tanks 25A and the electrode pins will be described later.

In the tank unit 20, the ink tanks 25A are fixed in an internal space 21s of the casing portion 21 in a state of being arranged in a line in the width direction, which will be described later and indicated by the arrow X. The casing portion 21 includes a lid portion 22. The lid portion 22 is connected to the main body of the casing portion 21 through a hinge mechanism 24, and is opened and closed by pivoting in the direction indicated by an arrow RD. The casing portion 21 may not be configured to be able to be opened and closed by the pivoting of the lid portion 22. For example, the casing portion 21 may be configured to be able to be opened and closed by attaching and removing the lid portion 22.

The lid portion 22 is provided with two opening portions 23*a* and 23*b* that allows a part of the housed ink tanks 25A to be viewed from the outside of the casing portion 21. The first opening portion 23*a* is provided such that a user can visually check a visual check portion, which will be described later, of each ink tank 25A. The second opening portion 23*b* is provided such that the user can supply ink to each ink tank 25A without opening the lid portion 22. An ink injection portion, which will be described later, of each ink tank 25A extends from the second opening portion 23*b*.

The print portion 30 corresponds to a subordinate concept of a liquid ejection apparatus, and includes a casing portion 31, the print head portion 32, a conveyance mechanism 33 for conveying print paper PP, an ink detecting portion 34, and a control portion 35. The casing portion 31 is an exterior portion of the print portion 30, and houses the control portion 35, the print head portion 32, and the conveyance mechanism 33.

In the printer 10 according to this embodiment, the casing portion 21 of the tank unit 20 and the casing portion 31 of the print portion 30 are connected to each other in an attachable, detachable, and pivotable state (not shown in the diagram). As a result of the tank unit 20 and the print portion 30 being thus configured as separate bodies, the tank unit 20 and the print portion 30 can be individually maintained, which increases the maintainability of the printer 10. In addition, as a result of the tank unit 20 and the print portion 30 being connected to each other, movement and installation of the printer 10 are facilitated. However, the tank unit 20 and the print portion 30 may not be connected to each other.

The print head portion 32 is installed so as to be able to move back and forth in a main scanning direction SD on a conveyance path of the print paper PP. The print head portion 32 is connected to the ink tanks 25A in the tank unit 20 via the aforementioned plurality of tubes 26. The print head portion 32 can eject the ink supplied from the ink tanks 25A under the control of the control portion 35. The print head portion 32 corresponds to a subordinate concept of a liquid ejection head according to the invention. The conveyance mechanism 33 can convey the print paper PP in a conveyance direction TD, which intersects the main scanning direction SD, by driving a conveyance roller to rotate.

The ink detecting portion 34 is electrically connected to the electrode pins of the ink tanks 25A via the signal lines 28 and the connection circuit units 27, as mentioned above. The ink detecting portion 34 cyclically applies a voltage for detecting the ink in each ink tank 25A to the electrode pins in the ink tank 25A via the corresponding signal line 28, and detects resistance that changes depending on a contact state between the electrode pins and the ink. The ink detecting portion 34 transmits a detection result to the control portion 35.

For example, the control portion 35 is constituted by a microcomputer that includes a central processing unit and a main storage device. The control portion 35 exerts various functions by the central processing unit loading various programs stored in an external storage device or a recording medium into the main storage device and executing these programs. In this embodiment, the control portion 35 functions as a print processing unit that controls the print portion 30 to execute print processing based on print data that is input to the control portion 35 from the outside of the printer 10. In the print processing, the conveyance mechanism 33 conveys the print paper PP, the print head portion 32 discharges ink droplets while moving back and forth in the main scanning direction SD, and thus a print image is formed on a print surface of the print paper PP.

The control portion 35 also functions as a remaining ink amount management unit that manages the amount of remaining ink in the ink tanks 25. The control portion 35 detects whether or not a predetermined amount of remaining ink or more is contained in each ink tank 25A based on a change in the resistance detected by the ink detecting portion 34 (details will be described later). If a too-little ink amount state where the amount of remaining ink is smaller than the predetermined amount of remaining ink is detected in an ink tank 25A, the control portion 35 executes notification processing for notifying the user of the arrival of an ink supply timing, and prompts the user to supply ink, for example. After the too-little ink amount state is detected, the control portion 35 starts to measure the amount of discharged ink that is discharged by the print head portion 32. When the amount of discharge reaches a predetermined amount of discharge, the control portion 35 detects an ink shortage state where the amount of remaining ink in an ink tank 25 has reached the minimum amount that may hinder the print processing. If the ink shortage state is detected, the control portion 35 suspends the print processing and notifies the user of this ink shortage state. Note that the aforementioned predetermined amount of remaining ink with which the too-little ink state is detected and the aforementioned predetermined amount of discharge with which the ink shortage state is detected may be different values.

Configuration of Ink Tanks

Figure 2:
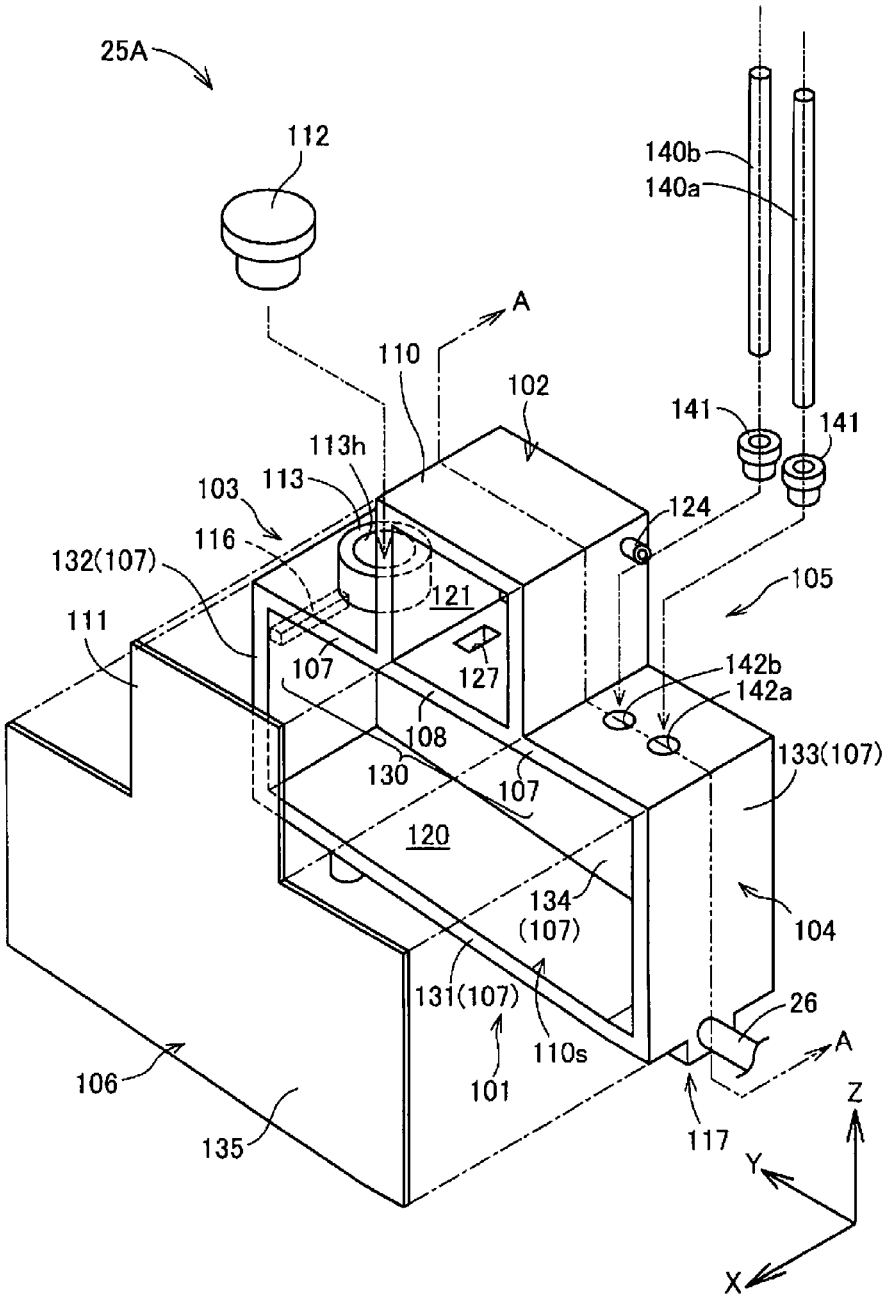
FIG. 2 is an exploded schematic perspective view of an ink tank according to the first embodiment.
Figure 3:
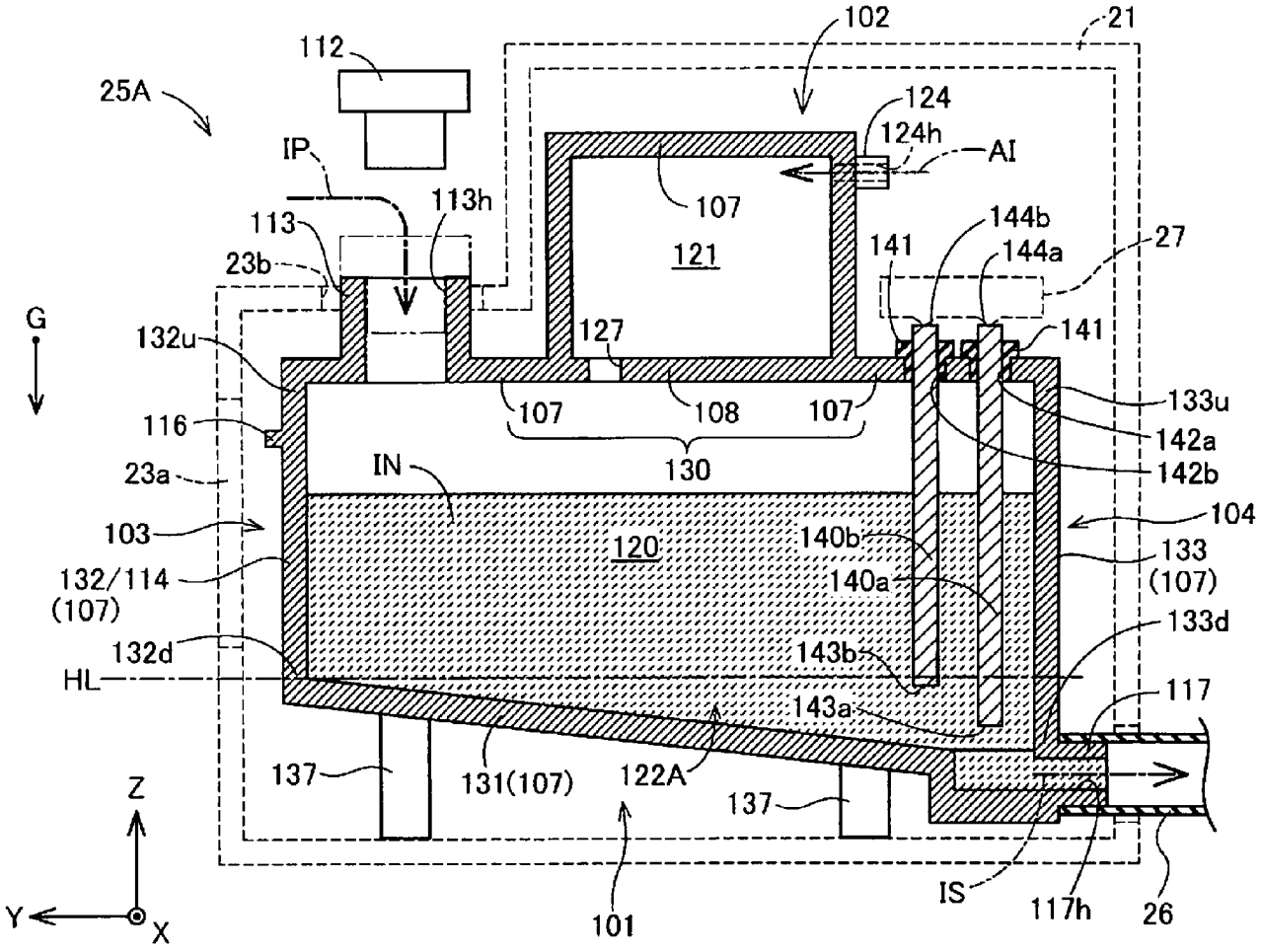
FIG. 3 is a schematic cross-sectional view of the ink tank according to the first embodiment.

A configuration of the ink tanks 25A will be described with reference to FIGS. 2 and 3 as well as FIG. 1. FIG. 2 is an exploded schematic perspective view of an ink tank 25A. FIG. 3 is a schematic cross-sectional view of the ink tank 25A taken along a line A-A shown in FIG. 2. FIG. 3 schematically shows an exemplary state where the ink tank 25A that contains ink IN is housed in the casing portion 21 in the tank unit 20, and a cap member 112 has been removed. The following is a description of a schematic configuration of the main body of the ink tank 25A, and each constituent portion of the ink tank 25A will be described in the order of an atmosphere introduction portion 121, an ink containing portion 120, an ink injection portion 113, an ink supply portion 117, and a pair of electrode pins 140*a* and 140*b*.

Schematic Configuration of Main Body of Ink Tank

Each ink tank 25A is configured as a hollow container having six face portions 101 to 106 (FIG. 2). The six face portions 101 to 106 will be described based on a posture at the time when the ink tank 25A is attached to the tank unit 20 (FIG. 1). In the following description, this posture will also be called a "reference posture". In this embodiment, the posture of the ink tank 25A at the time of supplying ink to the print head portion 32 when ejecting the ink is the same as the reference posture. That is to say, the reference posture corresponds to a mode of a liquid supply posture according to the invention. In this embodiment, the posture of the ink tank 25A at the time when the ink is supplied to the ink tank 25A by the user is also the same as the reference posture.

In the ink tank 25A, a first face portion 101 constitutes a bottom face portion that faces downward, and a second face portion 102 constitutes an upper face portion that faces upward (FIGS. 1 and 2). A part of the second face portion 102 directly faces the second opening portion 23*b* of the casing portion 21 in the tank unit 20. A third face portion 103 intersects the first face portion 101 and the second face portion 102, and constitutes a front portion that faces the user when the lid portion 22 of the casing portion 21 is opened in the tank unit 20. A part of the third face portion 103 directly faces the first opening portion 23*a* of the casing portion 21 in the tank unit 20, and can be viewed from the outside of the casing portion 21 via the first opening portion 23*a*. A fourth face portion 104 intersects the first face portion 101 and the second face portion 102, and constitutes a back face portion that faces in a direction opposite to the third face portion 103. A fifth face portion 105 intersects the aforementioned four face portions 101 to 104, and constitutes a left side face portion that is located to the left side when viewed directly facing the third face portion 103. A sixth face portion 106 intersects four face portions 101 to 104, and constitutes a right side face portion that is located to the right side opposite to the third face 103 when viewed directly facing the third face portion 103. Note that in this embodiment, two face portions "intersecting" each other means any one of a state where the two face portions actually intersect each other, a state where an extended face of one of the face portions intersects the other face portion, and a state where extended faces of the two face portions intersect each other.

Subsequently, the arrows X, Y, and Z, which indicate three directions with the ink tank 25A as a reference, will be described. The arrow X indicates a direction parallel with the width direction (left-right direction) of the ink tank 25A, and indicates a direction extending from the fifth face portion 105 toward the sixth face portion 106. In the following description, "right" means the side in the arrow X direction, and "left" means the side in the direction opposite to the arrow X direction. The arrow Y indicates a direction parallel with the depth direction (front-rear direction) of the ink tank 25A, and indicates a direction extending from the fourth face portion 104 toward the third face portion 103. In the following description, "front" means the side in the arrow Y direction, and "rear" means the side in the direction opposite to the arrow Y direction. The arrow Z indicates the height direction (up-down direction) of the ink tank 25A, and indicates a direction extending from the first face portion 101 toward the second face portion 102. In the reference posture, the arrow Z is oriented in the direction opposite to the gravity direction.

The main body portion of the ink tank 25A is constituted by a case member 110 and a sheet member 111. The case member 110 is a hollow box body that constitutes the main body portion of the ink tank 25A. The overall case member 110 on the sixth face portion 106 side is open in the arrow X direction, and outer wall portions 107 that surround an internal space 110*s* of the case member 110 constitute five face portions other than the sixth face portion 106, namely the face portions 101 to 105. For example, the case member 110 is produced by integrally molding synthetic resin, such as nylon or polypropylene.

The sheet member 111 is a flexible thin-film member, and is joined so as to seal the overall opening portion of the case member 110 to constitute the sixth face portion 106 of the ink tank 25A (FIG. 2). For example, the sheet member 111 is constituted by a film member formed by synthetic resin such as nylon or polypropylene. The sheet member 111 is joined to the case member 110 by means of adhesion, for example. Thus, the main body portion of the ink tank 25A according to this embodiment is configured to be simple and lightweight by the case member 110 and the sheet member 111. Note that the fifth face portion 105 side of the ink tank 25A may also be constituted by a sheet member that is joined to the case member 110, as the sixth face portion 106 side of the ink tank 25A is.

In the ink tank 25A, an inner wall portion 108 is provided in the internal space 110*s* of the case member 110 (FIGS. 2 and 3). The inner wall portion 108 has roughly the same position in the arrow X direction as that of the outer wall portion 107, and is adhered to the sheet member 111 together with the outer wall portion 107. The internal space 110*s* between the case member 110 and the sheet member 111 is partitioned into an ink containing portion 120, which is located below, and an atmosphere introduction portion 121, which is located above, by the inner wall portion 108.

Atmosphere Introduction Portion

The atmosphere introduction portion 121 is a portion that functions as an atmosphere flow path for introducing the atmosphere (air) from the outside of the ink tank 25A to the ink containing portion 120 (FIGS. 2 and 3). In this embodiment, the atmosphere introduction portion 121 is configured as a hollow portion capable of containing the atmosphere that is to be introduced to the ink containing portion 120, and is provided so as to project upward at the center of the ink tank 25A in the front-rear direction. The atmosphere introduction portion 121 is not limited to a hollow portion having a substantially rectangular parallelepiped shape as shown in the diagram, and may have other configurations. For example, the atmosphere introduction portion 121 may be configured to be partitioned by an inner wall portion and include a plurality of hollow portions that are in communication with each other.

The atmosphere introduction portion 121 is in communication with the outside of the ink tank 25A via an atmosphere intake portion 124. In this embodiment, the atmosphere intake portion 124 is configured as a cylindrical portion having a through hole 124*h* that is in communication with the atmosphere introduction portion 121, and is provided in the outer wall portion 107 on the fourth face portion 104 side relative to the atmosphere introduction portion 121. The atmosphere outside the ink tank 25A is taken into the atmosphere introduction portion 121 from the atmosphere intake portion 124, as indicated by an arrow Al. The atmosphere intake portion 124 may be provided in other portions, and may be formed in, for example, a part of the outer wall portion 107 located above the atmosphere introduction portion 121, or a part of the outer wall portion 107 on the fifth face portion 105 side relative to the atmosphere introduction portion 121.

In the inner wall portion 108 that partitions the ink containing portion 120 and the atmosphere introduction portion 121, a communication path 127 is formed as a through hole that passes through the inner wall portion 108. The atmosphere contained in the atmosphere introduction portion 121 is introduced to the ink containing portion 120 via the communication path 127. In the ink tank 25A, as the ink IN in the ink containing portion 120 is consumed, the internal pressure of the ink containing portion 120 becomes negative, and the atmosphere is introduced to the ink containing portion 120 from the atmosphere introduction portion 121 via the atmosphere introduction portion 121.

Ink Containing Portion

The ink containing portion 120 is a hollow portion capable of storing the ink IN (FIGS. 2 and 3). The ink containing portion 120 corresponds to a subordinate concept of a liquid containing portion according to the invention. In this embodiment, the ink containing portion 120 is formed over the width direction and the front-rear direction of the ink tank 25A. The ink containing portion 120 has an upper wall portion 130, a bottom wall portion 131, a first side wall portion 132, a second side wall portion 133, a third side wall portion 134, and a fourth side wall portion 135.

The upper wall portion 130 is a wall portion that extends above the ink containing portion 120 in a direction that intersects the gravity direction. In this embodiment, "to extend" means a state of continuously extending in a predetermined direction, and may be a state of bending in the middle of extension, or may be a curved state. A through hole or a shape with projections and recesses may be formed in the upper wall portion 130. In this embodiment, the upper wall portion 130 is configured as a wall portion that extends in the front-rear direction (horizontal direction), and is constituted by the outer wall portion 107 that constitutes the second face portion 102, and the inner wall portion 108.

The bottom wall portion 131 is a wall portion below the ink containing portion 120, the bottom wall portion 131 extending in a direction that intersects the gravity direction while opposing the upper wall portion 130. The bottom wall portion 131 is constituted by the outer wall portion 107 that constitutes the first face portion 101. In this embodiment, the bottom wall portion 131 inclines downward from the third face portion 103 side to the fourth face portion 104 side, and an end portion thereof on the fourth face portion 104 side is lowest. For example, the bottom wall portion 131 may have an inclination angle of about 5 to 10 degrees relative to a horizontal plane. In a lower face of the bottom wall portion 131, a plurality of leg portions 137 having different heights are arranged in the front-rear direction so as to be able to keep the arrangement posture of the ink tank 25A in the reference posture.

The first side wall portion 132 is a wall portion that extends between the upper wall portion 130 and the bottom wall portion 131, and is constituted by the outer wall portion 107 that constitutes the third face portion 103. In this embodiment, the first side wall portion 132 extends in the gravity direction. The first side wall portion 132 intersects the upper wall portion 130 at its upper end portion 132*u*, and intersects the bottom wall portion 131 at its lower end portion 132*d*.

In the ink tank 25A according to this embodiment, a part of or the overall first side wall portion 132 is configured to be transparent or translucent. Thus, the first side wall portion 132 functions as a visual check portion 114 for allowing the user to visually check the liquid surface of the ink IN in the ink containing portion 120 from the outside of the ink tank 25A. In this embodiment, the overall first side wall portion 132 is the visual check portion 114, and the upper end portion 132*u* and the lower end portion 132*d* of the first side wall portion 132 correspond respectively to an upper end portion and a lower end portion of the visual check portion 114. With the ink tank 25A according to this embodiment, the user can be visually prompted to supply the ink IN by the visual check portion 114, and accordingly, continuation of a too-little ink amount state or a state close to this too-little ink amount state for a long period is suppressed. Furthermore, since the user can check the amount of ink via the visual check portion 114 when supplying the ink IN, an excessive supply of the ink IN to the ink containing portion 120 is suppressed.

In this embodiment, a mark portion 116 is provided in the wall face of the first side wall portion 132 in an upper region closer to the upper end portion 132*u* than to the lower end portion 132*d* of the first side wall portion 132. The mark portion 116 is formed so as to indicate the position of the liquid surface of the ink IN when a predetermined reference amount of the ink IN is contained in the ink tank 25A that is in the reference posture. In the ink tank 25A, the maximum amount (reference amount) of the ink IN that is to be contained in the ink tank 25A is defined by the indication of the mark portion 116. For example, the mark portion 116 may be formed as a projecting portion or a recessed portion in the wall face portion of the third face portion 103, or may be formed by a print or attaching a seal. The mark portion 116 may be omitted.

As mentioned above, in the tank unit 20, the first side wall portion 132 directly faces the first opening portion 23*a*. The first opening portion 23*a* defines a visual field area in which the ink IN in the ink tank 25A can be viewed from the outside of the tank unit 20. It is favorable that an upper end portion of the first opening portion 23*a* is located above the mark portion 116. It is also favorable that a lower end portion of the first opening portion 23*a* is located below the center position of the first side wall portion 132 in the up-down direction. The lower end portion of the first opening portion 23*a* may be located at the same height as the lower end portion of the first side wall portion 132, or may be located at a position below the lower end portion 132*d* of the first side wall portion 132. In the tank unit 20, it is possible to construe, as the visual check portion, a region of the first side wall portion 132 that overlaps the opening region of the first opening portion 23*a* as viewed in the horizontal direction.

In the ink tank 25A according to this embodiment, as a result of having the bottom wall portion 131 that inclines downward from the lower end portion 132*d* of the first side wall portion 132, the lower portion 122A capable of storing the ink IN is formed below the visual check portion 114 in the ink containing portion 120. Note that, in FIG. 3, the height position HL of the lower end portion 132*d* of the first side wall portion 132 is indicated by an alternate long and short dash line in order to indicate the lower portion 122A. The height position HL of the lower end portion 132*d* of the first side wall portion 132 is also similarly indicated in the diagrams that are referenced in the following descriptions of the other embodiments.

In the ink tank 25A according to this embodiment, as a result of having the lower portion 122A, an occurrence of a sudden ink shortage state is suppressed even if the user fails to supply the ink IN until the liquid surface of the ink IN falls out of the visual check portion 114. Furthermore, in the ink tank 25A according to this embodiment, the accuracy of detection of the amount of remaining ink in the lower portion 122A is increased by the pair of electrode pins 140*a* and 140*b* (details will be described later).

The second side wall portion 133 is a wall portion that extends between the upper wall portion 130 and the bottom wall portion 131 at a position opposing the first side wall portion 132 with the upper wall portion 130 and the bottom wall portion 131 therebetween. The second side wall portion 133 is constituted by the outer wall portion 107 that constitutes the fourth face portion 104. In this embodiment, the second side wall portion 133 extends in the gravity direction as the first side wall portion 132 does. An upper end portion 133*u* of the second side wall portion 133 is located at the same height as the upper end portion 132*u* of the first side wall portion 132. A lower end portion 133*d* of the second side wall portion 133 is located at a position lower than the lower end portion 132*d* of the first side wall portion 132. In FIG. 3, the height position HL of the lower end portion 132*d* of the first side wall portion 132 is indicated by an alternate long and short dash line.

The third side wall portion 134 is a wall portion that intersects the upper wall portion 130, the bottom wall portion 131, the first side wall portion 132, and the second side wall portion 133, and is constituted by the wall portion 107 that constitutes the fifth face portion 105. The fourth side wall portion 135 is a wall portion that opposes the third side wall portion 134 and intersects the upper wall portion 130, the bottom wall portion 131, the first side wall portion 132, and the second side wall portion 133. The fourth side wall portion 135 is constituted by a part of the sheet member 111 that constitutes the sixth face portion 106.

Ink Injection Portion

The ink injection portion 113 is provided in the upper wall portion 130 of the ink containing portion 120 (FIGS. 2 and 3). The ink injection portion 113 is a portion that is in communication with the ink containing portion 120 from the outside of the ink tank 25A such that the ink IN can be injected into the ink containing portion 120. The ink injection portion 113 corresponds to a subordinate concept of a liquid injection portion according to the invention. In this embodiment, the ink injection portion 113 is constituted by a cylindrical portion having a through hole 113*h* that is in communication with the ink containing portion 120. The ink injection portion 113 is provided at a position on the third face portion 103 side closer to the third face portion 103 than to the fourth face portion 104, i.e., at a position between the third face portion 103 and the atmosphere introduction portion 121, such that the user can easily access the ink injection portion 113. The ink injection portion 113 extends upward from the second opening portion 23*b* of the casing portion 21 (FIG. 3).

Usually, the cap member 112 is attached in an airtight manner to an upper end portion of the ink injection portion 113. The cap member 112 has a portion that is inserted into the through hole 113*h* of the ink injection portion 113 and closely fitted to an inner wall portion of the through hole 113*h*. For example, the cap member 112 is produced with synthetic resin, such as nylon or polypropylene. The user can supply the ink IN to the ink containing portion 120 as indicated by an arrow IP by removing the cap member 112 from the ink injection portion 113.

Ink Supply Portion

The ink supply portion 117 is formed at a lower end of the ink containing portion 120 on the fourth face portion 104 side. The ink supply portion 117 is a portion that is in communication with the lower portion 122A of the ink containing portion 120 from the outside of the ink tank 25A such that the ink IN in the ink containing portion 120 can be supplied to the print head portion 32 (FIG. 1). In this embodiment, the ink supply portion 117 is connected to a lower end of the ink containing portion 120 on the fourth face portion 104 side, i.e., a lower end portion of the lower portion 122A. The ink supply portion 117 is configured as a cylindrical portion having a through hole 117*h*, and projects rearward from the outer wall portion 107 of the case member 110. The tube 26, which is connected to the print head portion 32, is connected to the ink supply portion 117 in an airtight manner. Note that the ink supply portion 117 may be configured to extend upward from a lower end side of the fourth face portion 104, such that the attaching direction of the tube 26 is a direction opposite to the arrow Z.

As mentioned above, in the ink tank 25A according to this embodiment, the bottom wall portion 131 of the ink containing portion 120 inclines downward from the third face portion 103 side to the fourth face portion 104 side, and the ink supply portion 117 is connected to the lower end of the bottom wall portion 131 (FIG. 3). Accordingly, almost all ink IN stored in the ink containing portion 120 is guided to the ink supply portion 117 by the gravity. Thus, when in a state where the ink IN in the ink containing portion 120 has been mostly consumed, the ink IN remaining in the ink containing portion 120 is suppressed.

Pair of Electrode Pins

In the ink tank 25A according to this embodiment, the pair of electrode pins 140*a* and 140*b* that are used for detecting the ink IK are housed in the ink containing portion 120 (FIGS. 2 and 3). The pair of electrode pins 140*a* and 140*b* correspond to a subordinate concept of an electrode member according to the invention. A first electrode pin 140*a* corresponds to a subordinate concept of a first electrode member according to the invention, and a second electrode pin 140*b* corresponds to a subordinate concept of a second electrode member according to the invention. In this embodiment, the electrode pins 140*a* and 140*b* are constituted by conductive members that extend in a bar-like shape such as metal pins. It is favorable that the electrode pins 140*a* and 140*b* are constituted by members with which formation of an oxide layer on a surface due to attachment of the ink is suppressed. For example, the electrode pins 140*a* and 140*b* may be made of stainless steel, or may be made of carbon.

Two through holes 142*a* and 142*b* in which the electrode pins 140*a* and 140*b* are respectively inserted are provided in the upper wall portion 130. In this embodiment, the two through holes 142*a* and 142*b* are arranged at positions between the second side wall portion 133 and the atmosphere introduction portion 121, i.e., positions on the second side wall portion 133 side that is closer to the second side wall portion 133 than to the first side wall portion 132. The first electrode pin 140*a* is inserted in the first through hole 142*a*, and the second electrode pin 140*b* is inserted in the second through hole 142*b*.

Cylindrical seal members 141 are fitted between an inner circumferential face of the first through hole 142*a* and the first electrode pin 140*a* and between an inner circumferential face of the second through hole 142*b* and the second electrode pin 140*b*. Thus, fixability of the electrode pins 140*a* and 140*b* to the upper wall portion 130 is increased, and the airtightness of the ink containing portion 120 is increased.

In the ink containing portion 120, the electrode pins 140*a* and 140*b* extend in the gravity direction downward from above at positions close to each other. The distance between the electrode pins 140*a* and 140*b* may be about 5 mm to 20 mm, for example. Both tip portions 143*a* and 143*b*, which are lower end portions of the electrode pins 140*a* and 140*b*, are located at positions lower than the lower end portion 132*d* of the first side wall portion 132 of the ink containing portion 120. That is to say, both the leading end portions 143*a* and 143*b* of the electrode pins 140*a* and 140*b* are arranged in the lower portion 122A that is a portion below the visual check portion 114 in the ink tank 25A. A reason for this will be described later.

In this embodiment, rear end portions 144*a* and 144*b*, which are upper end portions of the electrode pins 140*a* and 140*b*, are located at the same height positions outside the ink containing portion 120. The first electrode pin 140*a* is longer than the second electrode pin 140*b*. For this reason, in the ink containing portion 120, the leading end portion 143*b* of the second electrode pin 140*b* is at a position higher than the leading end portion 143*a* of the first electrode pin 140*a*.

Note that in this specification, "the same height" means being at substantially the same height, and for example, being within the range of ±5% can be construed as being at the same height, taking a tolerance into consideration.

In the printer 10 (FIG. 1), the electrode pins 140*a* and 140*b* are connected to the ink detecting portion 34 via the connection circuit unit 27. As mentioned above, in this embodiment, the rear end portions 144*a* and 144*b* of the electrode pins 140*a* and 140*b* are located at the same height position. For this reason, the connection circuit unit 27 can be configured in a flat plate shape, and the configuration of the connection circuit unit 27 can be simplified and made small. Furthermore, the connection of the connection circuit unit 27 to the electrode pins 140*a* and 140*b* is simplified, and the connectability thereof is increased.

Detection of Amount of Remaining Ink Using Electrode Pins

The ink detecting portion 34 cyclically applies a voltage to the second electrode pin 140*b* so as to cause an alternating current to flow through the ink IN, and detects resistance between the first electrode pin 140*a* and the second electrode pin 140*b* while the print processing is being executed or while the print processing is paused. Note that the alternating current caused to flow through the ink IN may be generated by connecting the first electrode pin 140*a* to a capacitor and causing the capacitor to repeat storage and discharge of electric energy via the two electrode pins 140*a* and 140*b*. If the ink IN in the ink containing portion 120 is consumed, the liquid surface of the ink IN is lowered to a position lower than the leading end portion 143*b* of the second electrode pin 140*b*, and electric conductivity between the ink IN and the second electrode pin 140*b* is interrupted, the resistance between the two electrode pins 140*a* and 140*b* increases. The control portion 35 detects a too-little ink amount state where the amount of ink in the ink containing portion 120 is smaller than a prescribed amount, when the resistance detected by the ink detecting portion 34 has increased and become larger than or equal to a predetermined threshold. Note that the control portion 35 may detect a change in the resistance in accordance with a change of a contact area of the electrode pins 140*a* and 140*b* with the ink IN as a change in the amount of the ink in the ink containing portion 120.

In this embodiment, the leading end portions 143*a* and 143*b* of the electrode pins 140*a* and 140*b* are arranged in the lower portion 122A. Accordingly, the ink can be detected in the lower portion 122A where it is difficult for the user to visually check the ink IN. Furthermore, in the ink tank 25A according to this embodiment, the accuracy of detection of the amount of the ink using the electrode pins 140*a* and 140*b* is increased by the configuration of the lower portion 122A, which will be described below.

In the lower portion 122A according to this embodiment, the cross-sectional area of the ink containing portion 120 in a horizontal cross-section is smaller at a lower position as a result of the bottom wall portion 131 inclining downward to the second side wall portion 133 side. The lower portion 122A according to this embodiment corresponds to a subordinate concept of an inclined portion according to the invention. Note that the cross-sectional area of the ink containing portion 120 in a horizontal cross-section means the area of a region surrounded by the inner circumferential wall faces of the ink containing portion 120 in a cross-sectional plane parallel with the horizontal direction.

In the lower portion 122A, even if the ink tank 25A inclines relative to the reference posture, a change of the position of the liquid surface of the ink IN is suppressed compared with a portion above the lower portion 122A where the cross-sectional area of a horizontal cross-section is large. The same applies to the case where the ink tank 25A is swinging. Accordingly, erroneous detection of a too-little ink amount state due to a change of the liquid surface position of the ink IN caused by a change in the arrangement posture of the ink tank 25A relative to the reference posture is suppressed. Furthermore, in the ink tank 25A according to this embodiment, the bottom wall portion 131 inclines downward. Therefore, the ink IN can be easily collected around the leading end portions 143*a* and 143*b* of the electrode pins 140*a* and 140*b*, and erroneous detection of the too-little ink amount state is further suppressed.

In the ink tank 25A according to this embodiment, the pair of electrode pins 140*a* and 140*b* are located in a region on the second side wall portion 133 side. That is to say, the pair of electrode pins 140*a* and 140*b* are located between the second side wall portion 133 and an intermediate position between the first side wall portion 132 and the second side wall portion 133. Thus, the leading end portions 143*a* and 143*b* of the electrode pins 140*a* and 140*b* are arranged in the region where the ink IN is collected, and accordingly, the accuracy of detection of the amount of remaining ink is increased. Furthermore, since the leading end portions 143*a* and 143*b* of the electrode pins 140*a* and 140*b* are arranged at lower positions at which the horizontal cross-sectional area is smaller, erroneous detection of the too-little ink amount state is further suppressed. Furthermore, the electrode pins 140*a* and 140*b* are arranged at positions closer to the second side wall portion 133 that does not have a function of the visual check portion 114 than to the first side wall portion 132 that has a function of the visual check portion 114. For this reason, interruption of a visual check of the ink IN via the visual check portion 114 is suppressed, and the correctness in understanding the amount of the remaining ink IN by means of a visual check is increased.

In the ink tank 25A according to this embodiment, the bottom wall portion 131 inclines downward toward the second side wall portion 133 located on the side opposite to the visual check portion 114, and the ink IN in the ink containing portion 120 is guided to a region away from the visual check portion 114 by the gravity. For this reason, it is easy to allow the user to visually recognize that the amount of the remaining ink IN is small before the too-little ink amount state is detected via the electrode pins 140*a* and 140*b*. Furthermore, in the ink tank 25A according to this embodiment, since the pair of electrode pins 140*a* and 140*b* are arranged at positions closer to the ink supply portion 117, the accuracy of detection of the amount of remaining ink using the electrode pins 140*a* and 140*b* is increased.

In the ink tank 25A according to this embodiment, the pair of electrode pins 140*a* and 140*b* extend in the gravity direction. For this reason, the ink IN that is attached to the electrode pins 140*a* and 140*b* above the liquid surface of the ink IN is guided downward by the gravity. Accordingly, an occurrence of a state where unnecessary ink IN is attached to the electrode pins 140*a* and 140*b* is suppressed, and a decrease in the accuracy of detection of the ink IN due to the attachment of the ink IN is suppressed. Furthermore, in the ink tank 25A according to this embodiment, the pair of electrode pins 140*a* and 140*b* are arranged in parallel next to each other. Accordingly, an increase in the resistance between the electrode pins 140*a* and 140*b* is suppressed, the efficiency of the detection of the amount of remaining ink is increased, and the accuracy of this detection is also increased.

In the ink tank 25A according to this embodiment, the pair of electrode pins 140*a* and 140*b* are held by the upper wall portion 130. Accordingly, even if, for example, a part of the ink IN scatters and reaches a portion where the pair of electrode pins 140*a* and 140*b* are held in the upper wall portion 130, external force is applied to this ink IN in a falling direction from the upper wall portion 130 by the gravity. Accordingly, an occurrence of a short circuit between the electrode pins 140*a* and 140*b* due to the ink IN attached to the upper wall portion 130 is suppressed, and a decrease in the accuracy of the detection of the ink IN is suppressed. Furthermore, a leakage of the ink IN from the through holes 142*a* and 142*b*, a degradation of the seal member 141 due to the attachment of the ink IN, and the like are suppressed.

In the ink tank 25A according to this embodiment, the leading end portions 143*a* and 143*b* of the electrode pins 140*a* and 140*b* are located at different heights. For this reason, the amount of ink with which the too-little ink amount state is detected is defined by the position of the leading end portion 143*b* of the second electrode pin 140*b*, and is not significantly affected by the position of the leading end portion 143*a* of the first electrode pin 140*a* that is located at a position lower than the leading end portion 143*b* of the second electrode pin 140*b*. Accordingly, an occurrence of a variation in the accuracy of detection of the amount of remaining ink due to a position shift of the leading end portions 143*a* and 143*b* caused by a manufacturing error or the like is suppressed.

In addition, in the ink tank 25A according to this embodiment, the atmosphere introduction portion 121 projects upward at a position adjacent to the pair of electrode pins 140*a* and 140*b*. Thus, even if, for example, the ink tank 25A accidentally falls down with the second face portion 102 side downward, the electrode pins 140*a* and 140*b* are protected by the outer wall portion 107 that surrounds the atmosphere introduction portion 121. Furthermore, since the pair of electrode pins 140*a* and 140*b* are located on the fourth face portion 104 side that is the back face side of the ink tank 25A, installation of the signal line 28 from the printer 10 is facilitated. Since the pair of electrode pins 140*a* and 140*b* are on the back face side that is difficult for the user to access, an accidental touch to the electrode pins 140*a* and 140*b* by the user or the like is suppressed, and an occurrence of a contact failure at the electrode pins 140*a* and 140*b* or the like is suppressed.

In the printer 10 according to this embodiment, the leading end portion 143*b* of the second electrode pin 140*b* is located at a position higher than the leading end portion 143*a* of the first electrode pin 140*a*. The ink detecting portion 34 applies a voltage to the second electrode pin 140*b* when detecting the amount of remaining ink. If a voltage is applied to the first electrode pin 140*a*, a current flows through the ink IN via the first electrode pin 140*a* even after the liquid surface of the ink IN is separated from the leading end portion 143*b* of the second electrode pin 140*b*. In contrast, if a voltage is applied to the second electrode pin 140*b* as in the printer 10 according to this embodiment, application of a voltage to the ink IN is suppressed if the liquid surface of the ink IN is separated from the leading end portion 143*b* of the second electrode pin 140*b*. Accordingly, with the printer 10 according to this embodiment, a degradation of the ink IN due to an unnecessary current flowing in the ink IN when detecting the amount of remaining ink is suppressed.

Summary

As described above, with the ink tank 25A according to this embodiment, erroneous detection of the too-little ink amount state due to a change in the arrangement posture of the ink tank 25A is suppressed, and the amount of remaining ink can be more correctly understood. Furthermore, with the printer 10 according to this embodiment, the amount of remaining ink in the ink tank 25A can be appropriately managed. In addition, various effects described in the above embodiment can be achieved.

Figure 4:
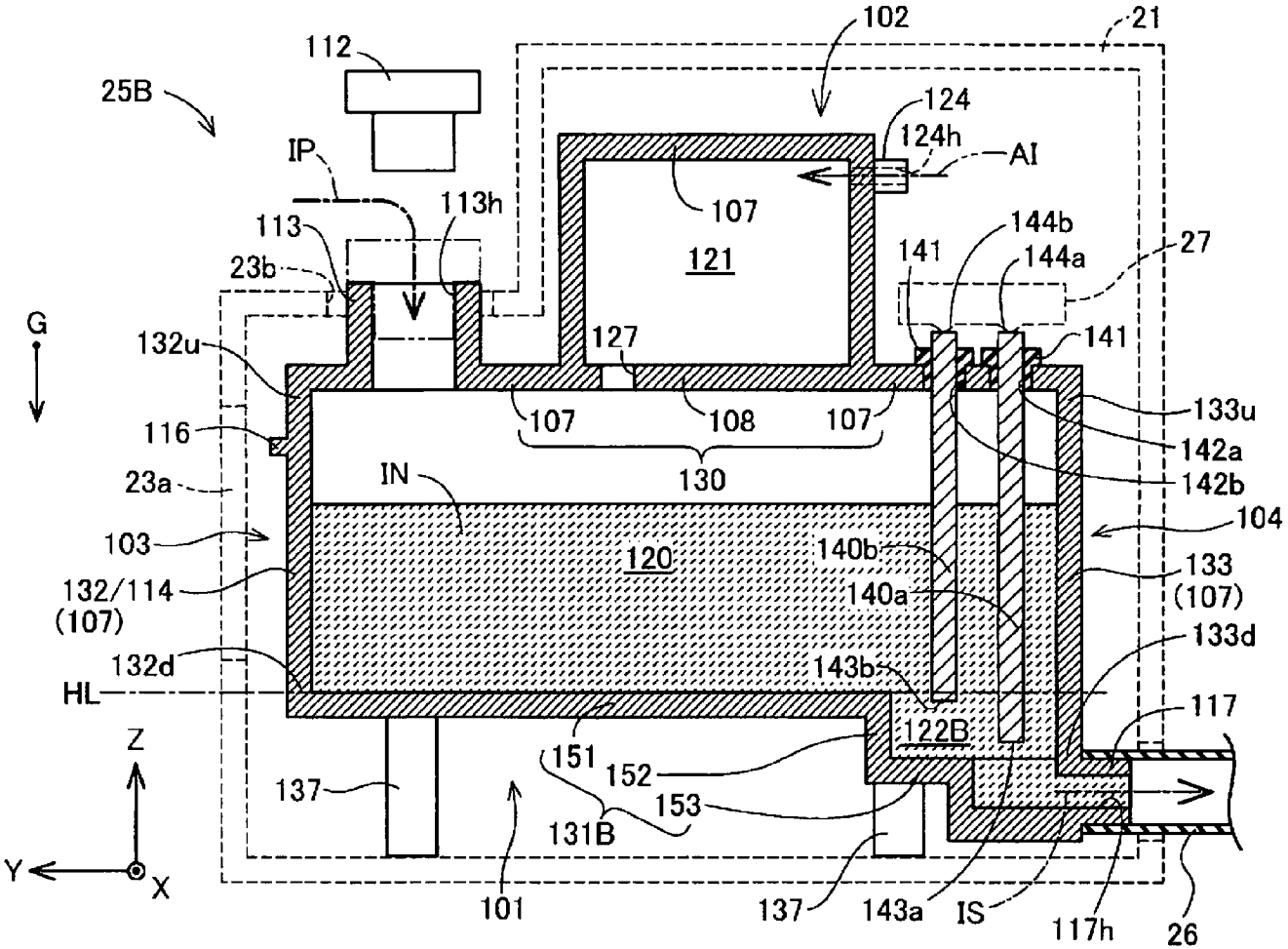
FIG. 4 is a schematic cross-sectional view showing a configuration of an ink tank according to a second embodiment.

B. Second Embodiment:

FIG. 4 is a schematic cross-sectional view showing a configuration of an ink tank 25B, which serves as a second embodiment of the invention. The ink tank 25B according to the second embodiment has a configuration similar to that of the ink tank 25A according to the first embodiment except that the configuration of a lower portion 122B is different, and is attached to the printer 10 (FIG. 1) having a configuration similar to that described in the first embodiment. In the following description and the reference diagrams, the same signs as those used in the first embodiment will be used for the same constituent portions as those described in the first embodiment, or corresponding constituent portions.

In the ink tank 25B according to the second embodiment, a bottom wall portion 131B of an ink containing portion 120 has a first horizontal portion 151, a step portion 152, and a second horizontal portion 153. The first horizontal portion 151 is a portion that horizontally extends in a direction opposite to the arrow Y up to a position before the portion where a pair of electrode pins 140*a* and 140*b* are arranged. The step portion 152 is a portion that extends downward from an end portion of the first horizontal portion 151 on the side in the direction opposite to the arrow Y. The second horizontal portion 153 is a portion that horizontally extends in the direction opposite to the arrow Y from a lower end portion of the step portion 152.

In the ink tank 25B according to the second embodiment, as a result of the step portion 152 being provided in the middle of the bottom wall portion 131B, the lower portion 122B is formed in a local region located below the portion where the pair of electrode pins 140*a* and 140*b* are arranged. The leading end portions 143*a* and 143*b* of the pair of electrode pins 140*a* and 140*b* are arranged within the lower portion 122B. Furthermore, the ink supply portion 117 is connected to the second horizontal portion 153 that constitutes a lower end portion of the lower portion 122B.

Here, in the ink tank 25B according to the second embodiment, the cross-sectional area of the ink containing portion 120 in a horizontal cross-section becomes smaller stepwise at an upper end of the lower portion 122B. That is to say, in the lower portion 122B, the cross-sectional area in a horizontal cross-section is smaller than the cross-sectional area of a portion located above the lower portion 122B. For this reason, in the lower portion 122B, a change of the liquid surface of the ink IN in accordance with a change of the arrangement posture of the ink tank 25B is suppressed, and the accuracy of the detection of the amount of remaining ink using the pair of electrode pins 140*a* and 140*b* is increased. Note that the lower portion 122B according to the second embodiment corresponds to a subordinate concept of a step portion according to the invention.

As described above, with the ink tank 25B according to the second embodiment, erroneous detection of the too-little ink amount state due to a change of the arrangement posture of the ink tank 25B is suppressed, and the amount of remaining ink can be more correctly understood. In addition, with the ink tank 25B according to the second embodiment, effects similar to those described in the first embodiment can be achieved.

Figure 5:
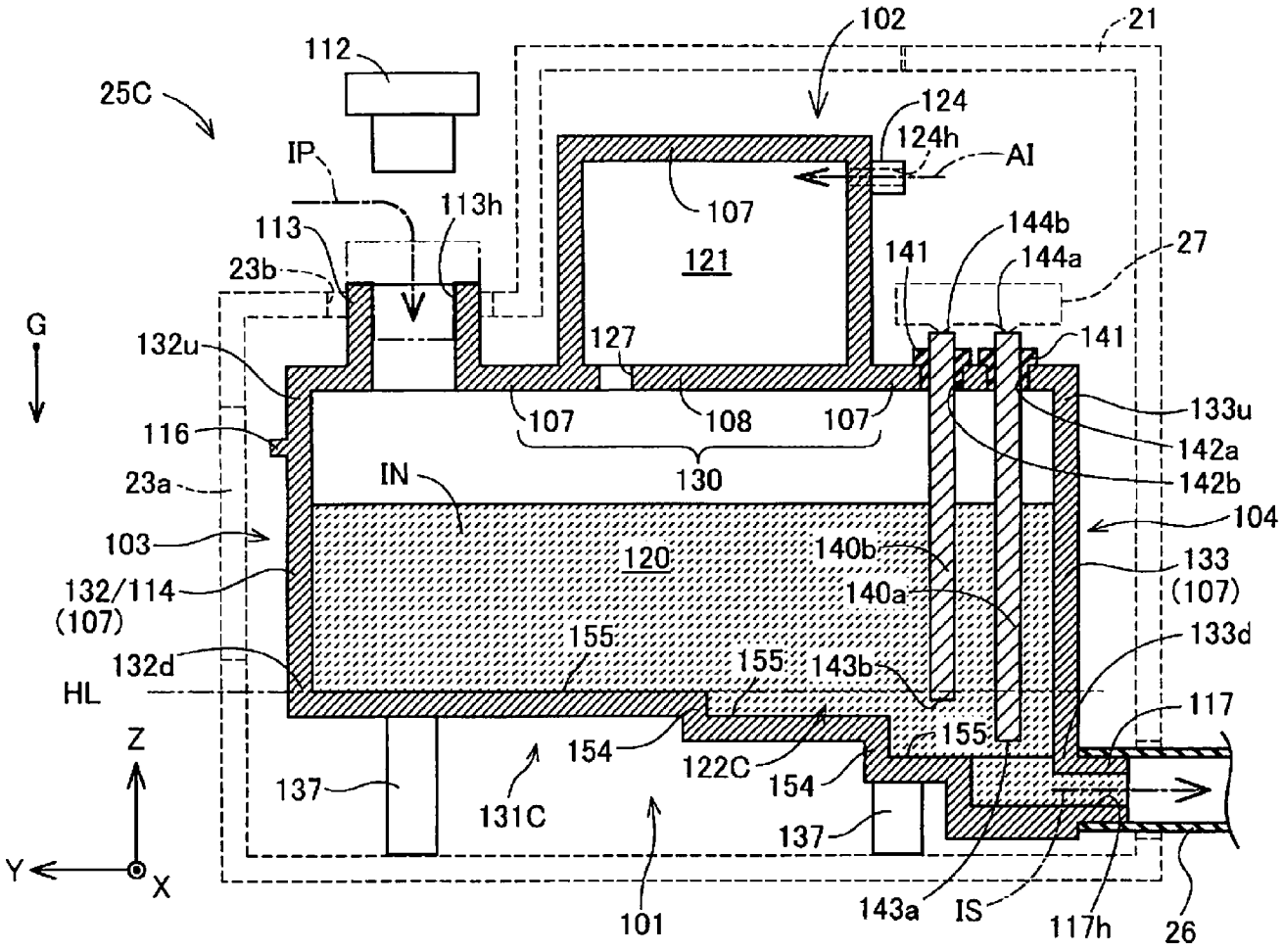
FIG. 5 is a schematic cross-sectional view showing a configuration of an ink tank according to a third embodiment.

C. Third Embodiment:

FIG. 5 is a schematic cross-sectional view showing a configuration of an ink tank 25C, which serves as a third embodiment of the invention. The ink tank 25C according to the third embodiment has a configuration similar to that of the ink tank 25B according to the second embodiment except that a step in the lower portion 122C is added, and is attached to the printer 10 (FIG. 1) having a configuration similar to that described in the first embodiment. In the following description and the reference diagrams, the same signs as those used in the above embodiments will be used for the same constituent portions as those described in the above embodiments, or corresponding constituent portions.

In the ink tank 25C according to the third embodiment, a bottom wall portion 131C of the ink containing portion 120 has a plurality of step portions 154, and the height position of a bottom face 155 of the bottom wall portion 131C becomes sequentially lower stepwise toward the portion where the electrode pins 140*a* and 140*b* are arranged. Thus, in a lower portion 122C of the ink containing portion 120 according to the third embodiment, the cross-sectional area in a horizontal plane becomes smaller stepwise in the gravity direction, and a change of the liquid surface of the ink IN in accordance with a change of the arrangement posture of the ink tank 25B is suppressed. Accordingly, the accuracy of detection of the amount of remaining ink using the pair of electrode pins 140*a* and 140*b* in the lower portion 122C is increased. Note that the lower portion 122C according to the third embodiment corresponds to a subordinate concept of a step portion according to the invention.

As described above, with the ink tank 25C according to the third embodiment, erroneous detection of the too-little ink amount state due to a change of the arrangement posture of the ink tank 25C is suppressed, and the amount of remaining ink can be more correctly understood. In addition, with the ink tank 25C according to the third embodiment, effects similar to those described in the above embodiments can be achieved.

Figure 6:
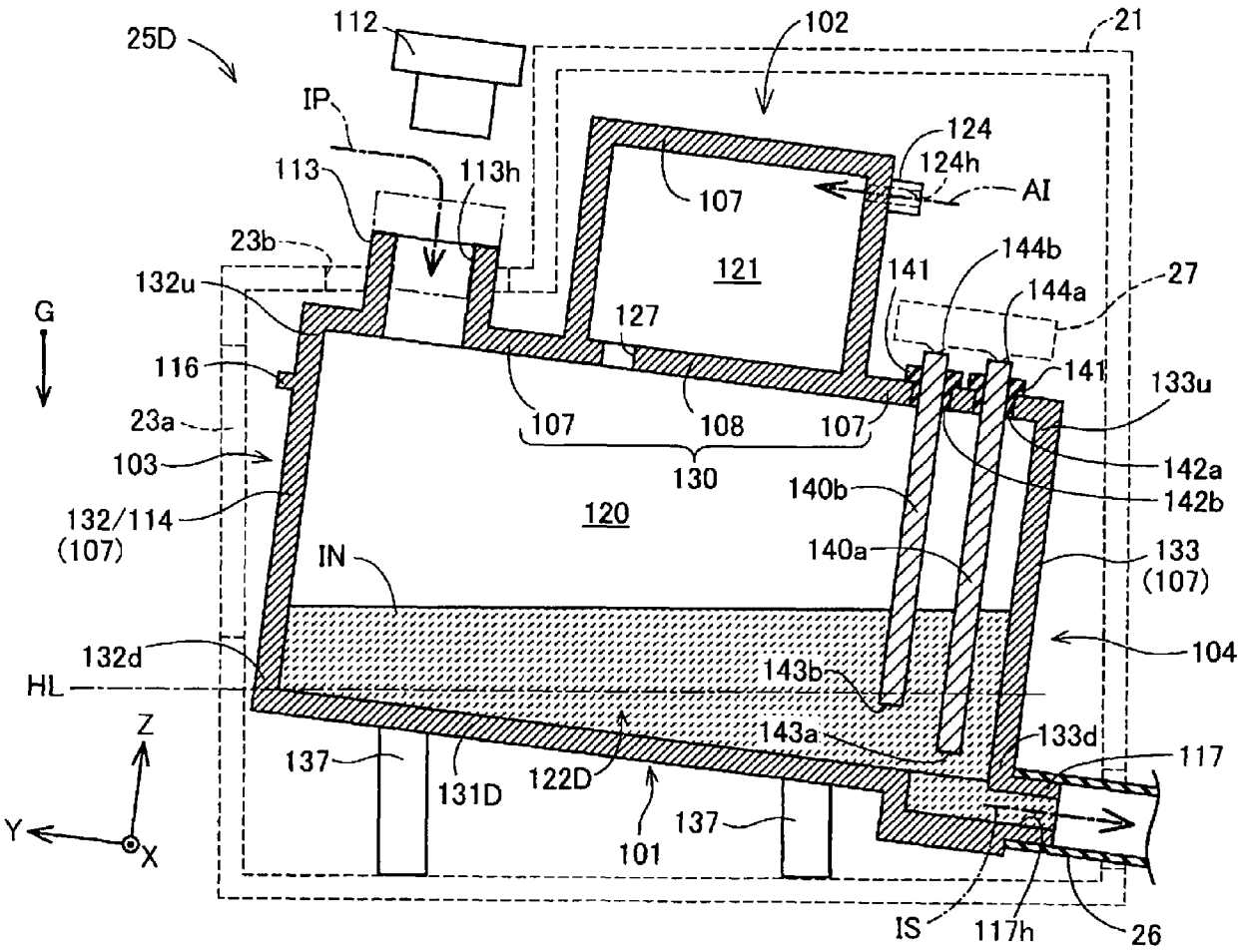
FIG. 6 is a schematic cross-sectional view showing a configuration of an ink tank according to a fourth embodiment.

D. Fourth Embodiment:

FIG. 6 is a schematic cross-sectional view showing a configuration of an ink tank 25D, which serves as a fourth embodiment of the invention. The ink tank 25D according to the fourth embodiment has a configuration similar to that of the ink tank 25A according to the first embodiment except the following points, and is attached to the printer 10 (FIG. 1) having a configuration similar to that described according to the first embodiment. In the following description and the reference diagrams, the same signs as those used in the above embodiments will be used for the same constituent portions as those described in the above embodiments, or corresponding constituent portions.

In the ink tank 25D according to the fourth embodiment, a bottom wall portion 131D of the ink containing portion 120 is configured as a wall portion that extends parallel with the upper wall portion 130. However, in the ink tank 25D according to the fourth embodiment, a plurality of leg portions 137 having different heights that are similar to those of the ink tank 25A according to the first embodiment are provided in a lower face of the bottom wall portion 131D. Thus, in the reference posture at the time when the ink tank 25D according to the fourth embodiment is arranged within the casing portion 21 of the tank unit 20, the upper wall portion 130 and the bottom wall portion 131D are in a state of inclining downward in a direction extending from the first side wall portion 132 toward the second side wall portion 133.

In the ink tank 25D according to the fourth embodiment when in the reference posture state, a lower portion 122D is formed at a position lower than the lower end portion 132*d* of the first side wall portion 132 that is a lower end of the visual check portion 114 as a result of the bottom wall portion 131D inclining as mentioned above. In the lower portion 122D according to the fourth embodiment, the cross-sectional area in a horizontal plane becomes smaller at a lower position. The lower portion 122D according to the fourth embodiment corresponds to a subordinate concept of an inclined portion according to the invention. The leading end portions 143*a* and 143*b* of the electrode pins 140*a* and 140*b* are arranged within the lower portion 122D.

As described above, with the ink tank 25D according to the fourth embodiment, the lower portion 122D located below the visual check portion 114 is formed when in the reference posture. Furthermore, as a result of the leading end portions 143*a* and 143*b* of the electrode pins 140*a* and 140*b* being arranged in this lower portion 122D, the ink detection accuracy in the lower portion 122D is increased. In addition, with the ink tank 25D according to the fourth embodiment, effects similar to those described in the first embodiment can be achieved.

Figure 7:
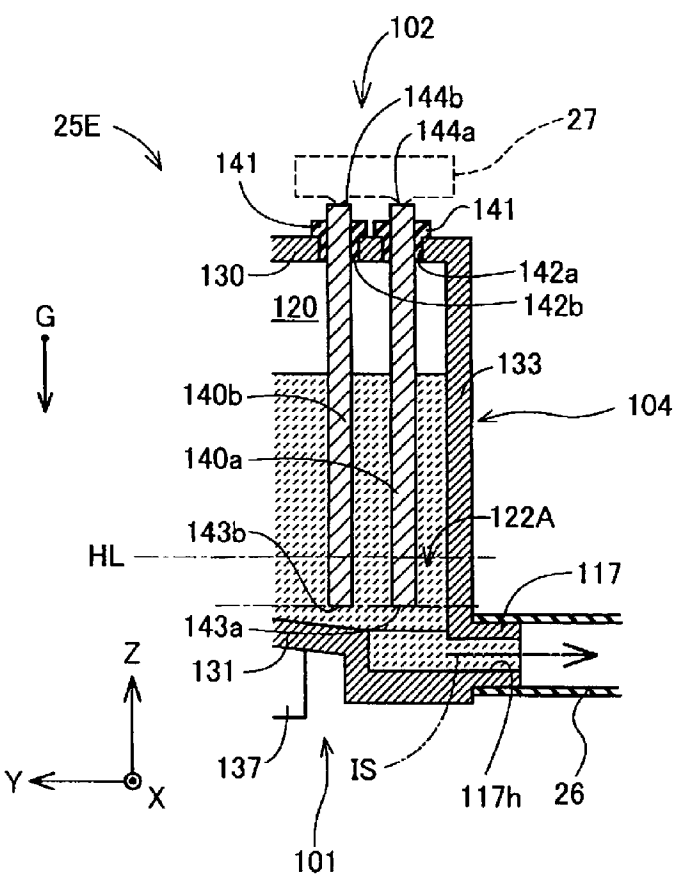
FIG. 7 is a schematic cross-sectional view showing a configuration of a part of an ink tank according to a fifth embodiment.

E. Fifth Embodiment:

FIG. 7 is a schematic cross-sectional view showing a configuration of a part of an ink tank 25E, which serves as a fifth embodiment of the invention. The ink tank 25E according to the fifth embodiment has a configuration similar to that of the ink tank 25A according to the first embodiment except the following points, and is attached to the printer 10 (FIG. 1) having a configuration similar to that described according to the first embodiment. In the following description and the reference diagrams, the same signs as those used in the above embodiments will be used for the same constituent portions as those described in the above embodiments, or corresponding constituent portions.

In the ink tank 25E according to the fifth embodiment, the electrode pins 140*a* and 140*b* are constituted by metal pins that have the same length, and the leading end portions 143*a* and 143*b* are arranged at the same height. With this configuration as well, since the leading end portions 143*a* and 143*b* of the electrode pins 140*a* and 140*b* are arranged in the lower portion 122A, the accuracy of detection of the amount of remaining ink can be similarly increased as described in the first embodiment. Furthermore, since the electrode pins 140*a* and 140*b* can be constituted by the same parts, manufacturing costs can be reduced. Furthermore, an occurrence of an error in installation of the electrode pins 140*a* and 140*b* is suppressed. In addition, with the ink tank 25E according to the fifth embodiment, effects similar to those described in the first embodiment can be achieved. Note that the configuration of the electrode pins 140*a* and 140*b* according to the fifth embodiment may be applied to the ink tanks 25B to 25D according to the second, third, and fourth embodiments.

Figure 8:
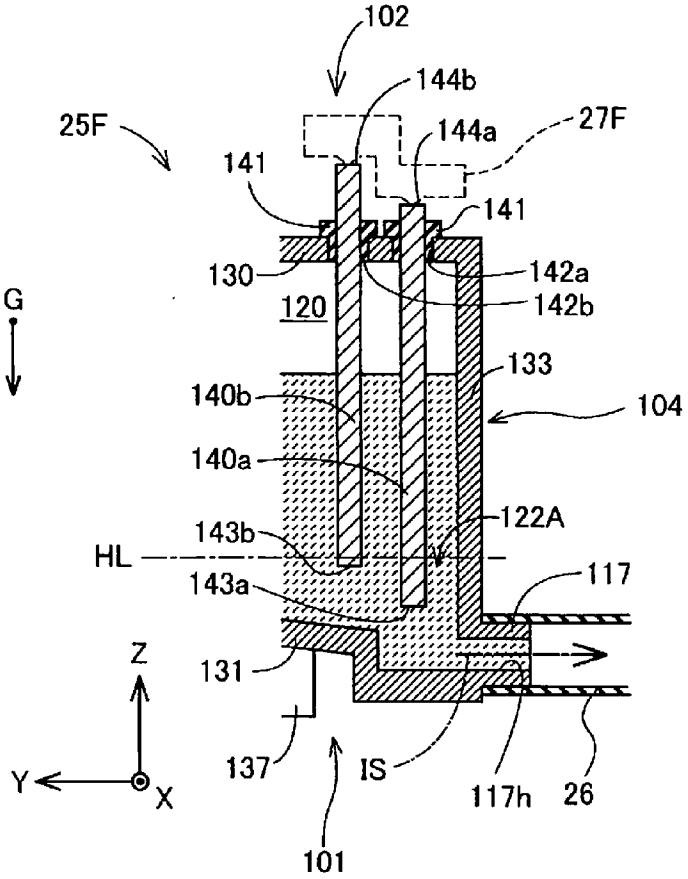
FIG. 8 is a schematic cross-sectional view showing a configuration of a part of an ink tank according to a sixth embodiment.

F. Sixth Embodiment:

FIG. 8 is a schematic cross-sectional view showing a configuration of a part of an ink tank 25F, which serves as a sixth embodiment of the invention. The ink tank 25F according to the sixth embodiment has a configuration similar to that of the ink tank 25A according to the first embodiment except the following points, and is attached to the printer 10 (FIG. 1) having a configuration similar to that described according to the first embodiment. In the following description and the reference diagrams, the same signs as those used in the above embodiments will be used for the same constituent portions as those described in the above embodiments, or corresponding constituent portions.

In the ink tank 25F according to the sixth embodiment, the electrode pins 140*a* and 140*b* are constituted by metal pins that have the same length. In the ink tank 25F according to the sixth embodiment, the height position of the rear end portion 144*a* of the first electrode pin 140*a* is lower than the rear end portion 144*b* of the second electrode pin 140*b*. Thus, the leading end portion 143*b* of the second electrode pin 140*b* is located above the leading end portion 143*a* of the first electrode pin 140*a*. Note that in the tank unit 20 according to the sixth embodiment, the positions of electrodes of the connection circuit unit 27F are offset in the up-down direction, which is a connecting direction of the connection circuit unit 27F, such that the electrodes thereof can be connected to the rear end portions 144*a* and 144*b* of the electrode pins 140*a* and 140*b* having different height positions.

With the ink tank 25F according to the sixth embodiment as well, the accuracy of detection of the amount of remaining ink in the lower portion 122A can be increased as described in the first embodiment. Furthermore, since the electrode pins 140*a* and 140*b* can be constituted by the same parts, manufacturing costs can be reduced as with the ink tank 25E according to the fifth embodiment. In addition, with the ink tank 25F according to the sixth embodiment, effects similar to those described in the first embodiment can be achieved. Note that the configuration of the electrode pins 140*a* and 140*b* according to the sixth embodiment may be applied to the ink tanks 25B to 25D according to the second, third, and fourth embodiments.

Figure 9:
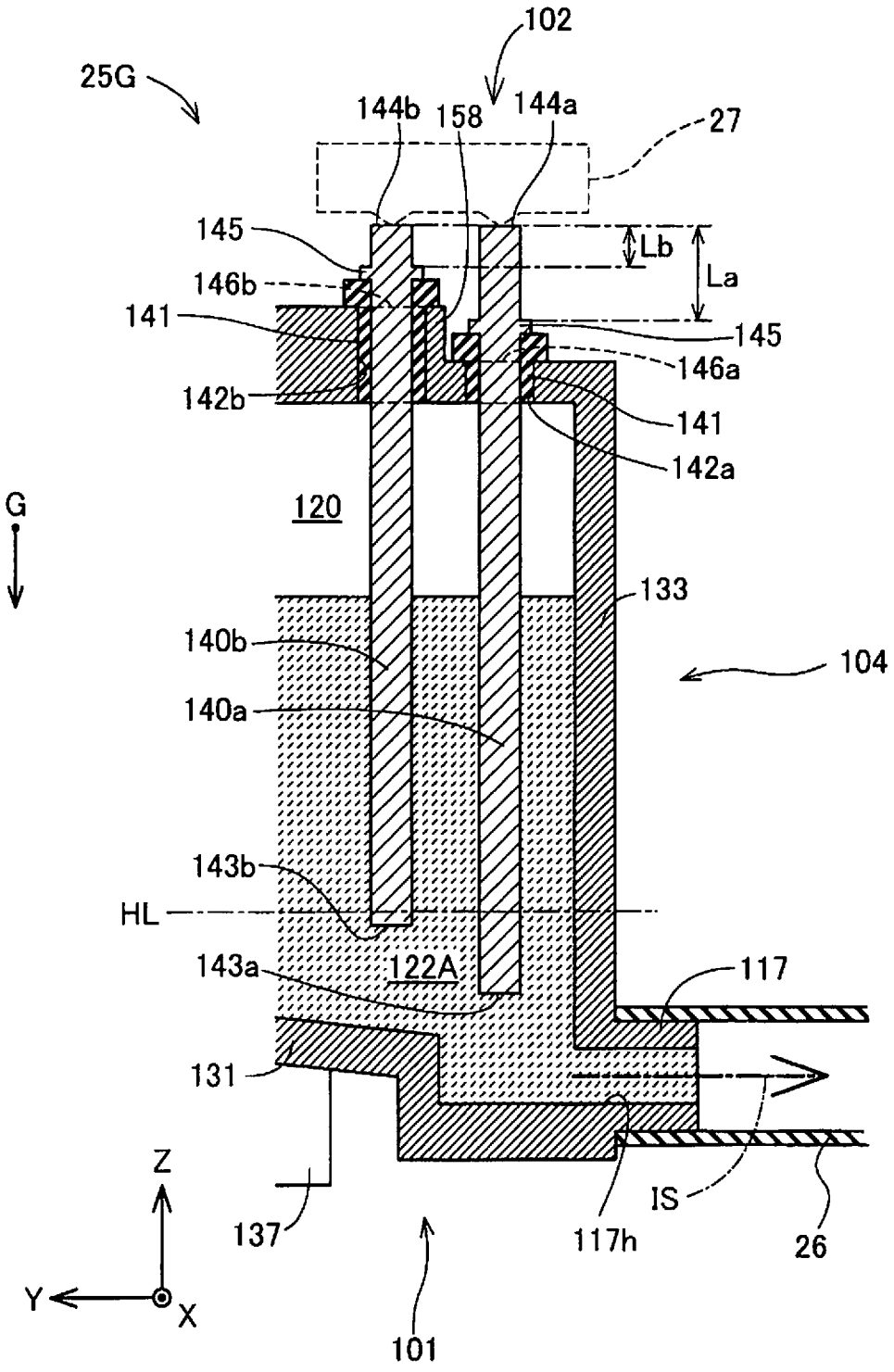
FIG. 9 is a schematic cross-sectional view showing a configuration of a part of an ink tank according to a seventh embodiment.

G. Seventh Embodiment:

FIG. 9 is a schematic cross-sectional view showing a configuration of a part of an ink tank 25G, which serves as a seventh embodiment of the invention. The ink tank 25G according to the seventh embodiment has a configuration similar to that of the ink tank 25A according to the first embodiment except the following points, and is attached to the printer 10 (FIG. 1) having a configuration similar to that described according to the first embodiment. In the following description and the reference diagrams, the same signs as those used in the first embodiment will be used for the same constituent portions as those described in the first embodiment, or corresponding constituent portions.

In the ink tank 25G serving as the seventh embodiment, electrode pins 140*a* and 140*b* are similarly attached as in the ink tank 25A according to the first embodiment. Specifically, the electrode pins 140*a* and 140*b* are attached such that the rear end portions 144*a* and 144*b* thereof are located at the same height, and the leading end portion 143*b* of the second electrode pin 140*b* is located above the leading end portion 143*a* of the first electrode pin 140*a*.

In the ink tank 25G according to the seventh embodiment, a restriction portion 145 for positioning is provided in each of the electrode pins 140*a* and 140*b*. The restriction portion 145 is configured as a ring-shaped protruding portion that projects in a radius direction in the outer circumference of each of the electrode pins 140*a* and 140*b*. The restriction portion 145 of each of the electrode pins 140*a* and 140*b* comes into contact with an inner circumferential edge of the seal member 141 and restricts a movement of the electrode pins 140*a* and 140*b* downward of a predetermined attachment position. Thus, the positioning accuracy and fixability at attaching positions of the electrode pins 140*a* and 140*b* are increased, and the accuracy of detection of the amount of remaining ink using the electrode pins 140*a* and 140*b* is increased. Furthermore, the attachment of the electrode pins 140*a* and 140*b* is facilitated.

In the ink tank 25G according to the seventh embodiment, a step portion 158 is provided in an upper wall face of the upper wall portion 130, and an opening end portion 146*b* located above the second through hole 142*b* is located above an opening end portion 146*a* located above the first through hole 142*a*. Thus, the position at which a movement of the restriction portion 145 of the second electrode pin 140*b* is restricted is located above the position at which a movement of the restriction portion 145 of the first electrode pin 140*a* is restricted.

In the ink tank 25G according to the seventh embodiment, since the height positions of the opening end portions 146*a* and 146*b* on the upper side of the through holes 142*a* and 142*b* are different as described above, the restriction portions 145 of the electrode pins 140*a* and 140*b* are formed at respective appropriate positions. For this reason, the distance La between the rear end portion 144*a* and the restriction portion 145 of the first electrode pin 140*a* is longer than the distance Lb between the rear end portion 144*b* and the restriction portion 145 of the second electrode pin 140*b*. Thus, an occurrence of an error in installation of the electrode pins 140*a* and 140*b* is suppressed as described above.

Figure 10:
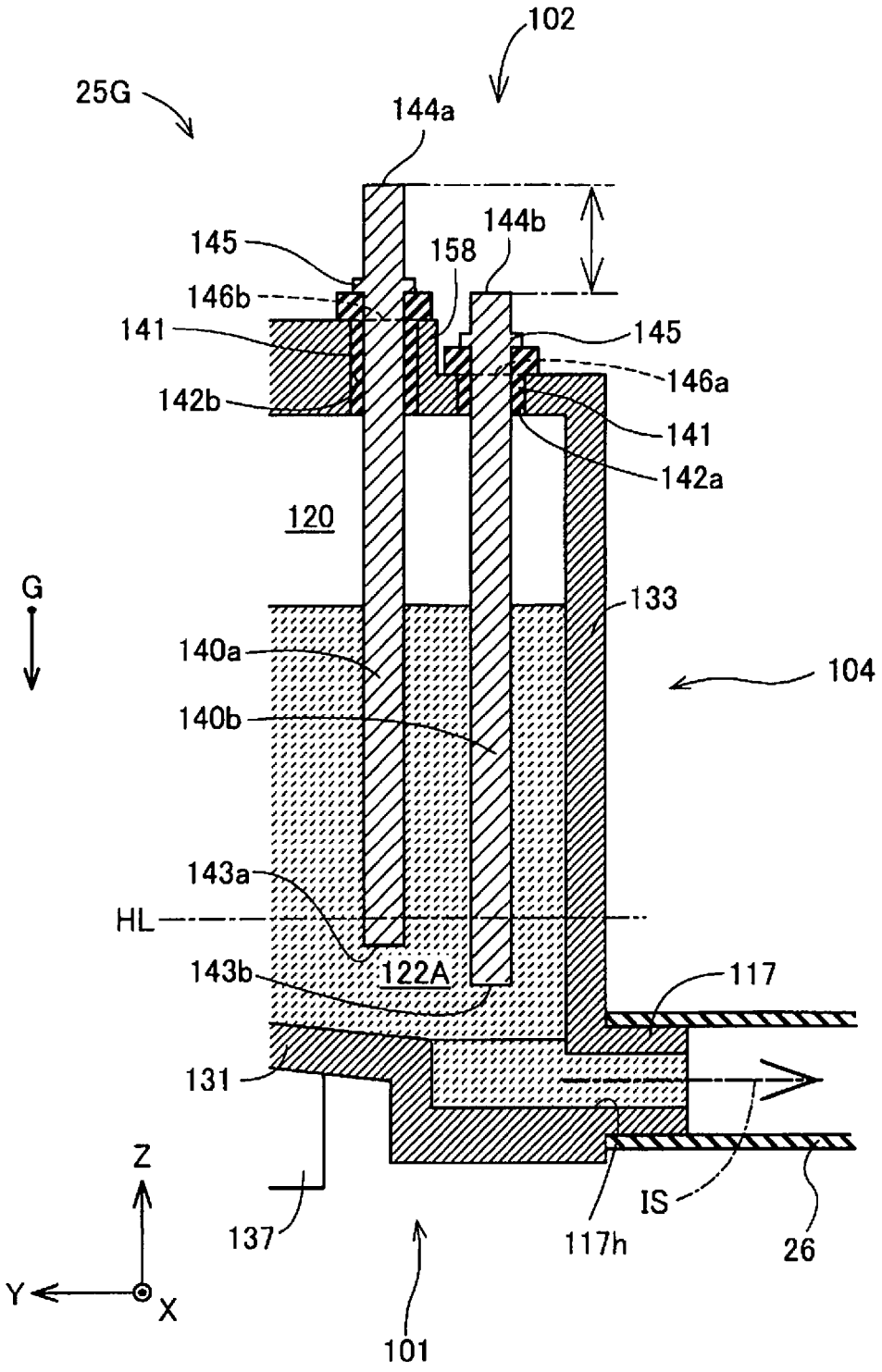
FIG. 10 is a schematic view showing an exemplary state where electrode pins are incorrectly installed.

FIG. 10 is a schematic diagram showing an exemplary state where the first electrode pin 140*a* and the second electrode pin 140*b* are incorrectly installed. When installing the electrode pins 140*a* and 140*b*, if, by mistake, the second electrode pin 140*b* is attached to the first through hole 142*a*, and the first electrode pin 140*a* is attached to the second through hole 142*b*, the heights of the rear end portions 144*a* and 144*b* are different. Therefore, the error in the installation of the electrode pins 140*a* and 140*b* can be easily found, and an occurrence of the error in the installation of the electrode pins 140*a* and 140*b* is suppressed.

In the ink tank 25G according to the seventh embodiment, the step portion 158 may be formed by the seal member 141 or other members. Furthermore, conversely to the above-described configuration, a configuration may also be employed in which the position at which a movement of the restriction portion 145 of the second electrode pin 140*b* is restricted is located below the position at which a movement of the restriction portion 145 of the first electrode pin 140*a* is restricted when the electrode pins 140*a* and 140*b* are correctly installed. With this configuration as well, an occurrence of an error in installation of the electrode pins 140*a* and 140*b* is suppressed.

As described above, with the ink tank 25G according to the seventh embodiment, the positioning accuracy of the electrode pins 140*a* and 140*b* is increased, and the accuracy of detection of the amount of remaining ink is increased. Furthermore, the attachment of the electrode pins 140*a* and 140*b* is facilitated, and an occurrence of an error in installation of the electrode pins 140*a* and 140*b* is suppressed. In addition, with the ink tank 25G according to the seventh embodiment, effects similar to those described in the first embodiment can be achieved. Note that the attachment structure of the electrode pins 140*a* and 140*b* in the ink tank 25G according to the seventh embodiment may be applied to the ink tanks 25B to 25F according to the above-described second, third, fourth, fifth, and sixth embodiments.

Figure 11:
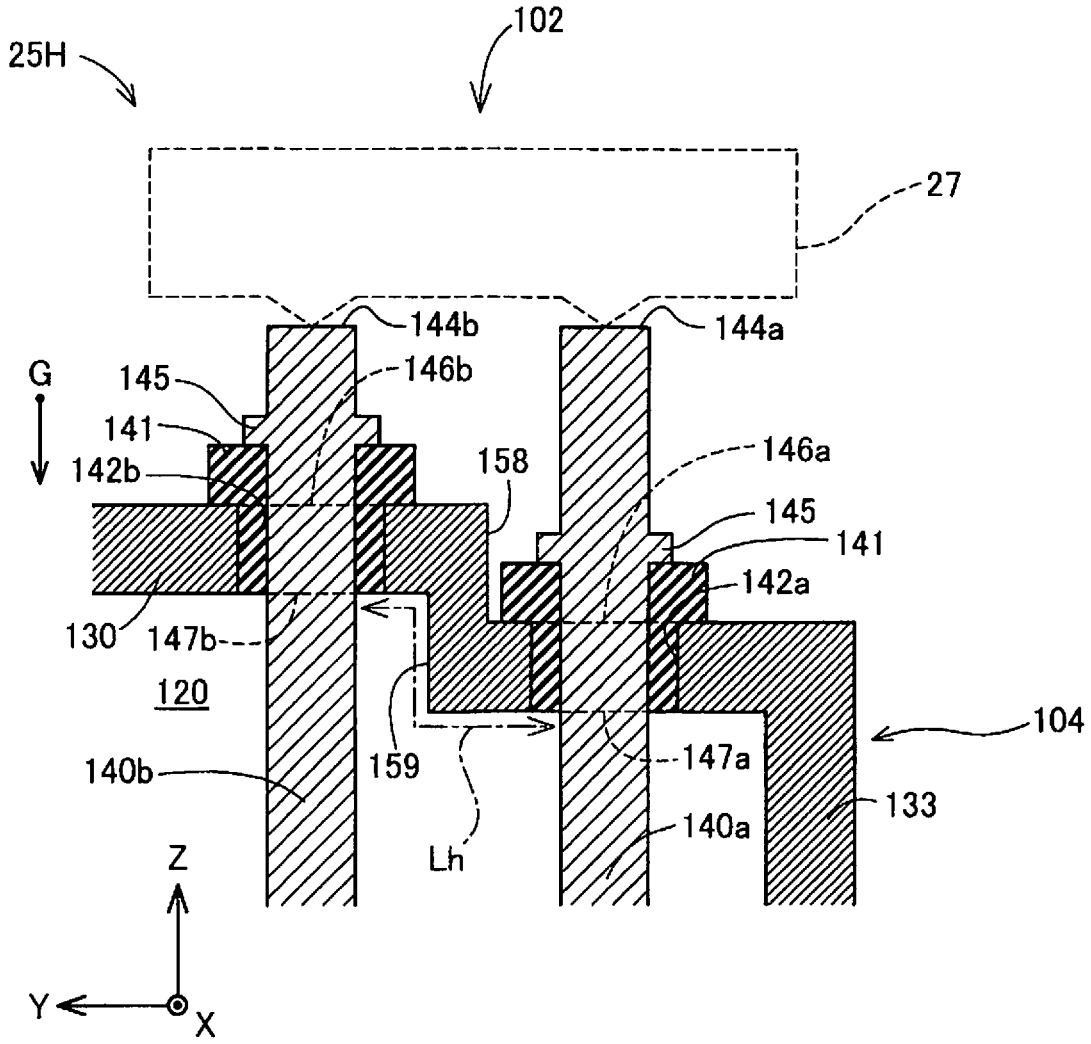
FIG. 11 is a schematic cross-sectional view showing a configuration of a part of an ink tank according to an eighth embodiment.

H. Eighth Embodiment:

FIG. 11 is a schematic cross-sectional view showing a configuration of a part of an ink tank 25H, which serves as an eighth embodiment of the invention. The ink tank 25H according to the eighth embodiment has a configuration similar to that of the ink tank 25G according to the seventh embodiment except the following points, and is attached to the printer 10 (FIG. 1) having a configuration similar to that described according to the first embodiment. In the following description and the reference diagrams, the same signs as those used in the seventh embodiments will be used for the same constituent portions as those described in the seventh embodiments, or corresponding constituent portions.

In the ink tank 25H according to the eighth embodiment, a step portion 159 is also provided in a lower wall face of the upper wall portion 130 in addition to the step portion 158 provided on an upper wall face of the upper wall portion 130. The two step portions 158 and 159 are formed at positions on opposite sides of the upper wall portion 130 in the thickness direction. Thus, the height position of the opening end portion 147*b* below the second through hole 142*b* is higher than the height position of the opening end portion 147*a* below the first through hole 142*a*.

As a result of having this configuration, the distance Lh between the electrode pins 140*a* and 140*b* along the lower wall face of the upper wall portion 130 is increased by the step portion 159. Accordingly, even if the ink IN in the ink containing portion 120 scatters and is attached to the upper wall portion 130, an occurrence of a short circuit between the electrode pins 140*a* and 140*b* due to the attached ink is suppressed. In addition, with the ink tank 25H according to the eighth embodiment, effects similar to those of the ink tank 25G according to the seventh embodiment can be achieved. Note that in the ink tank 25H according to the eighth embodiment, the step portion 158 in the upper wall portion 130 described in the seventh embodiment may be omitted. Furthermore, the configuration of the step portion 159 in the ink tank 25H according to the eighth embodiment may be applied to the ink tanks 25B to 25F according to the above-described second, third, fourth, fifth, and sixth embodiments.

Figure 12:
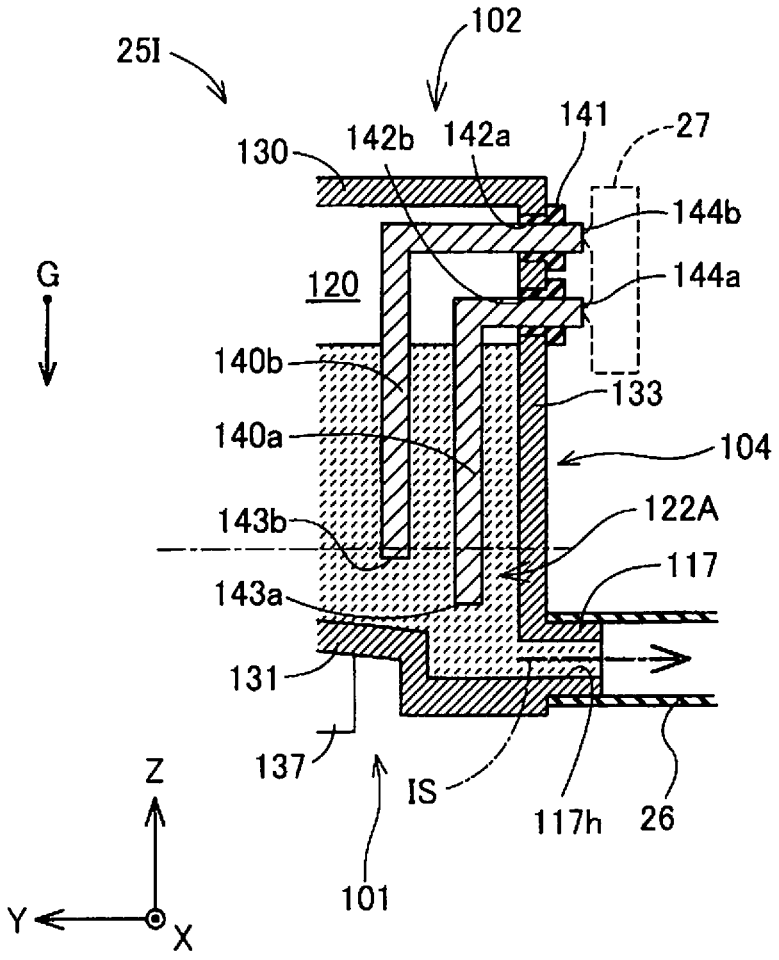
FIG. 12 is a schematic cross-sectional view showing a configuration of a part of an ink tank according to a ninth embodiment.

I. Ninth Embodiment:

FIG. 12 is a schematic cross-sectional view showing a configuration of a part of an ink tank 25I, which serves as a ninth embodiment of the invention. The ink tank 25I according to the ninth embodiment has a configuration similar to that of the ink tank 25A according to the first embodiment except the following points, and is attached to the printer 10 (FIG. 1) having a configuration similar to that described according to the first embodiment. In the following description and the reference diagrams, the same signs as those used in the first embodiments will be used for the same constituent portions as those described in the first embodiments, or corresponding constituent portions.

In the ink tank 25I according to the ninth embodiment, the through holes 142*a* and 142*b* in which the pair of electrode pins 140*a* and 140*b* are inserted are formed in an upper portion of the second side wall portion 133. The electrode pins 140*a* and 140*b* are inserted from the arrow Y direction toward the ink containing portion 120, and bends downward and extends toward the bottom wall portion 131 within the ink containing portion 120. The leading end portions 143*a* and 143*b* of the electrode pins 140*a* and 140*b* are arranged in the lower portion 122A of the ink containing portion 120. The leading end portion 143*a* of the first electrode pin 140*a* is located below the leading end portion 143*b* of the second electrode pin 140*b*. Note that the connection circuit unit 27 is connected to the rear end portions 144*a* and 144*b* of the electrode pins 140*a* and 140*b* with the arrow Y direction as the connecting direction.

With the ink tank 25I according to the ninth embodiment as well, the accuracy of detection of the amount of remaining ink is increased as a result of the leading end portions 143*a* and 143*b* of the electrode pins 140*a* and 140*b* being arranged in the lower portion 122A, as in the ink tank 25A according to the first embodiment. In addition, with the ink tank 25I according to the ninth embodiment, effects similar to those described in the first embodiment can be achieved. Note that in the ink tank 25I according to the ninth embodiment, the leading end portions 143*a* and 143*b* of the electrode pins 140*a* and 140*b* may be arranged at the same height. Furthermore, the through holes 142*a* and 142*b* may be provided in the third side wall portion 134 located on the fifth face portion 105 side or in the fourth side wall portion 135 located on the sixth face portion 106 side. The attachment structure of the electrode pins 140*a* and 140*b* in the ink tank 25I according to the ninth embodiment may be applied to the ink tanks 25B to 25H according to the above-described second, third, fourth, fifth, sixth, seventh, and eighth embodiments.

Figure 13:
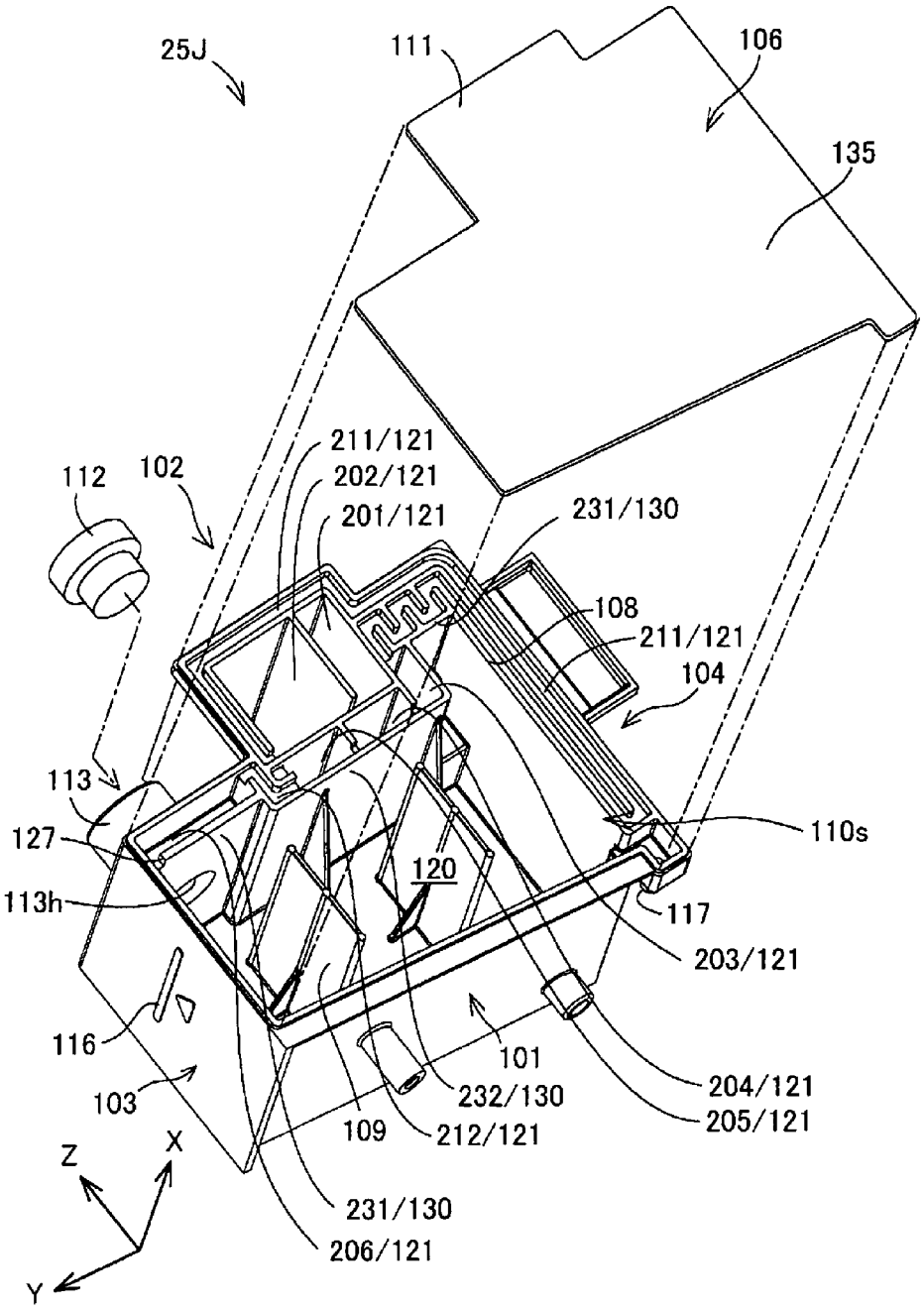
FIG. 13 is an exploded schematic perspective view of an ink tank according to a tenth embodiment.
Figure 14:
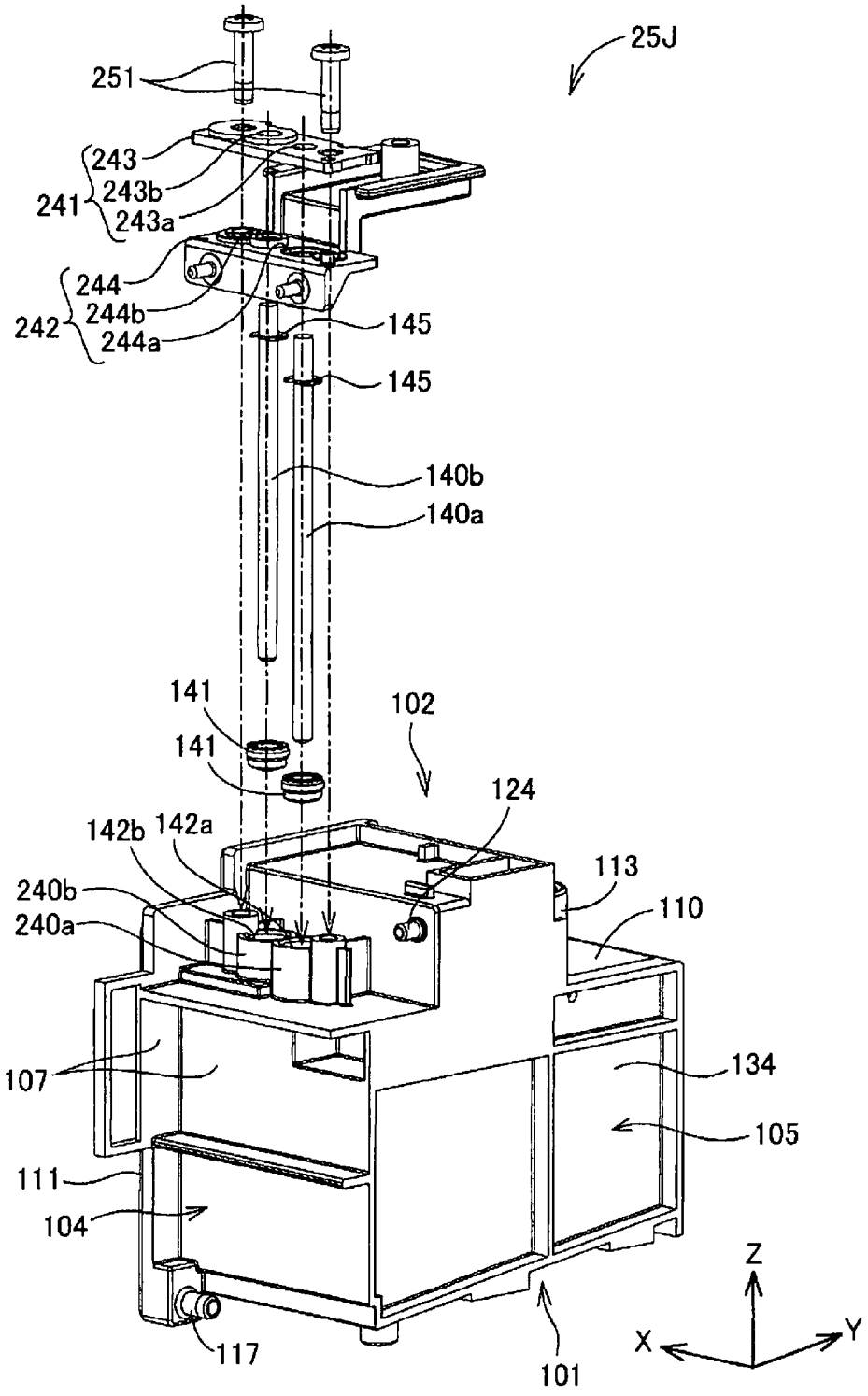
FIG. 14 is an exploded schematic perspective view of the ink tank according to the tenth embodiment.
Figure 15:
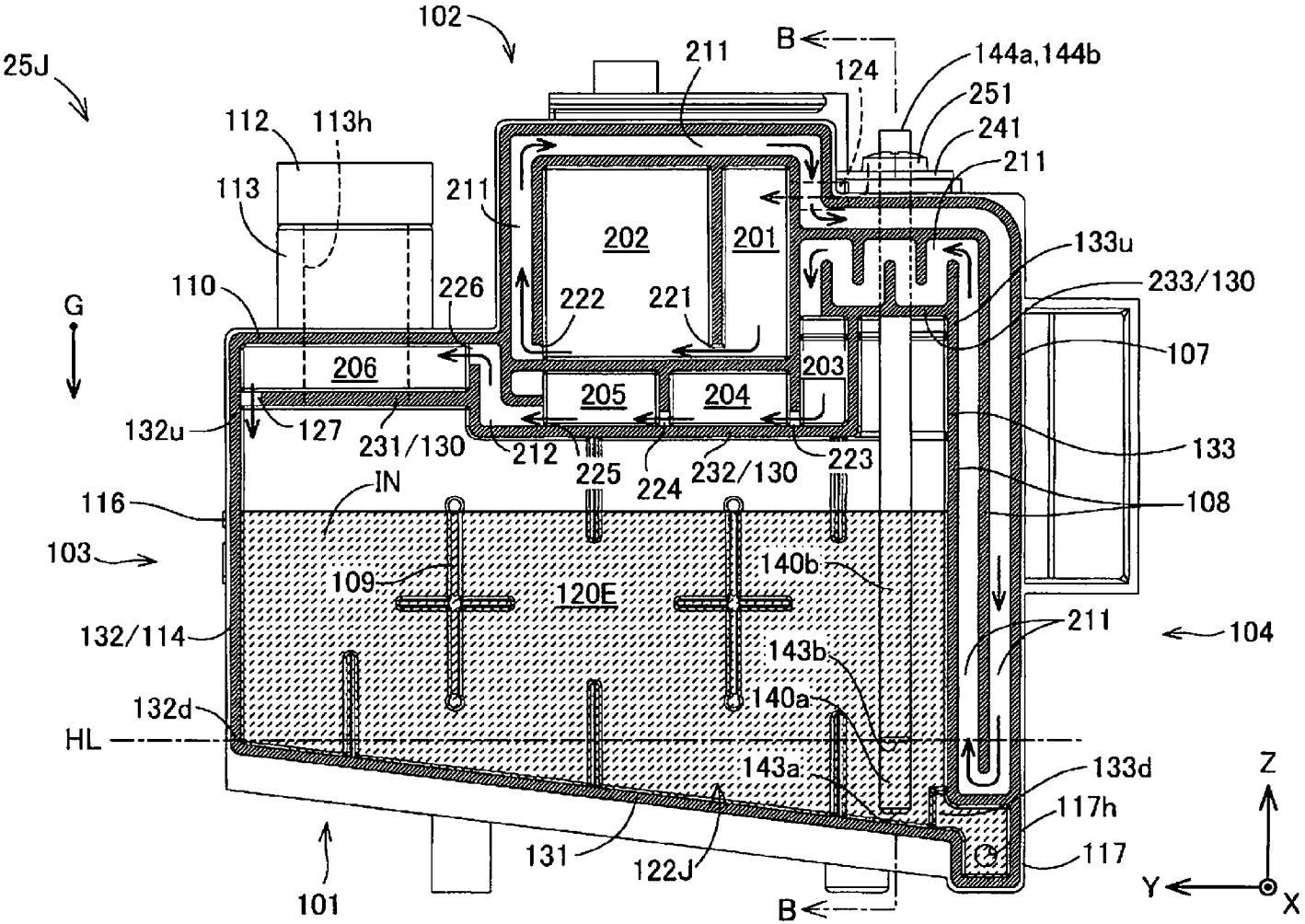
FIG. 15 is a schematic cross-sectional view of the ink tank according to the tenth embodiment.
Figure 16:
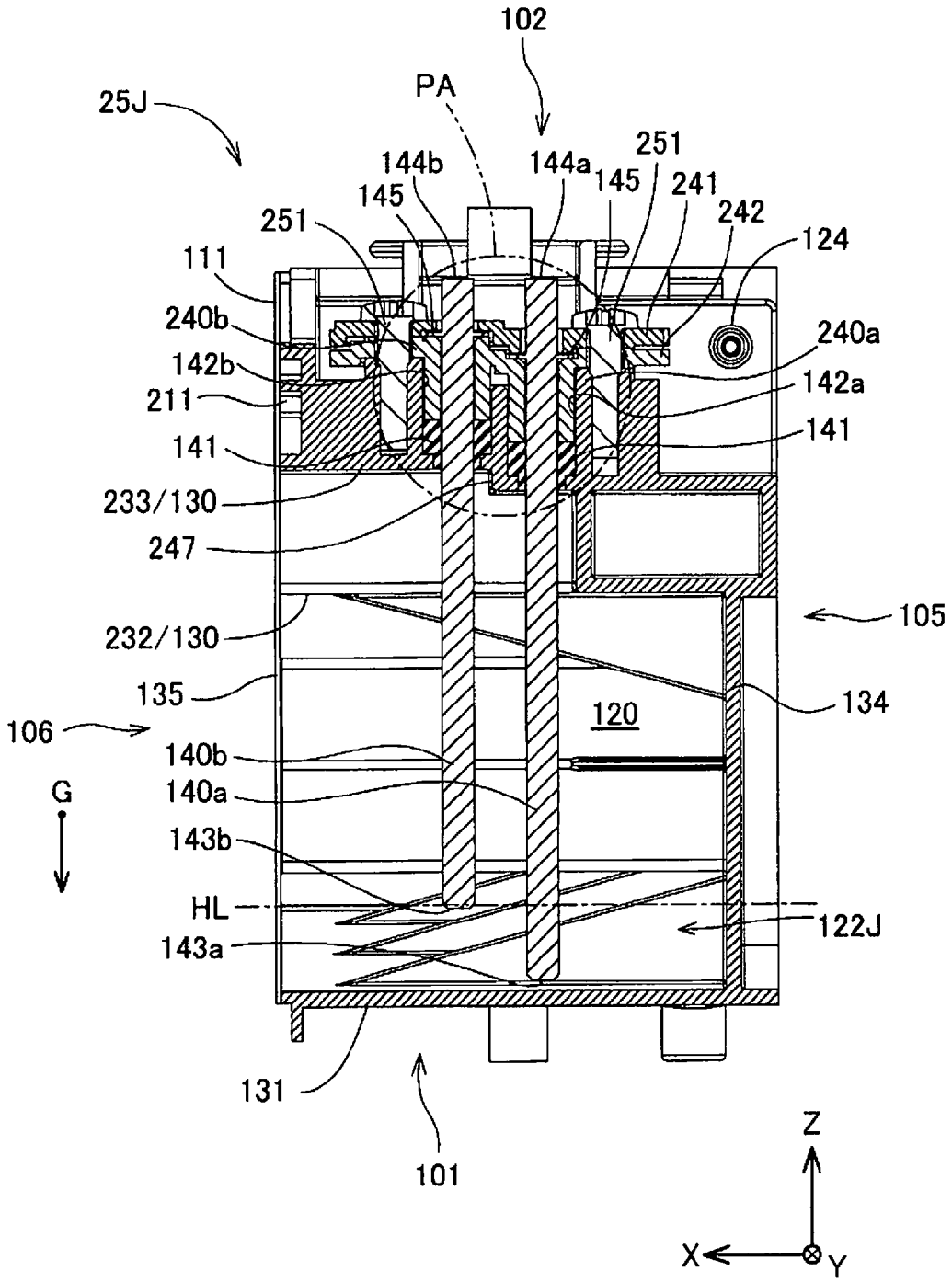
FIG. 16 is a schematic cross-sectional view of the ink tank according to the tenth embodiment.
Figure 17:
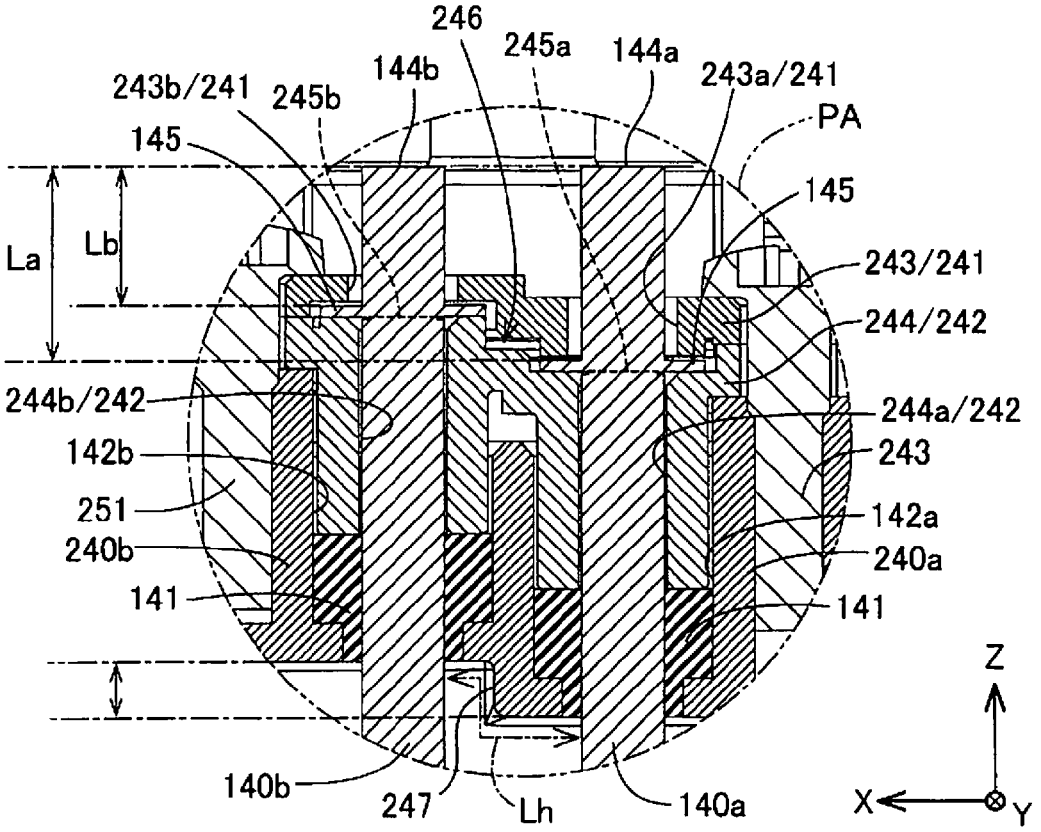
FIG. 17 is a schematic cross-sectional view showing an electrode pin attachment structure according to the tenth embodiment.

J. Tenth Embodiment:

A configuration of an ink tank 25J, which serves as a tenth embodiment of the invention, will be described with reference to FIGS. 13 to 17. FIG. 13 is a schematic exploded perspective view of the ink tank 25J according to the tenth embodiment as viewed obliquely from below on the third face portion 103 side. FIG. 14 is a schematic exploded perspective view of the ink tank 25J according to the tenth embodiment as viewed obliquely from above on the fourth face portion 104 side. FIG. 15 is a schematic cross-sectional view of the ink tank 25J according to the tenth embodiment in a joint plane between the case member 110 and the sheet member 111. In FIG. 15, a state where the ink IN is contained in the ink containing portion 120 is schematically shown as an example. In FIG. 15, arrows indicating a flow of the atmosphere from the atmosphere introduction portion 121 up to the ink containing portion 120 are shown. FIG. 16 is a schematic cross-sectional view of the ink tank 25J according to the tenth embodiment taken along arrows B-B shown in FIG. 15. FIG. 17 is a schematic cross-sectional view showing an attachment structure of the electrode pins 140*a* and 140*b*. In FIG. 17, a region PA shown in FIG. 16 is extracted. In the following description and the reference diagrams, the same signs as those used in the above embodiments will be used for the same constituent portions as those described in the above embodiments, or corresponding constituent portions. The ink tank 25J according to the tenth embodiment is attached to the printer 10 (FIG. 1) having a configuration similar to the configuration of the printer 10 described in the first embodiment.

In the ink tank 25J according to the tenth embodiment, an opening portion of the case member 110 on the sixth face portion 106 side is sealed by adhesion with the sheet member 111 as in the ink tank 25A according to the first embodiment. An internal space 110*s* of the case member 110 is partitioned into an ink containing portion 120 and an atmosphere introduction portion 121 by an inner wall portion 108 (FIGS. 13 and 15). The ink containing portion 120 is formed as a recessed space that is open in the arrow X direction in the case member 110. A region where the ink containing portion 120 is formed spreads through the substantially overall region in the width direction and the front-rear direction. A plurality of reinforcement ribs 109 that are erected in parallel in the arrow X direction are provided within the ink containing portion 120. The reinforcement ribs 109 may be omitted.

The upper wall portion 130 (FIG. 13) of the ink containing portion 120 extends in the arrow Y direction while bending in the up-down direction. The upper wall portion 130 has a first upper wall portion 231, a second upper wall portion 232, and a third upper wall portion 233 that horizontally extend at different height positions. The first upper wall portion 231 is located on the third face portion 103 side, the second upper wall portion 232 is located at the center, and the third upper wall portion 233 is located on the fourth face portion 104 side. The first upper wall portion 231 is located at a position higher than the second upper wall portion 232, and the third upper wall portion 233 is located at a position higher than the first upper wall portion 231. A substantially cylindrical ink injection portion 113 is formed above the first upper wall portion 231 so as to project in the arrow Z direction. The through holes 142*a* and 142*b* for attaching the pair of electrode pins 140*a* and 140*b* are provided in the third upper wall portion 233.

The first side wall portion 132 of the ink containing portion 120 is configured to be transparent or translucent over the up-down direction. In the ink tank 25J according to the tenth embodiment, the overall first side wall portion 132 functions as the visual check portion 114 of the ink containing portion 120. A mark portion 116 is formed in an outer wall face of the first side wall portion 132. The first side wall portion 132 can be viewed from the outside of the casing portion 21 via the first opening portion 23*a* when the ink tank 25J is housed in the tank unit 20 similarly as in the ink tank 25A according to the first embodiment. The lower end portion 132*d* of the first side wall portion 132 is located above the lower end portion 133*d* of the second side wall portion 133.

A bottom wall portion 131 of the ink containing portion 120 inclines downward from the lower end portion 132*d* of the first side wall portion 132 up to the lower end portion 133*d* of the second side wall portion 133 (FIG. 15). Thus, in the ink tank 25J according to the tenth embodiment, a lower portion 122J capable of storing the ink IN is formed below the visual check portion 114. The ink supply portion 117 is provided at a lower end of the lower portion 122J. The ink supply portion 117 is provided at a position below the bottom wall portion 131 so as to project from the second side wall portion 133 to the side opposite to the arrow Y direction.

The atmosphere introduction portion 121 is formed as a recessed space that is open in the arrow X direction in the case member 110 similarly as in the ink containing portion 120 (FIGS. 13 and 15). The atmosphere introduction portion 121 is formed along the outer periphery of the ink containing portion 120 on the second face portion 102 side and the outer periphery thereof on the fourth face portion 104 side. The atmosphere introduction portion 121 has six buffer chambers 201 to 206, a first atmosphere path 211, and a second atmosphere path 212.

The six buffer chambers 201 to 206 are formed as hollow portions having a substantially rectangular parallelepiped shape. The buffer chambers 201 to 206 have a function of storing the ink IN such that the ink IN that has entered the atmosphere introduction portion 121 from the ink containing portion 120 does not leak as-is outward of the ink tank 25J. Of the six buffer chambers 201 to 206, five buffer chambers 201 to 205 have roughly the same depth in the arrow X direction as the depth of the ink containing portion 120, and are spanned roughly in the overall region in the arrow X direction. The sixth buffer chamber 206 is configured such that the depth thereof in the arrow X direction is smaller than those of the other buffer chambers 201 to 205 in order to avoid interference with the ink injection portion 113.

The two atmosphere paths 211 and 212 are formed as groove portions that extend parallel with the surface of the sheet member 111. Both the two atmosphere paths 211 and 212 have a smaller depth in the arrow X direction than those of the six buffer chambers 201 to 206. In the ink tank 25J according to the tenth embodiment, the buffer chambers 201 to 206 and the atmosphere paths 211 and 212 are laid out as follows.

The first buffer chamber 201 and the second buffer chamber 202 are arranged next to each other in the arrow Y direction above the second upper wall portion 232 of the ink containing portion 120 (FIG. 15). The first buffer chamber 201 and the second buffer chamber 202 are formed such that the positions of the upper faces and the bottom faces thereof are respectively aligned with each other in the arrow Z direction. The atmosphere intake portion 124 is connected to an upper end portion of the first buffer chamber 201. The first buffer chamber 201 and the second buffer chamber 202 are in communication with each other via a first communication port 221 that is formed at their lower end. The second buffer chamber 202 is connected to the first atmosphere path 211 via a second communication port 222 that is formed at a lower end of its side wall face on the side in the arrow Y direction.

The first atmosphere path 211 extends up to an end portion on the fourth face portion 104 side from the second communication port 222 along the outer periphery of the second buffer chamber 202 and the first buffer chamber 201 while being spanned over the first buffer chamber 201 and the second buffer chamber 202. Then, the first atmosphere path 11 extends so as to go and return once in the up-down direction between the second face portion 102 and the first face portion 101 at a position on the side opposite to the arrow Y direction relative to the second side wall portion 133 of the ink containing portion 120. Thereafter, the first atmosphere path 11 extends in the arrow Y direction while turning back multiple times in a bellows-like shape in the arrow Z direction above the third upper wall portion 233, and is connected to an upper face of the third buffer chamber 203.

The third buffer chamber 203, the fourth buffer chamber 204, and the fifth buffer chamber 205 are formed above the second upper wall portion 232. The third buffer chamber 203 is located above an end portion of the second upper wall portion 232 on the fourth face portion 104 side. An upper end portion of the third buffer chamber 203 is located at a position adjacent to a lower end portion of the first buffer chamber 201 on the side opposite to the arrow Y direction. The lower end portion of the third buffer chamber 203 and the fourth buffer chamber 204 are in communication with each other via a third communication port 223.

The fourth buffer chamber 204 and the fifth buffer chamber 205 are arranged next to each other in this order in the arrow Y direction at a stage below the first buffer chamber 201 and the second buffer chamber 202. The positions of upper faces and the height positions of bottom faces of the fourth buffer chamber 204 and the fifth buffer chamber 205 are respectively aligned with each other. The fifth buffer chamber 205 is connected to the second atmosphere path 212 via a fifth communication port 225 that is provided at a lower end of a side wall face on the third face portion 103 side. The second atmosphere path 212 extends in the arrow Y direction and is connected to the sixth buffer chamber 206 via a sixth communication port 226. The sixth buffer chamber 206 is located above the first upper wall portion 231, and is formed at a position that overlaps a lower end portion of the ink injection portion 113 when the ink tank 25J according to the tenth embodiment is viewed in the arrow X direction.

A communication path 127 that is in communication with the ink containing portion 120 is formed at an end portion of the first upper wall portion 231, which constitutes a bottom face of the sixth buffer chamber 206, on the third face portion 103 side. The communication path 127 is formed as a recessed portion provided between the inner wall portion 108 and the sheet member 111. The atmosphere that is taken into the first buffer chamber 201 via the atmosphere intake portion 124 reaches the sixth buffer chamber 206 through the route indicated by the arrows in the atmosphere introduction portion 121, and is introduced into the ink containing portion 120 via the communication path 127.

In the ink tank 25J according to the tenth embodiment, the pair of electrode pins 140*a* and 140*b* are inserted in the ink containing portion 120 via the through holes 142*a* and 142*b* of two cylindrical portions 240*a* and 240*b*, which are provided so as to project upward in the second face portion 102. The two cylindrical portions 240*a* are arranged in the arrow X direction in a region of the second face portion 102 on the fourth face portion 104 side. A first cylindrical portion 240*a* is located on the fifth face portion 105 side, and a second cylindrical portion 240*b* is located on the sixth face portion 106 side.

The through holes 142*a* and 142*b* of the two cylindrical portions 240*a* and 240*b* pass through the first upper wall portion 231 and reach the ink containing portion 120 (FIG. 16). The first electrode pin 140*a* is inserted in the ink containing portion 120 via the first through hole 142*a* of the first cylindrical portion 240*a*. The second electrode pin 140*b* is inserted in the ink containing portion 120 via the second through hole 142*b* of the second cylindrical portion 240*b*.

A cylindrical seal member 141 is arranged between an inner circumferential face of the first through hole 142*a* and the first electrode pin 140*a*. A cylindrical seal member 141 is also arranged between an inner circumferential face of the second through hole 142*b* and the second electrode pin 140*b*. A lower end face of each seal member 141 is exposed to the ink containing portion 120 in the first upper wall portion 231.

The ink tank 25J according to the tenth embodiment includes a first fixing member 241, a second fixing member 242, and two screws 251 as fixing members for fixing the pair of electrode pins 140*a* and 140*b* (FIG. 14). The first fixing member 241 has a plate-shaped portion 243 that extends in the arrow X direction. This plate-shaped portion 243 is provided with a first through hole 243*a* in which the first electrode pin 140*a* is inserted, and a second through hole 243*b* in which the second electrode pin 140*b* is inserted.

The second fixing member 242 has a plate-shaped portion 244 that extends in the arrow X direction. This plate-shaped portion 244 is provided with a first through hole 244*a* in which the first electrode pin 140*a* is inserted, and a second through hole 244*b* in which the second electrode pin 140*b* is inserted. The plate-shaped portion 244 of the second fixing member 242 is provided with a step portion 246 between the through holes 244*a* and 244*b* (FIG. 17). Thus, the position of an opening end above the second through hole 244*b* is located above an opening end portion above the first through hole 244*a*.

The first fixing member 241 and the second fixing member 242 are arranged in a stacked manner on the two cylindrical portions 240*a* and 240*b* in a state where the electrode pins 140*a* and 140*b* that correspond to the respective through holes 243*a*, 243*b*, 244*a* and 244*b* are inserted, with the first fixing member 241 on the upper side and the second fixing member 242 on the lower side (FIGS. 16 and 17). The first fixing member 241 and the second fixing member 242 are fixed to the case member 110 at both ends in the arrow X direction by the two screws 251.

The electrode pins 140*a* and 140*b* are arranged in a state of extending in the gravity direction toward the bottom wall portion 131 in the ink containing portion 120 (FIG. 16). The leading end portions 143*a* and 143*b* of the electrode pins 140*a* and 140*b* are arranged in the lower portion 122J. The leading end portion 143*b* of the second electrode pin 140*b* is located above the leading end portion 143*a* of the first electrode pin 140*a*. The rear end portions 144*a* and 144*b* of the electrode pins 140*a* and 140*b* are arranged at the same height outside the case member 110. In the ink tank 25J according to the tenth embodiment as well, a voltage is applied to the second electrode pin 140*b* from the ink detecting portion 34 (FIG. 1) when detecting the amount of remaining ink, as in the ink tank 25A according to the first embodiment.

Here, the electrode pins 140*a* and 140*b* are provided with restriction portions 145, which are similar to those described in the seventh embodiment, as positioning portions for the electrode pins 140*a* and 140*b* (FIG. 14). The restriction portions 145 of the electrode pins 140*a* and 140*b* are stopped so as to be into contact with the opening end portions 245*a* and 245*b* above the through holes 244*a* and 244*b* of the second fixing member 242 (FIG. 17). Thus, the positioning accuracy of the electrode pins 140*a* and 140*b* is increased.

Furthermore, as mentioned above, in the second fixing member 242, the position of the opening end portion 245*a* above the second through hole 244*b* is located above the opening end portion 245*b* above the first through hole 244*a* (FIG. 17). In the electrode pins 140*a* and 140*b* according to the tenth embodiment as well, the positions of the restriction portions 145 are determined in accordance with a difference in the height position between the opening end portions 245*a* and 245*b*. For this reason, the distance La between the rear end portion 144*a* and the restriction portion 145 of the first electrode pin 140*a* is longer than the distance Lb between the rear end portion 144*b* and the restriction portion 145 of the second electrode pin 140*b*. Thus, as described in the seventh embodiment, an occurrence of an error in installation of the first electrode pin 140*a* and the second electrode pin 140*b* is suppressed.

Furthermore, in the ink tank 25J according to the tenth embodiment, in the first upper wall portion 231, a step portion 247 is formed in the first upper wall portion 231 between the first through hole 142*a* and the second through hole 142*b* (FIGS. 16 and 17). With the step portion 246, in the first upper wall portion 231, the height position of the wall face on the second through hole 142*b* side is higher than the height position of the wall face on the first through hole 142*a* side. Thus, the distance Lh between the electrode pins 140*a* and 140*b* along the wall face of the first upper wall portion 231 increases by the distance of the step portion 246. Accordingly, an occurrence of a short circuit between the electrode pins 140*a* and 140*b* due to attachment of the ink IN to the first upper wall portion 231 is suppressed similarly as described in the eighth embodiment.

As described above, with the ink tank 25J according to the tenth embodiment, the accuracy of detection of the amount of remaining ink is increased as a result of the leading end portions 143*a* and 143*b* of the electrode pins 140*a* and 140*b* being arranged in the lower portion 122J. In addition, with the ink tank 25J according to the tenth embodiment, effects similar to those described in the above embodiments can be achieved.

Figure 18:
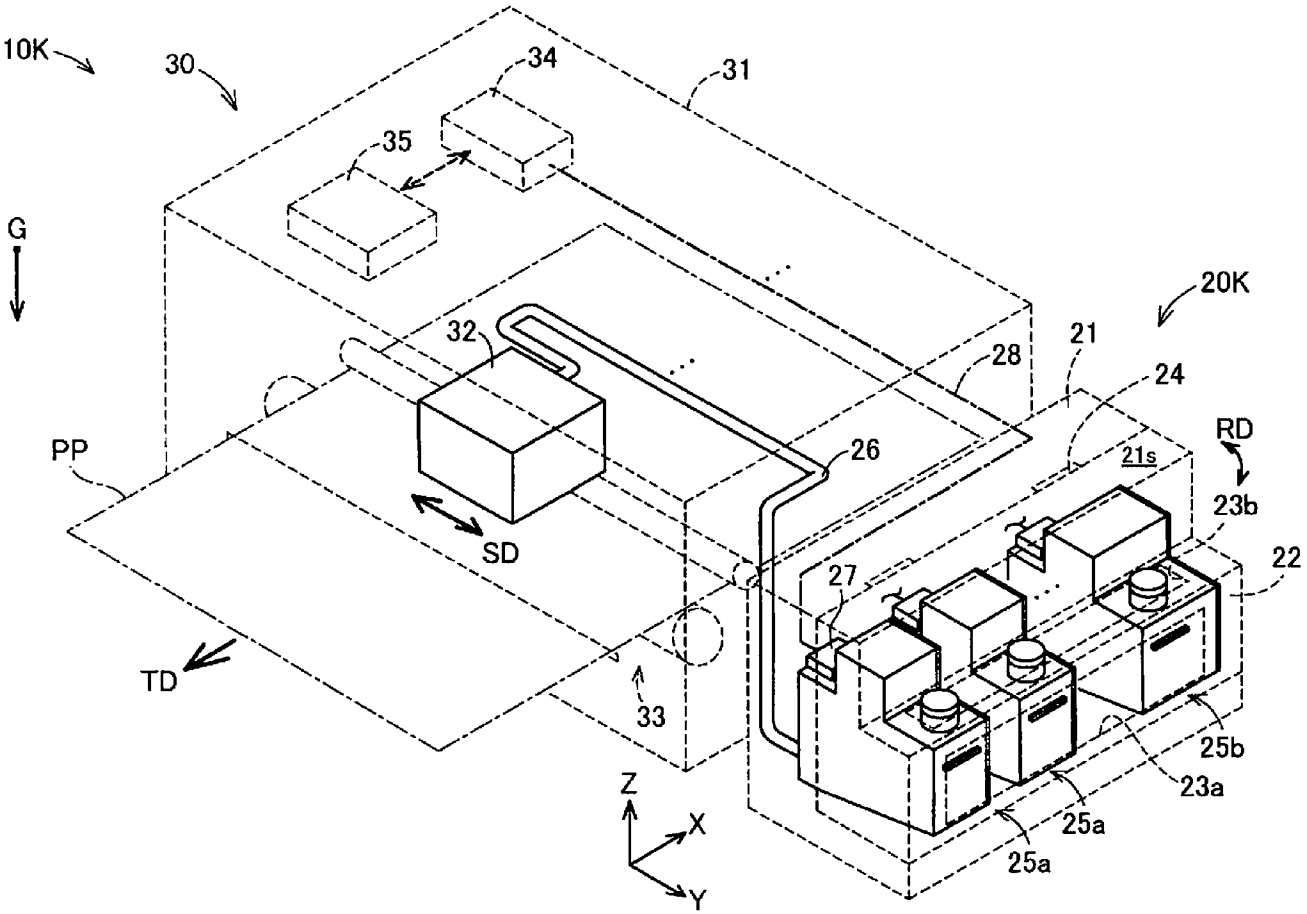
FIG. 18 is a schematic view showing a configuration of a printer according to an eleventh embodiment.

K. Eleventh Embodiment:

FIG. 18 is a schematic view showing a configuration of a printer 10K, which serves as an eleventh embodiment of the invention. The printer 10K is roughly the same as the printer 10 in the first embodiment (FIG. 1) except the following points. In the following description and the reference diagrams, the same signs as those used in the above embodiments will be used for the same constituent portions as those described in the above embodiments, or corresponding constituent portions.

The printer 10K according to the eleventh embodiment includes a tank unit 20K, which serves as one embodiment of the tank unit according to the invention. The tank unit 20K according to the eleventh embodiment has roughly the same configuration as that of the tank unit 20 according to the first embodiment, except that the tank unit 20K has two types of ink tanks 25*a* and 25*b* that have different ink capacities. The tank unit 20K includes one or more first ink tanks 25*a* and one or more second ink tanks 25*b*.

Each first ink tank 25*a* has the same configuration as that of the ink tank 25A described in the first embodiment. Each second ink tank 25*b* has roughly the same configuration as that of the first ink tank 25*a* except that the capacity of the ink containing portion 120 is different and that the installation position of the electrode pins 140*a* and 140*b* in the ink containing portion 120 is different. The width of each ink tank 25*b* in the arrow X direction is larger than that of the first ink tank 25*a*. Thus, the capacity of the ink containing portion 120 of each second ink tank 25*b* is larger than that of each first ink tank 25*a*. Each first ink tank 25*a* corresponds to a subordinate concept of a first tank according to the invention, and each second ink tank 25*b* corresponds to a subordinate concept of a second tank according to the invention.

Figures 19A, 19B:
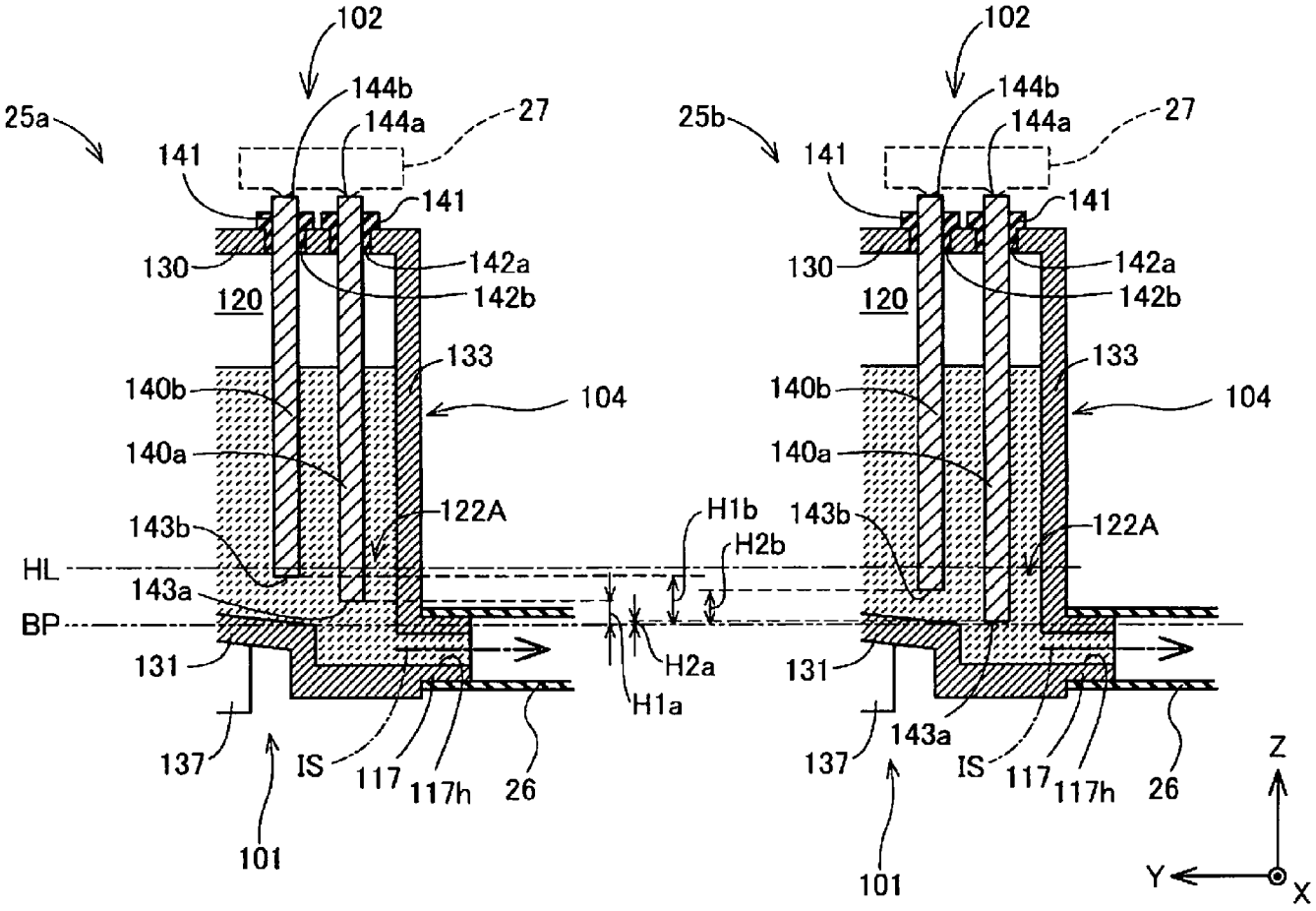
FIGS. 19A and 19B are schematic views showing a difference in the electrode pin installation position between the first ink tank and the second ink tank.

FIGS. 19A and 19B are schematic views showing a difference in the installation position of the electrode pins 140*a* and 140*b* between each first ink tank 25*a* and each second ink tank 25*b*. FIG. 19A shows a schematic cross-section of a first ink tank 25*a* at the portion where the electrode pins 140*a* and 140*b* are installed, and FIG. 19B shows a schematic cross-section of a second ink tank 25*b* at the portion where the electrode pins 140*a* and 140*b* are installed. In FIGS. 19A and 19B, the height of lower end portions of the ink containing portions 120 in the ink tanks 25*a* and 25*b* are aligned with each other, and the position BP of the lower end portions in the ink containing portions 120 is indicated by a chain double-dashed line.

In each second ink tank 25*b*, the lower portion 122A is formed in the ink containing portion 120 similarly as in each first ink tank 25*a*, and the leading end portions 143*a* and 143*b* of the electrode pins 140*a* and 140*b* are arranged in the lower portion 122A. The first electrode pin 140*a* of each second ink tank 25*b* corresponds to a subordinate concept of a third electrode member according to the invention, and the second electrode pin 140*b* of each second ink tank 25*b* corresponds to a subordinate concept of a fourth electrode member according to the invention. In each second ink tank 25*b*, the position of the leading end portions 143*a* and 143*b* of the electrode pins 140*a* and 140*b* is changed from that in each first ink tank 25*a* in accordance with a difference in the capacity of the ink containing portion 120 between the first ink tank 25*a* and the second ink tank 25*b*.

The distance H2*a* between the leading end portion 143*a* of the first electrode pin 140*a* and a lower end portion of the ink containing portion 120 in each second ink tank 25*b* is smaller than the distance H1*a* between the leading end portion 143*a* of the first electrode pin 140*a* and a lower end portion of the ink containing portion 120 in each first ink tank 25*a*. The distance H2*b* between the leading end portion 143*b* of the second electrode pin 140*b* and the lower end portion of the ink containing portion 120 in each second ink tank 25*b* is smaller than the distance H1*b* between the leading end portion 143*b* of the second electrode pin 140*b* and the lower end portion of the ink containing portion 120 in each first ink tank 25*a*. Note that the distance H1*a* is smaller than the distance H1*b*, and the distance H2*a* is smaller than the distance H2*b*.

If a first ink tank 25*a* and a second ink tank 25*b* contain the same amount of the ink IN, the height of the liquid surface of the ink IN in the first ink tank 25*a* is higher than the height of the liquid surface of the ink IN in the second ink tank 25*b*. Accordingly, as described above, as a result of the height positions of the leading end portions 143*a* and 143*b* of the electrode pins 140*a* and 140*b* being changed, an occurrence of a difference in the amount of remaining ink when the too-little ink amount state is detected between the first ink tank 25*a* and the second ink tank 25*b* is suppressed. Note that it is favorable that the height position of the leading end portion 143*b* of the second electrode pin 140*b* is determined such that the space volume in a region below the leading end portion 143*b* of the second electrode pin 140*b* is equal in the first ink tank 25*a* and the second ink tank 25*b*.

In the printer 10K according to the eleventh embodiment, the tank unit 20K includes the first ink tank(s) 25*a* and the second ink tank(s) 25*b* that have different ink capacities. Therefore, multiple types of ink can be set in conformity with the tendency of ink consumption in the print portion 30. Accordingly, adaptability to the characteristics of the print portion 30 is increased, which is more convenient for the user. In the tank unit 20K according to the eleventh embodiment, an occurrence of a difference in the amount of remaining ink at the time when a too-little ink amount state is detected between the first ink tank 25*a* and the second ink tank 25*b* that have different ink capacities is suppressed. Accordingly, with the printer 10K according to the eleventh embodiment, the amount of remaining ink in the ink tanks 25*a* and 25*b* can be more appropriately managed. In addition, with the ink tanks 25*a* and 25*b*, the tank unit 20K, and the printer 10K that includes these ink tanks 25*a* and 25*b* and the tank unit 20K according to the eleventh embodiment, effects similar to those described in the first embodiment can be achieved. Note that the configurations according to the above-described second, third, fourth, sixth, seventh, eighth, and ninth embodiments may be applied to the ink tanks 25*a* and 25*b* according to the eleventh embodiment.

Figures 20A, 20B:
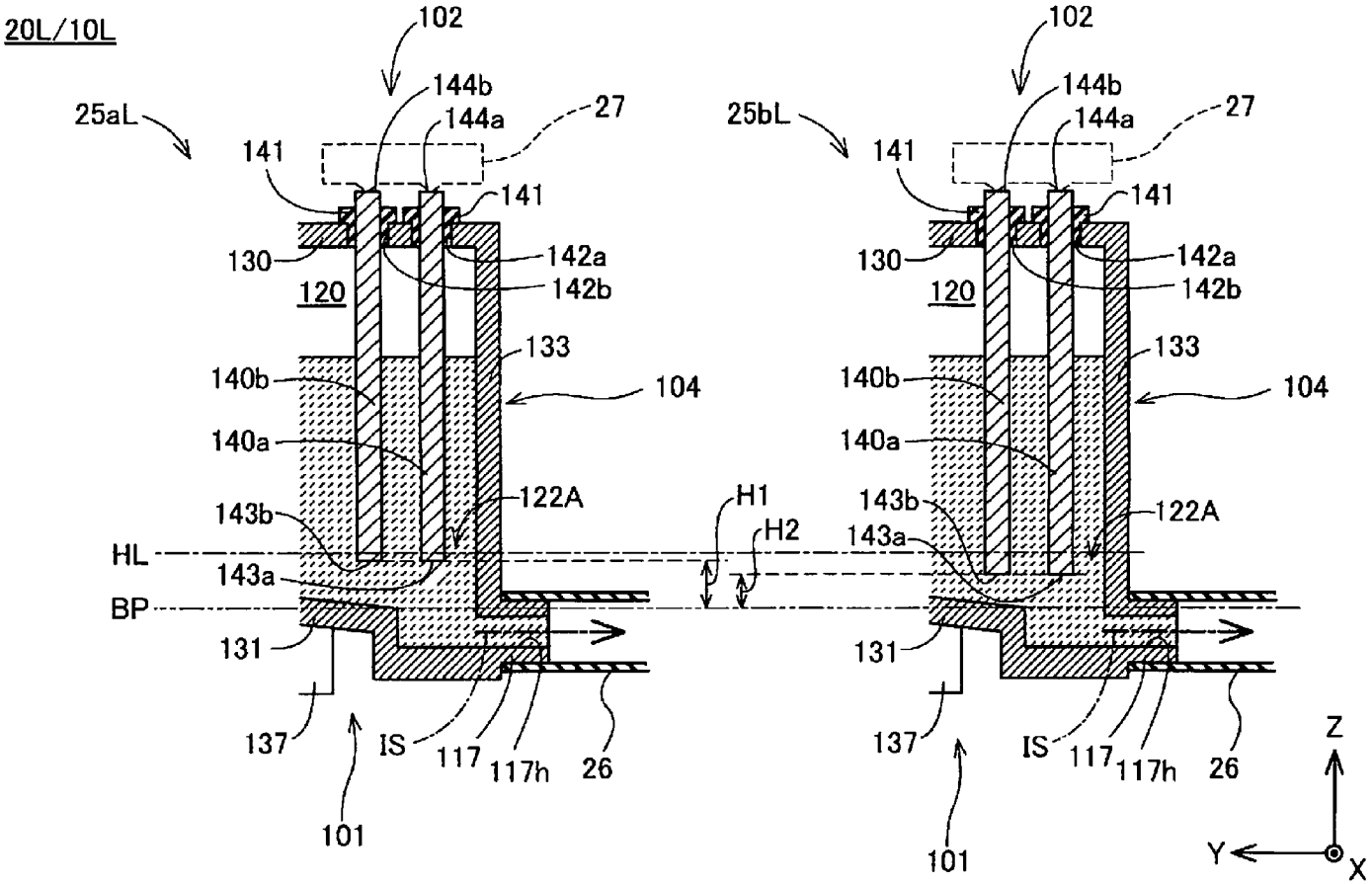
FIGS. 20A and 20B are schematic views for illustrating a configuration of a tank unit according to a twelfth embodiment.

L. Twelfth Embodiment:

FIGS. 20A and 20B are schematic views for illustrating a configuration of a tank unit 20L, which serves as a twelfth embodiment of the invention. In FIGS. 20A and 20B, schematic cross-sections of a first ink tank 25*a*L and a second ink tank 25*b*L at the portion where the electrode pins 140*a* and 140*b* are installed are shown similarly as in FIGS. 19A and 19B, which are referenced in the eleventh embodiment. The tank unit 20L according to the twelfth embodiment has roughly the same configuration as that of the tank unit 20K according to the eleventh embodiment except the following points. The configuration of a printer 10L that includes the tank unit 20L according to the twelfth embodiment is roughly the same as that of the printer 10K according to the eleventh embodiment (FIG. 18).

The configuration of the first ink tank 25*a*L included in the tank unit 20L according to the twelfth embodiment is roughly the same as that of the first ink tank 25*a* according to the eleventh embodiment except that the leading end portions 143*a* and 143*b* of the electrode pins 140*a* and 140*b* are located at the same height position. The configuration of the second ink tank 25*b*L included in the tank unit 20L according to the twelfth embodiment is roughly the same as the second ink tank 25*b* according to the eleventh embodiment except that the leading end portions 143*a* and 143*b* of the electrode pins 140*a* and 140*b* are located at the same height positions. With the first and second ink tanks 25*a*L and 25*b*L according to the twelfth embodiment, the first electrode pin 140*a* and the second electrode pin 140*b* can be constituted by the same common parts, which is efficient.

Here, the distance H2 between the leading end portions 143*a* and 143*b* of the electrode pins 140*a* and 140*b* and the lower end portion of the ink containing portion 120 in the second ink tank 25*b*L is smaller than the distance H1 between the leading end portions 143*a* and 143*b* of the electrode pins 140*a* and 140*b* and the lower end portion of the ink containing portion 120 in the first ink tank 25*a*L. Thus, an occurrence of a difference in the amount of remaining ink at the time when the too-little ink amount state is detected between the first ink tank 25*a*L and the second ink tank 25*b*L is suppressed similarly as described in the eleventh embodiment. Note that it is favorable that the height positions of the leading end portions 143*a* and 143*b* of the electrode pins 140*a* and 140*b* are determined such that the space volume in a region below the leading end portions 143*a* and 143*b* of the electrode pins 140*a* and 140*b* is equal in the first ink tank 25*a*L and the second ink tank 25*b*L.

As described above, with the tank unit 20L according to the twelfth embodiment, an occurrence of a difference in the amount of remaining ink at the time when the too-little ink amount state is detected between the first ink tank 25*a*L and the second ink tank 25*b*L that have different ink capacities is suppressed. Accordingly, with the printer 10L according to the twelfth embodiment, the amount of remaining ink in the ink tanks 25*a*L and 25*b*L can be more appropriately managed. In addition, with the ink tanks 25*a*L and 25*b*L, the tank unit 20L, and the printer 10L that includes the ink tanks 25*a*L and 25*b*L and the tank unit 20L according to the twelfth embodiment, effects similar to those described in the first embodiment can be achieved. Note that the configurations according to the above-described second, third, fourth, seventh, eighth, and ninth embodiments may be applied to the ink tanks 25*a*L and 25*b*L according to the twelfth embodiment.

Figure 21:
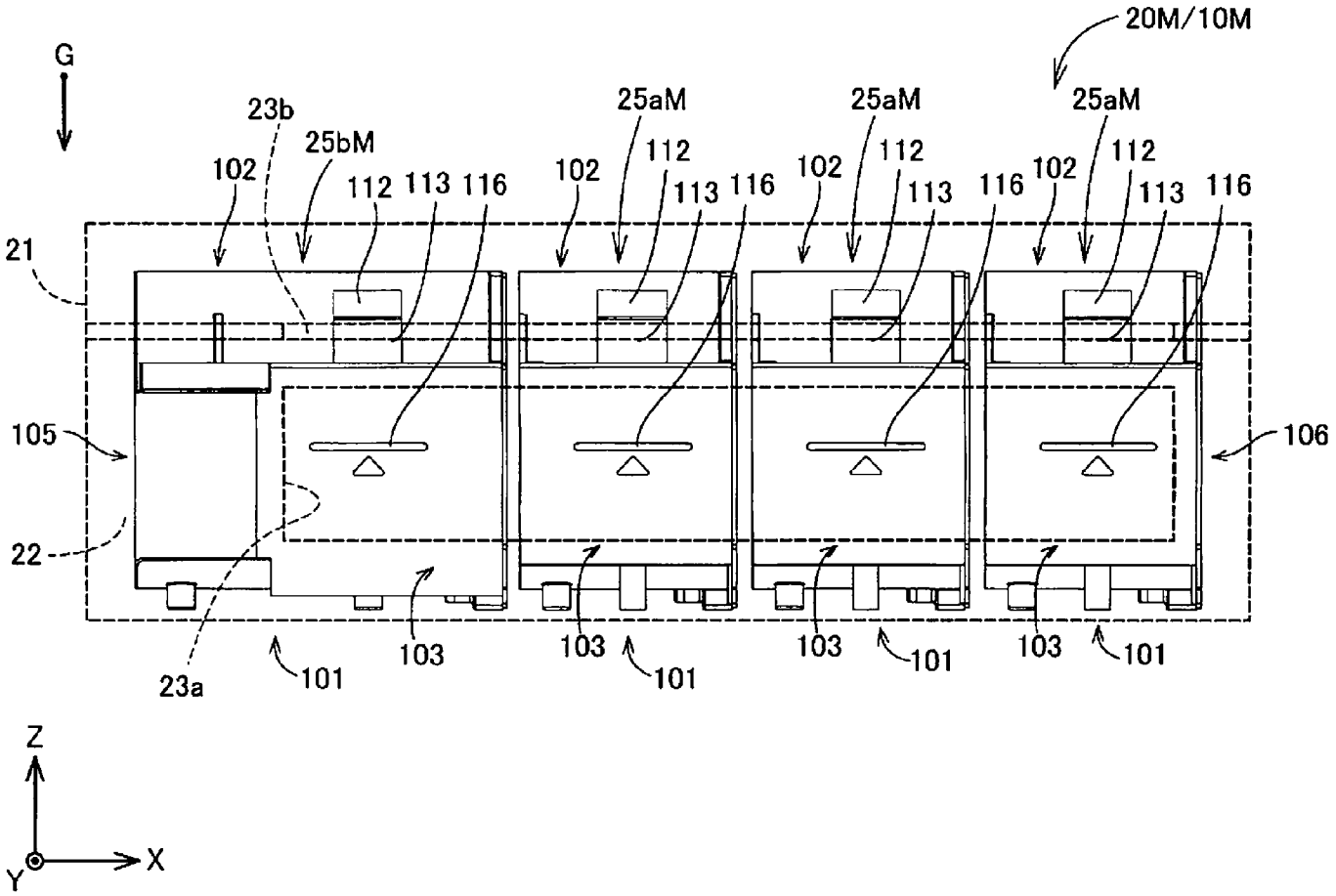
FIG. 21 is a schematic view of a tank unit according to a thirteenth embodiment.
Figure 22:
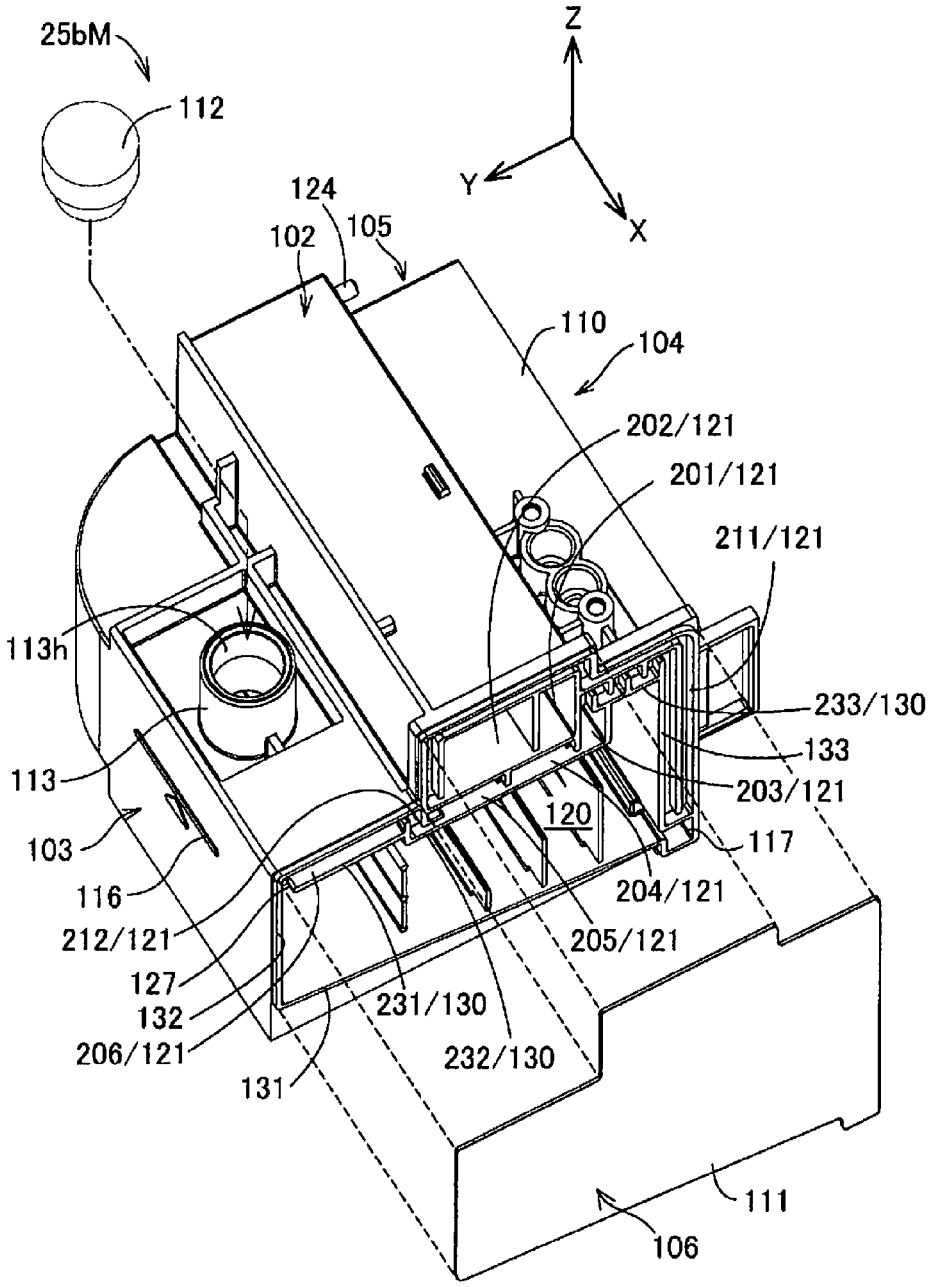
FIG. 22 is an exploded schematic perspective view of a second ink tank according to the thirteenth embodiment.
Figure 23:
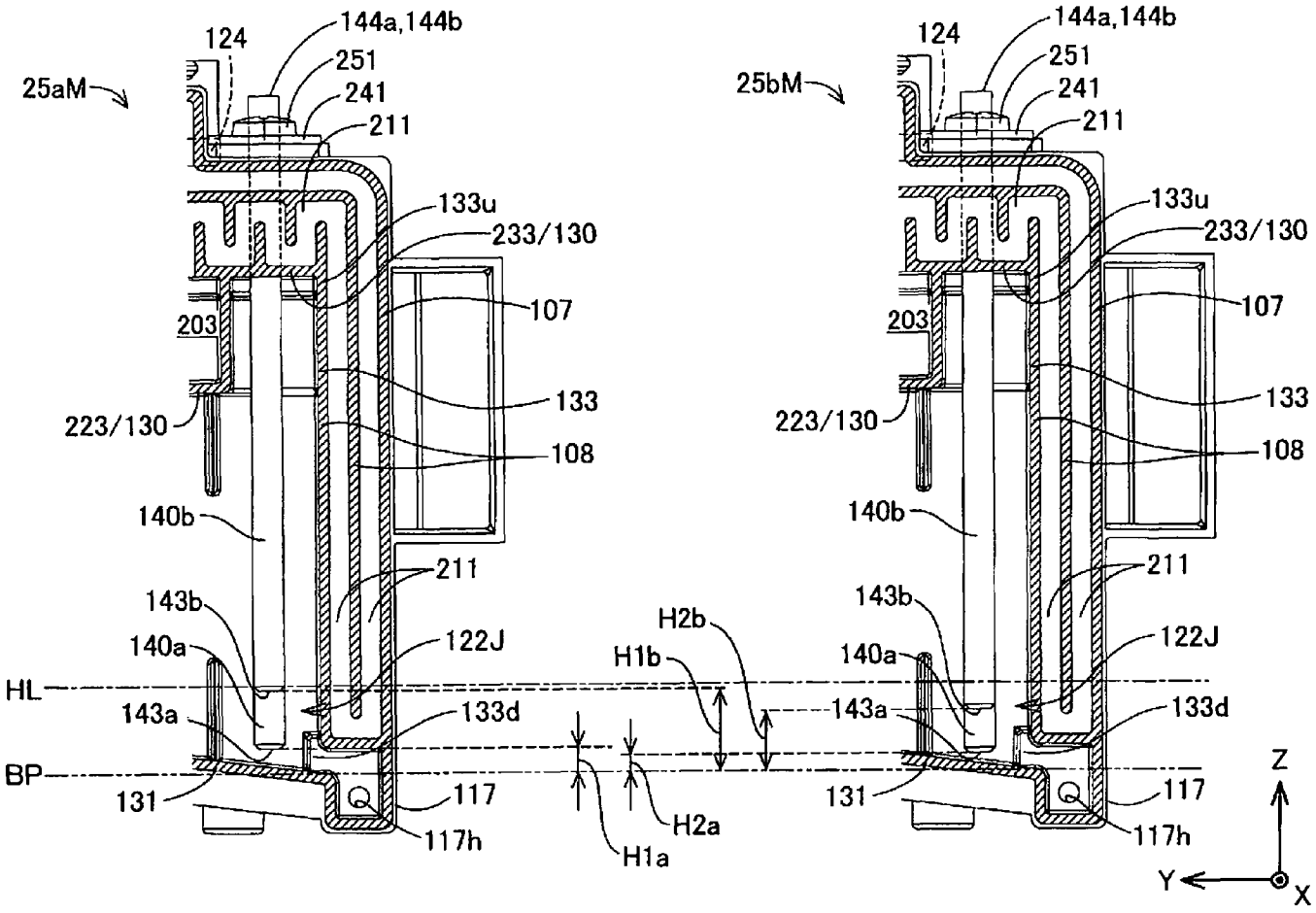
FIG. 23 is a schematic cross-sectional view showing a portion where electrode pins are installed in the ink tank according to the thirteenth embodiment.

M. Thirteenth Embodiment:

A tank unit 20M, which serves as a thirteenth embodiment, and a printer 10M that includes the tank unit 20M will be described with reference to FIGS. 21 to 23 in order. FIG. 21 is a schematic view of the tank unit 20M according to the thirteenth embodiment as viewed in the direction opposite to the arrow Y direction. In FIG. 21, the tubes 26, the connection circuit unit 27, and the signal lines 28 are omitted. FIG. 22 is an exploded schematic perspective view of a second ink tank 25*b*M. FIG. 23 is a schematic cross-sectional view showing a portion where the electrode pins 140*a* and 140*b* are installed in ink tanks 25*a*M and 25*b*M according to the thirteenth embodiment. In the following description and the reference diagrams, the same signs as those used in the third embodiment will be used for the same constituent portions as those described in the above embodiments, or corresponding constituent portions.

The configuration of the tank unit 20M according to the third embodiment is roughly the same as that of the tank unit 20K according to the eleventh embodiment except the following points. The configuration of the printer 10M that includes the tank unit 20M according to the thirteenth embodiment is roughly the same as that of the printer 10K according to the eleventh embodiment (FIG. 18). The tank unit 20M according to the third embodiment includes two types of ink tanks 25*a*M and 25*b*M that have different capacities. The tank unit 20M according to the thirteenth embodiment includes three first ink tanks 25*a*M and a single second ink tank 25*b*M. The configuration of each first ink tank 25*a*M is roughly the same as that of the ink tank 25J according to the tenth embodiment.

The configuration of the second ink tank 25*b*M is roughly the same as that of the first ink tank 25*a*M except the following points. The width of the second ink tank 25*b*M in the arrow X direction is larger than the first ink tank 25*a*M (FIGS. 21 and 22). Thus, the capacity of the ink containing portion 120 of the second ink tank 25*b*M is larger than that of each first ink tank 25*a*M. In the tank unit 20M, for example, ink that is more consumed, such as black ink, may be assigned to the second ink tank 25*b*M, and other ink such as cyan, magenta, and yellow ink may be assigned to the first ink tanks 25*a*M.

In the second ink tank 25*b*M, a lower portion 122J is formed in the ink containing portion 120 similarly as in the first ink tank 25*a*M, and the leading end portions 143*a* and 143*b* of the electrode pins 140*a* and 140*b* are arranged in the lower portion 122J (FIG. 23). In the second ink tank 25*b*M, the position of the leading end portions 143*a* and 143*b* of the electrode pins 140*a* and 140*b* is changed from that in each first ink tank 25*a*M in accordance with a difference in the capacity of the ink containing portion 120 between each first ink tank 25*a*M and the second ink tank 25*b*M.

The distance H2*a* between the leading end portion 143*a* of the first electrode pin 140*a* and the lower end portion of the ink containing portion 120 in the second ink tank 25*b*M is smaller than the distance H1*a* between the leading end portion 143*a* of the first electrode pin 140*a* and the lower end portion of the ink containing portion 120 in each first ink tank 25*a*M. The distance H2*b* between the leading end portion 143*b* of the second electrode pin 140*b* and the lower end portion of the ink containing portion 120 in the second ink tank 25*b*M is smaller than the distance H1*b* between the leading end portion 143*b* of the second electrode pin 140*b* and the lower end portion of the ink containing portion 120 in the first ink tank 25*a*M. The distance H1*a* is smaller than the distance H1*b*, and the distance H2*a* is smaller than the distance H2*b*. Thus, an occurrence of a difference in the amount of remaining ink at the time when the too-little ink amount state is detected between the first ink tank 25*a*M and the second ink tank 25*b*M is suppressed similarly as described in the eleventh embodiment. Note that it is favorable that the height position of the leading end portion 143*b* of the second electrode pin 140*b* is determined such that the space volume in a region below the leading end portion 143*b* of the second electrode pin 140*b* is equal in the first ink tank 25*a*M and the second ink tank 25*b*M.

As described above, with the tank unit 20M and the printer 10M according to the thirteenth embodiment, effects similar to those of the tank unit 20K and the printer 10K according to the eleventh embodiment can be achieved. In addition, with the ink tanks 25*a*M and 25*b*M according to the thirteenth embodiment, effects similar to those of the ink tank 25J according to the tenth embodiment can be achieved.

Figure 24:
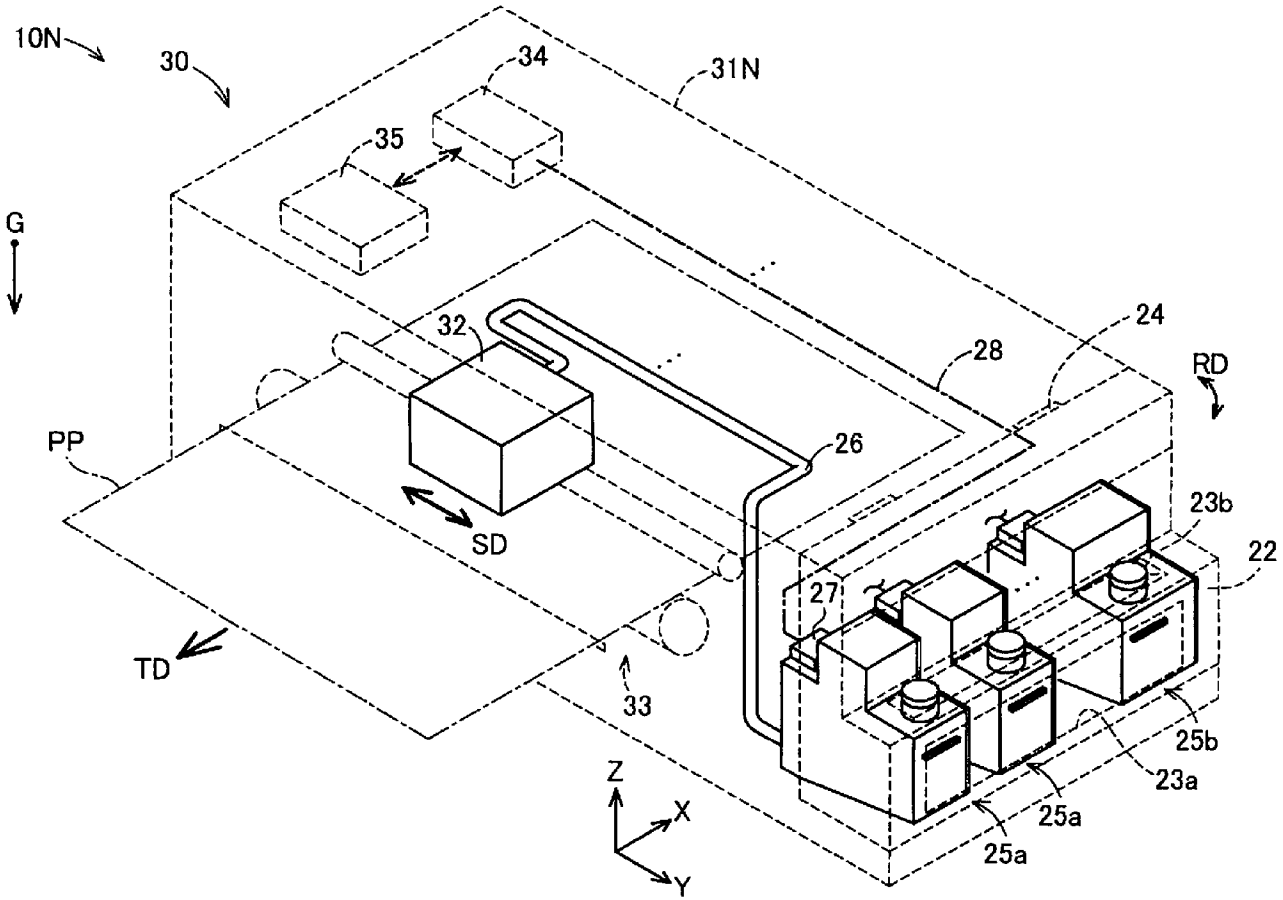
FIG. 24 is a schematic view showing a configuration of a printer according to a fourteenth embodiment.

N. Fourteenth Embodiment:

FIG. 24 is a schematic view showing a configuration of a printer 10N, which serves as a fourteenth embodiment of the invention. The printer 10N according to the fourteenth embodiment has roughly the same configuration as that of the printer 10K according to the eleventh embodiment except that the first ink tanks 25*a* and the second ink tank 25*b* are housed in a casing portion 31N (indicated by broken lines) of the printer 10N together with the print portion 30. The casing portion 31N of the printer 10N is provided with the first opening portion 23*a* and the second opening portion 23*b* for allowing a part of the ink tanks 25*a* and 25*b* to be viewed from the outside of the casing portion 31N similarly as with the casing portion 21 of the tank unit 20K according to the eleventh embodiment.

With the printer 10N according to the fourteenth embodiment, since the ink tanks 25*a* and 25*b* are integrally housed in the main body, the installation efficiency thereof is increased. Furthermore, with the ink tanks 25*a* and 25*b* included in the printer 10N according to the fourteenth embodiment, an occurrence of a difference in the amount of remaining ink at the time when the too-little ink amount state is detected is suppressed similarly as described in the eleventh embodiment. In addition, with the printer 10N according to the fourteenth embodiment, effects similar to those of the printer 10K according to the eleventh embodiment can be achieved. Note that the ink tanks 25*a*L and 25*b*L according to the twelfth embodiment, the ink tanks 25*a*M and 25*b*M according to the thirteenth embodiment, or the like may be applied, in place of the ink tanks 25*a* and 25*b*, to the printer 10N according to the fourteenth embodiment.

Figure 25:
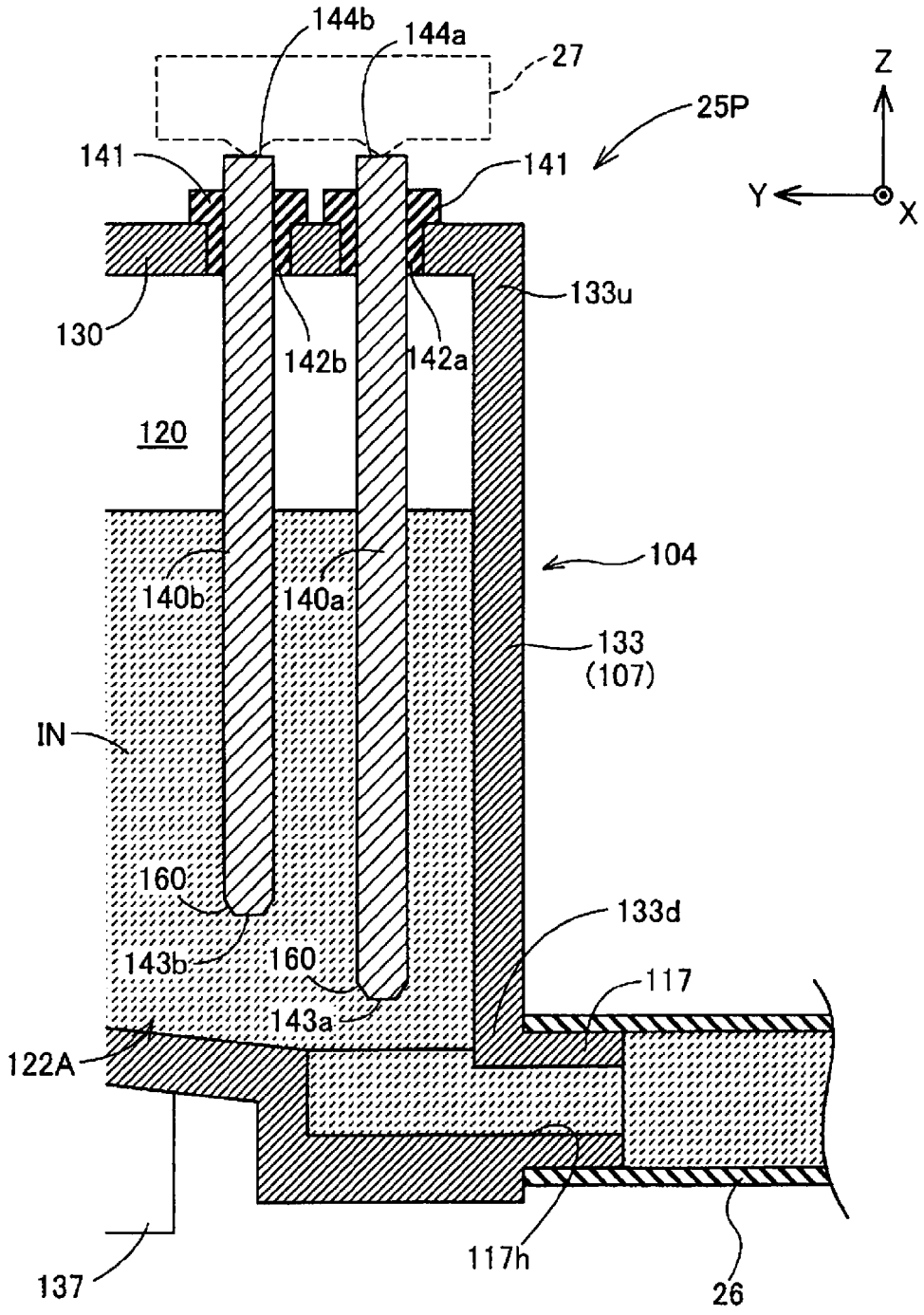
FIG. 25 is a schematic cross-sectional view showing a configuration of a part of an ink tank according to a fifteenth embodiment.

P. Fifteenth Embodiment:

FIG. 25 is a schematic cross-sectional view showing a configuration of a part of an ink tank 25P, which serves as a fifteenth embodiment of the invention. The ink tank 25P according to the fifteenth embodiment has a configuration similar to that of the ink tank 25A according to the first embodiment except that the configuration of the electrode pins 140*a* and 140*b* is different, and is attached to the printer 10 (FIG. 1) having a configuration similar to that described in the first embodiment. In the following description and the reference diagrams, the same signs as those used in the first embodiment will be used for the same constituent portions as those described in the first embodiment, or corresponding constituent portions.

With the ink tank 25P according to the fifteenth embodiment, chamfered portions 160 are provided in the leading end portions 143*a* and 143*b* of the electrode pins 140*a* and 140*b* similarly as in the electrode pins 140*a* and 140*b* according to the tenth embodiment shown in FIGS. 14, 15, and 16, for example. The chamfered portions 160 are provided as inclined faces obtained by cutting corner portions between leading end faces and side faces of the respective electrode pins 140*a* and 140*b*. As a result of provision of the chamfered portions 160, the leading end portions 143*a* and 143*b* of the electrode pins 140*a* and 140*b* have a tapered shape, and the areas of the leading end faces thereof are smaller than the cross-sectional areas of portions of the electrode pins 140*a* and 140*b* rearward of the leading end portions.

As a result of provision of the chamfered portions 160, insertion of the electrode pins 140*a* and 140*b* in the ink containing portion 120 at the time of assembling the ink tank 25P is facilitated. Furthermore, the inner circumferential faces of the through holes 142*a* and 142*b* being damaged by being scratched by the leading end portions 143*a* and 143*b* of the electrode pins 140*a* and 140*b* at the time of attaching the electrode pins 140*a* and 140*b* to the ink tank 25P is suppressed. In addition, as a result of the leading end faces of the electrode pins 140*a* and 140*b* being made small, the liquid surface of the ink IN easily moves away from these leading end faces when the amount of ink is close to the too-little ink amount state. For this reason, the accuracy of detection of the too-little ink amount state is increased. In addition, with the ink tank 25P according to the fifteenth embodiment, effects similar to those described in the first embodiment can be achieved.

The effects achieved by the above-described chamfered portions 160 can also be achieved with the electrode pins 140*a* and 140*b* according to the tenth embodiment and the thirteenth embodiment that also have chamfered portions at the leading end portions. This configuration of the chamfered portions 160 of the electrode pins 140*a* and 140*b* can also be applied to the leading end portions 143*a* and 143*b* of the electrode pins 140*a* and 140*b* described in the other embodiments. Furthermore, the chamfered portions 160 may not be provided in both the two electrode pins 140*a* and 140*b*, and need only be provided in at least one of the electrode pins 140*a* and 140*b*.

Figure 26:
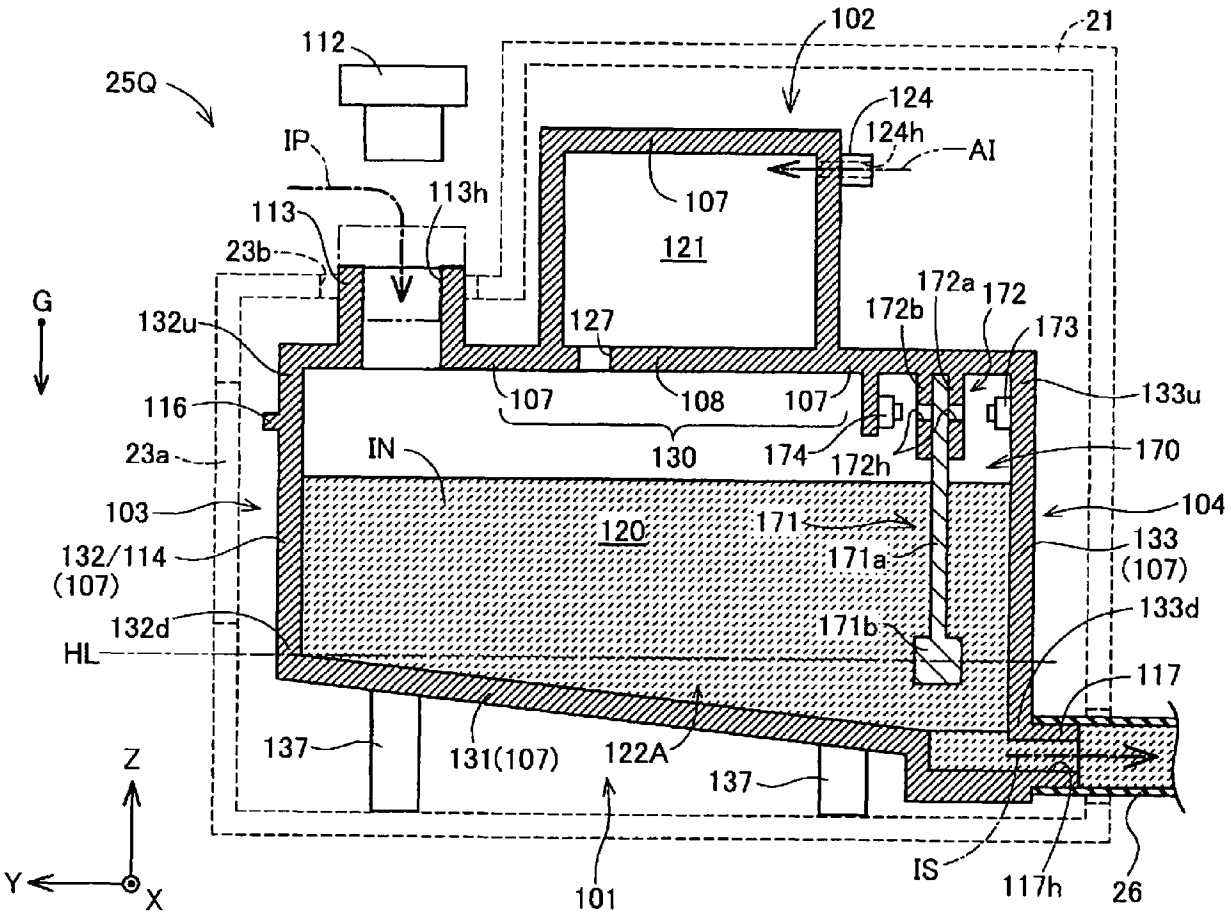
FIG. 26 is a schematic cross-sectional view showing a configuration of an ink tank according to a sixteenth embodiment.

Q. Sixteenth Embodiment:

FIG. 26 is a schematic cross-sectional view showing a configuration of an ink tank 25Q, which serves as a sixteenth embodiment of the invention. The ink tank 25Q according to the sixteenth embodiment has a configuration similar to that of the ink tank 25A according to the first embodiment except that the configuration for detecting the ink in the ink containing portion 120 is different. The ink tank 25Q according to the sixteenth embodiment is attached to the printer 10 (FIG. 1) having a configuration similar to that described in the first embodiment. In the following description and the reference diagrams, the same signs as those used in the first embodiment will be used for the same constituent portions as those described in the first embodiment, or corresponding constituent portions.

The ink tank 25Q according to the sixteenth embodiment is provided with a detection mechanism 170, in place of the electrode pins 140*a* and 140*b*, as a constituent portion for detecting the ink IN in the ink containing portion 120. The detection mechanism 170 is provided at a portion close to the second side wall portion in the ink containing portion 120. The detection mechanism 170 is constituted by a detection member 171, a holding portion 172, a light emitting element 173, and a light receiving element 174.

The detection member 171 is constituted by a resin member having a smaller density than that of the ink IN, and has an extension portion 171*a* and a leading end portion 171*b*. The density of the detection member may be made small by providing a hollow portion inside. The extension portion 171*a* is a plate-shaped portion having a substantially rectangular shape, and is arranged such that the thickness direction thereof is parallel with the arrow Y direction, the long direction thereof is parallel with the arrow Z direction, and the short direction thereof is parallel with the arrow X direction. The leading end portion 171*b* is a portion whose volume is locally increased at a lower end portion of the extension portion 171*a*. The leading end portion 171*b* is arranged below the extension portion 171*a*, and at least a part of the leading end portion 171*b* is arranged in the lower portion 122A. Since the detection member 171 has a smaller density than that of the ink IN as mentioned above, the detection member 171 receives buoyancy from the ink IN in the ink containing portion 120.

The holding portion 172 is provided in the upper wall portion 130, and holds the detection member 171 in a state of being able to be displaced in the arrow Z direction The holding portion 172 is constituted by two wall portions 172*a* and 172*b* that sandwich, in the arrow Y direction, an upper end portion of the extension portion 171*a* of the detection member 171 which is in the aforementioned installation posture. The two wall portions 172*a* and 172*b* are formed so as to be suspended from the upper wall portion 130 in the direction opposite to the arrow Z direction. The first wall portion 172*a* is located on the second side wall portion 133 side, and the second wall portion 172*b* is located on the first side wall portion 132 side. The aforementioned installation posture of the detection member 171 is held in a state of receiving buoyancy from the ink IN as a result of being supported while being sandwiched by the wall portions 172*a* and 172*b* of the holding portion 172 in the ink containing portion 120. Through holes 172*h* that pass through in the arrow Y direction are provided respectively in the two wall portions 172*a* and 172*b* that constitute the holding portion 172 at the same corresponding positions. FIG. 26 shows a state where the extension portion 171*b* of the detection member 171 is located between the through holes 172*h* of the two wall portions 172*a* and 172*b*, and the through holes 172*h* are closed.

The light emitting element 173 and the light receiving element 174 correspond to a subordinate concept of an optical sensor according to the invention. The light emitting element 173 and the light receiving element 174 are fixed to the inside of the ink containing portion 120 with the above-described holding portion 172 therebetween in the arrow Y direction. The light emitting element 173 is fixed to a position that directly faces the through hole 172*h* of the first wall portion 172*a* so as to be able to emit light toward this through hole 172*h*. The light receiving element 174 is fixed to a position that directly faces the through hole 172*h* of the second wall portion 172*b* so as to be able to receive the light emitted by the light emitting element 173 through this through hole 172*h*. The light emitting element 173 and the light receiving element 174 are electrically connected to the ink detecting portion 34 via the corresponding signal line (FIG. 1). In the sixth embodiment, the ink detecting portion 34 outputs driving power and a signal for giving a light emission instruction to the light emitting element 173 under the control of the control portion 35. The ink detecting portion 34 also supplies driving power to the light receiving element 174 and receives a light reception signal from the light receiving element 174.

Figure 27:
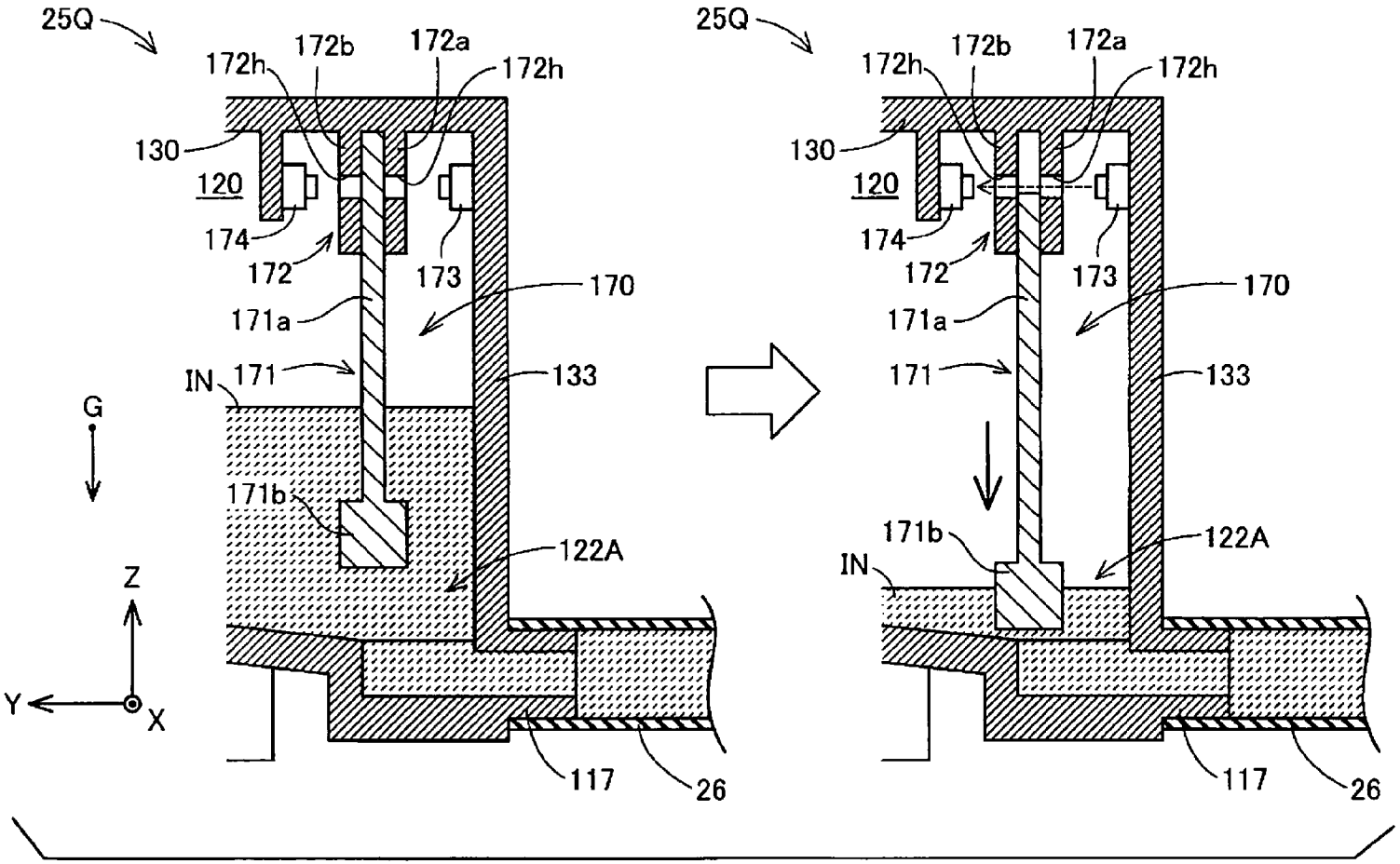
FIG. 27 is a schematic view for illustrating an ink detecting operation performed by a detection mechanism according to the sixteenth embodiment.

FIG. 27 is a schematic view for illustrating an operation of detecting the ink IN with the detection mechanism 170. An exemplary state of the detection mechanism 170 before the amount of ink reaches the too-little ink amount state is shown to the left in FIG. 27, and an exemplary state of the detection mechanism 170 after the amount of ink has reached the too-little ink amount state is shown to the right in FIG. 27.

In the ink tank 25Q, when a predetermined amount of remaining ink IN or more is contained in the ink containing portion 120, the upper end portion of the detection member 171 is located at a height position at which it closes the two through holes 172*h* of the holding portion 172, due to the buoyancy received from the ink IN (left in FIG. 27). For this reason, even if the light emitting element 173 emits light, the light receiving element 174 does not receive this light. On the other hand, when the amount of the ink IN in the ink containing portion 120 has decreased to an amount smaller than the predetermined amount of remaining ink and reaches the too-little ink amount state, the height position of the leading end portion 171*b* of the detection member 171 located in the lower portion 122A lowers in accordance with the lowering of the liquid surface of the ink IN (right in FIG. 27). For this reason, the height position of the upper end portion of the detection member 171 also lowers, achieving a state where the two through holes 172*h* are opened. In this state, when the light emitting element 173 emits light, the light receiving element 174 can receive this light. The control portion 35 detects, via the ink detecting portion 34, that the light receiving element 174 has received the light of the light emitting element 173, thereby detecting the too-little ink amount state in the ink tank 25Q.

With the ink tank 25Q according to the sixteenth embodiment, it is possible to detect the too-little ink amount state of the ink IN whose liquid surface is located in the lower portion 122A, which is difficult for the user to visually check, using the detection member 171 that is displaced in accordance with the position of the liquid surface of the ink IN. With the ink tank 25Q according to the sixteenth embodiment, the leading end portion 171*b* of the detection member 171 is arranged in the lower portion 122A where, since the horizontal cross-sectional area is comparatively small, the lowering speed of the liquid surface relative to the consumption of the ink I is high, and the change in the liquid surface position of the ink IN is significant. Therefore, displacement of the detection member 171 due to a shaking of the liquid surface of the ink IN and displacement thereof due to the lowering of the liquid surface of the ink IN can be easily distinguished from each other, and an erroneous detection of the too-little ink amount state can be suppressed. Furthermore, with the ink tank 25Q according to the sixteenth embodiment, since the detection mechanism 170 is provided in the region on the second side wall portion 133 side, a visual check of the ink IN by the user being interrupted by the detection mechanism 170 is suppressed. In addition, with the ink tank 25Q according to the sixteenth embodiment, various effects similar to those described in the above embodiments can be achieved.

Figure 28:
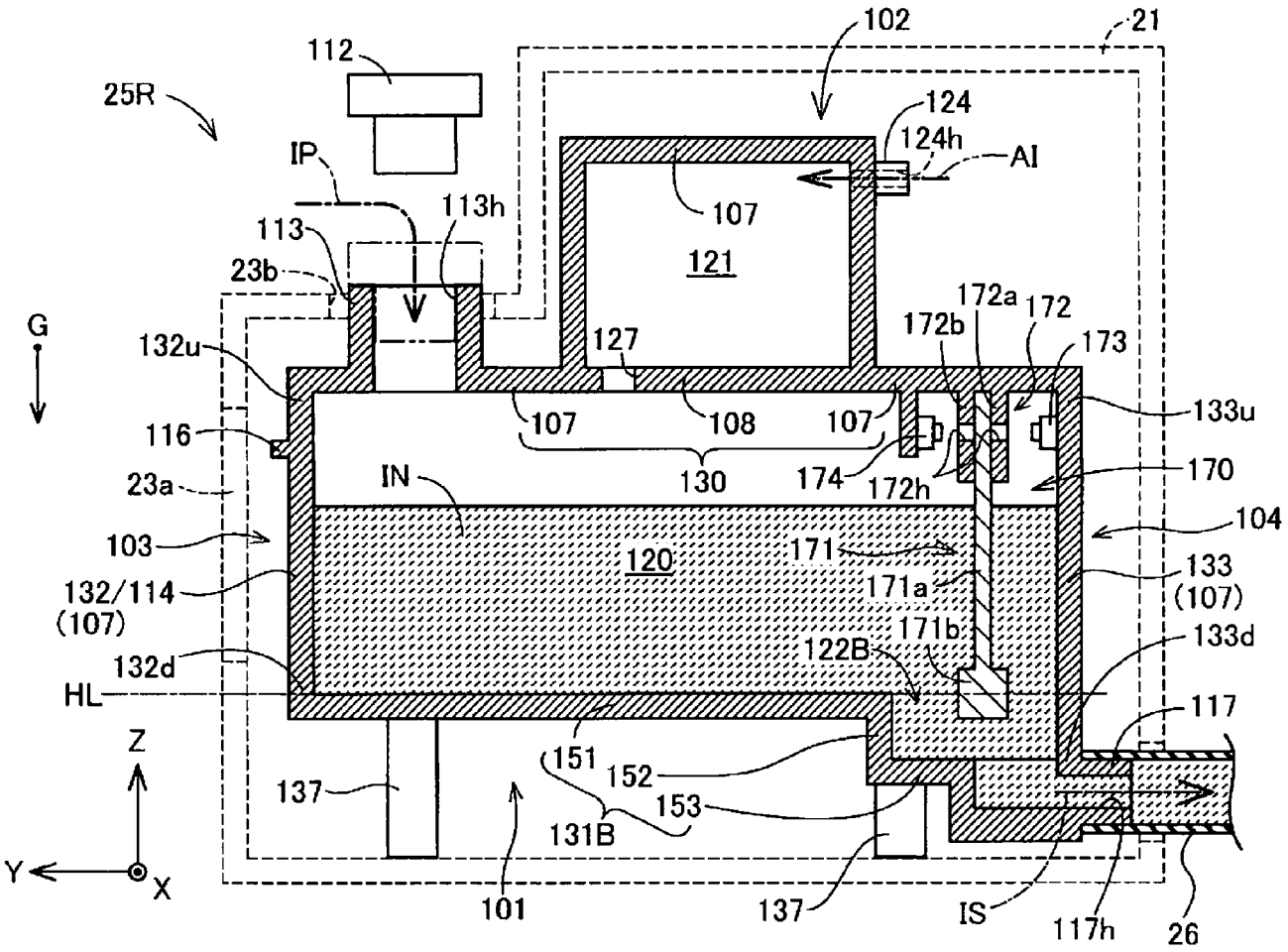
FIG. 28 is a schematic cross-sectional view showing a configuration of an ink tank according to a seventeenth embodiment.

R. Seventeenth Embodiment:

FIG. 28 is a schematic cross-sectional view showing a configuration of an ink tank 25R, which serves as a seventeenth embodiment of the invention. The ink tank 25R according to the seventeenth embodiment has a configuration similar to that of the ink tank 25Q according to the sixteenth embodiment except that the ink tank 25R has the configuration of the lower portion 122B described in the second embodiment in place of the lower portion 122A. In the following description and the reference diagrams, the same signs as those used in the sixteenth embodiment will be used for the same constituent portions as those described in the sixteenth embodiment, or corresponding constituent portions. In the ink tank 25R according to the seventeenth embodiment, at least a part of the leading end portion 171*b* of the detection member 171 is arranged in the lower portion 122B. For this reason, when the position of the liquid surface of the ink IN reaches the lower portion 122B, the height position of the detection member 171 begins to lower in accordance with the lowering of the liquid surface of the ink IN. Accordingly, the too-little ink amount state can be detected similarly as described in the sixteenth embodiment. In addition, with the ink tank 26R according to the seventeenth embodiment, various effects similar to those described in the above embodiments can be achieved. Note that the configuration of the detection mechanism 170 can be applied to the ink tanks according to not only the first and second embodiments but also the other embodiments such as the third and fourth embodiments.

Figure 29:
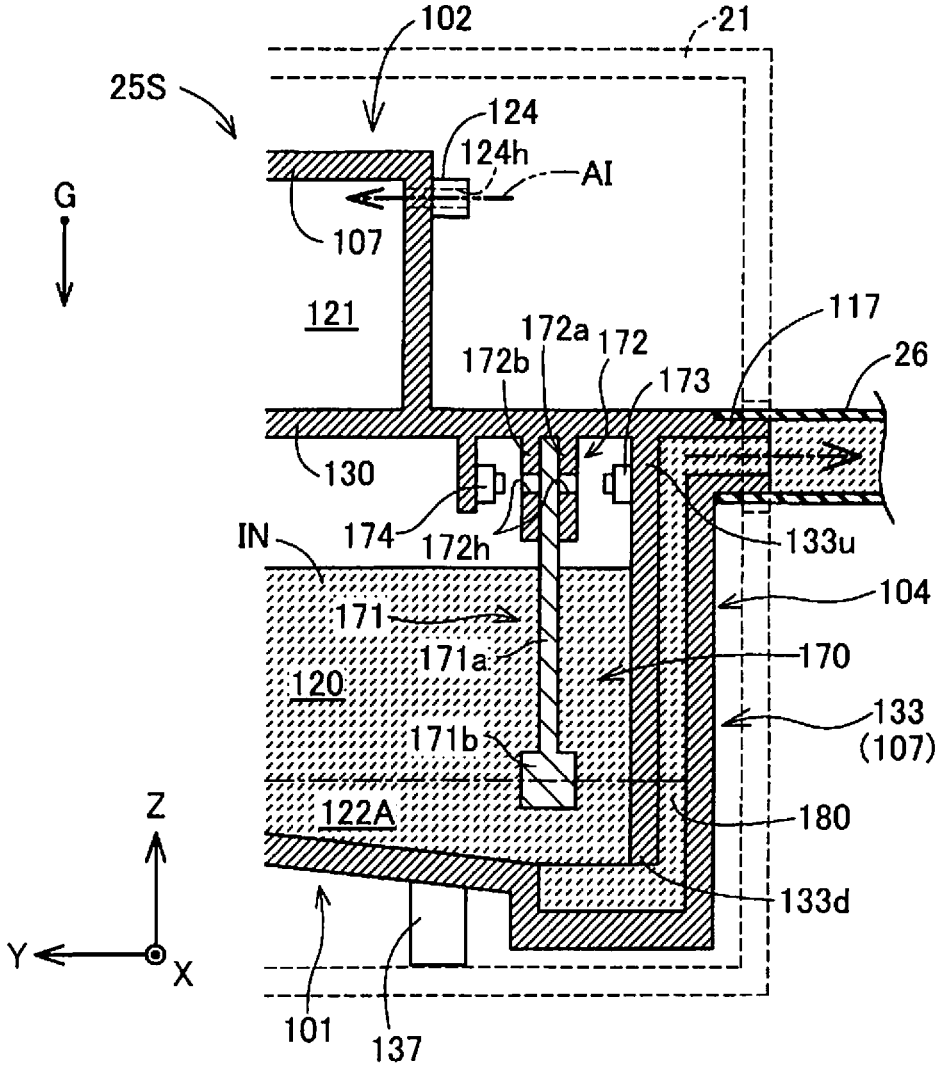
FIG. 29 is a schematic cross-sectional view showing a configuration of a part of an ink tank according to an eighteenth embodiment.

S. Eighteenth Embodiment:

FIG. 29 is a schematic cross-sectional view showing a part of a configuration of an ink tank 25S, which serves as an eighteenth embodiment of the invention. The ink tank 25S according to the eighteenth embodiment has a configuration similar to that of the ink tank 25Q according to the sixteenth embodiment except that an ink supply path 180 is added, and the position of the ink supply portion 117 is different. In the following description and the reference diagrams, the same signs as those used in the sixteenth embodiment will be used for the same constituent portions as those described in the sixteenth embodiment, or corresponding constituent portions.

In the ink tank 25S according to the eighteenth embodiment, an ink supply portion 117 is located at roughly the same height as that of an upper end portion 133*u* of the second side wall portion 133. The ink supply portion 117 is connected to a lower end portion of the lower portion 122A via the ink supply path 180. The ink supply path 180 is provided in an end face of the second side wall portion 133 of the case member 110 on the side in the arrow X direction, and is constituted by a path groove that is covered with the sheet member 111 (FIG. 1). The ink IN in the ink containing portion 120 passes through the ink supply path 180 by being suctioned by a suction pump (not shown) provided in the print head portion 32 (FIG. 1), and outflows from the ink supply portion 117.

With the ink tank 25S according to the eighteenth embodiment, since the ink supply portion 117 is located on the upper side, the attachment of the tube 26 to the ink supply portion 117 at the time of assembling the printer is facilitated. In addition, with the ink tank 25S according to the eighteenth embodiment, various effects similar to those described in the above embodiments can be achieved. Note that the configuration of the ink supply path 180 and the ink supply portion 117 according to the eighteenth embodiment may also be applied to the ink tanks according to the other embodiments.

T. Modifications:

T1. Modification 1:

In the above embodiments, the lower end of the visual check portion 114 coincides with the lower end portion 132*d* of the first side wall portion 132. In this regard, the lower end of the visual check portion 114 may not coincide with the lower end portion 132*d* of the first side wall portion 132. For example, the lower end of the visual check portion 114 may be provided above the lower end portion 132*d* of the first side wall portion 132. In this case, the leading end portions 143*a* and 143*b* of the electrode pins 140*a* and 140*b* may be located above the lower end portion 132*d* of the first side wall portion 132. The leading end portions 143*a* and 143*b* of the electrode pins 140*a* and 140*b* need only be located at a position below the lower end of the visual check portion 114.

T2. Modification 2:

In the above embodiment, the visual check portion 114 is provided in the first side wall portion 132. In this regard, the visual check portion 114 may not be provided in the first side wall portion 132. The visual check portion 114 may be provided in the second side wall portion 133, the third side wall portion 134, or the fourth side wall portion 135. The visual check portion 114 may also be omitted. Even in this case, if the leading end portions 143*a* and 143*b* of the electrode pins 140*a* and 140*b* are arranged in the portion where the cross-sectional area in a horizontal plane is small, such as the lower portions 122A to 122D and 122J, the accuracy of ink detection with the electrode pins 140*a* and 140*b* is increased.

T3. Modification 3:

In the above embodiments, the bottom wall portion 131 inclines downward from the first side wall portion 132 toward the second side wall portion 133. In this regard, the bottom wall portion 131 may not incline downward from the first side wall portion 132 up to the second side wall portion 133. The bottom wall portion 131 need only have a portion where the bottom wall portion 131 inclines downward in a direction extending from the first side wall portion 132 toward the second side wall portion 133. For example, the bottom wall portion 131 may incline downward such that a center portion thereof between the first side wall portion 132 and the second side wall portion 133 is lowest.

T4. Modification 4:

In the above embodiments, the electrode pins 140*a* and 140*b* are arranged in a region between the second side wall portion 133 and an intermediate position between the first side wall portion 132 and the second side wall portion 133. In this regard, the electrode pins 140*a* and 140*b* may be arranged in other regions. For example, the electrode pins 140*a* and 140*b* may be arranged in a region on the first side wall portion 132 side.

T5. Modification 5:

In the above embodiments excluding the fourth embodiment, the electrode pins 140*a* and 140*b* extend in the gravity direction. In this regard, the electrode pins 140*a* and 140*b* may not extend in the gravity direction. The electrode pins 140*a* and 140*b* may extend downward from above in a direction that intersects the gravity direction as in the fourth embodiment (FIG. 6). Alternatively, the electrode pins 140*a* and 140*b* may extend horizontally. The pair of electrode pins 140*a* and 140*b* may not extend parallel with each other, and may extend in directions that intersect each other. The pair of electrode pins 140*a* and 140*b* may have different shapes. For example, a configuration may be employed in which the first electrode pin 140*a* is configured to have a straight bar shape, while the second electrode pin 140*b* bends in the middle. The electrodes used for detecting ink may not be constituted by the electrode pins 140*a* and 140*b*, and may have a plate shape, a thin film shape, a band shape, or a complicatedly bent shape with aforementioned shapes, for example.

T6. Modification 6:

The ink tanks according to the above embodiments are each provided with the two electrode pins 140*a* and 140*b* as a pair of electrodes. In this regard, the ink tanks may not be each provided with a pair of electrodes, and may be each provided with only one electrode, for example. In this case, a configuration may be employed in which only one electrode is arranged in the ink containing portion 120, and another electrode is arranged outside the ink containing portion 120 in a state where electric conductivity is maintained with ink flowed into the tube 26 as a conductive path. Alternatively, the ink tank may include two or more electrodes.

T7. Modification 7:

In the above embodiments, the ink supply portion 117 is connected to the lower end of the ink containing portion 120. In this regard, the ink supply portion 117 may be connected to a portion other than the lower end of the ink containing portion 120. For example, the ink supply portion 117 may be connected slightly above the lower end of the ink containing portion 120.

T8. Modification 8:

In the above embodiments, the reference posture that is a posture at the time when the ink tanks are attached to the printer 10, the posture at the time when the ink is supplied to the print head portion 32, and the posture at the time when the ink is supplied by the user are the same. In this regard, the posture at the time when the ink is supplied to the print head portion 32 and the posture at the time when the ink is supplied by the user may not be the same as the reference posture. In this case, in the ink tanks in the embodiments, the leading end portions 143*a* and 143*b* of the electrode pins 140*a* and 140*b* need only be at least arranged in the lower portions 122A to 122D and 122J in the posture at the time when the ink is supplied to the print head portion 32.

T9. Modification 9:

The ink tanks according to the above embodiments are each provided with the ink injection portion 113. In this regard, the ink injection portion 113 may be omitted. That is to say, the invention can also be applied to an ink tank that does not include the ink injection portion 113 and to which the user accordingly cannot supply the ink.

T10. Modification 10:

In the cartridges according to the above embodiments, the atmosphere introduction portion 121 has an internal space capable of containing the atmosphere. In this regard, the internal space capable of containing the atmosphere may be omitted. For example, the atmosphere introduction portion may be constituted only by the communication path 127.

T11. Modification 11:

In the lower portions 122A to 122D and 122J in the above embodiments, the cross-sectional area of the horizontal cross-section thereof is smaller than that of a region above the lower portions 122A to 122D and 122J. In this regard, the cross-sectional area of the horizontal cross section of the lower portion 122A to 122D and 122J may be roughly the same as that of a region above these lower portions.

T12. Modification 12:

The ink tanks according to the above embodiments are each housed in the casing portion 21 of the tank unit 20. In this regard, the ink tanks according to the above embodiments may be housed in the casing portion 31 of the print portion 30. Alternatively, the ink tanks in the above embodiments may not be housed in these casing portions 21 and 31, and may be connected to the print portion 30 in a state of being entirely exposed to the outside of the printer or in a state of being held by a basket-like holding member or the like.

T13. Modification 13:

In the above embodiments, the connection circuit units 27 and 27F are in electrical contact with end faces of the rear end portions 144*a* and 144*b* of the electrode pins 140*a* and 140*b*. In this regard, the connection circuit units 27 and 27F may be in electrical contact with a side portion of the rear end portions 144*a* and 144*b* of the electrode pins 140*a* and 140*b*.

T14. Modification 14:

In the above sixth embodiment, the electrode pins 140*a* and 140*b* having the same length are arranged such that the leading end portion 143*a* of the first electrode pin 140*a* is located below the leading end portion 143*b* of the second electrode pin 140*b*, and such that the rear end portion 144*a* of the first electrode pin 140*a* is located below the rear end portion 144*b* of the second electrode pin 140*b*. In this regard, an arrangement may be employed in which the second electrode pin 140*b* is made shorter than the first electrode pin 140*a*, the leading end portion 143*a* of the first electrode pin 140*a* is located below the leading end portion 143*b* of the second electrode pin 140*b*, and the rear end portion 144*a* of the first electrode pin 140*a* is located above the rear end portion 144*b* of the second electrode pin 140*b*.

T15. Modification 15:

The ink tanks according to the above embodiments each contain ink that is to be supplied to the print head portion 32 of the printer 10. In this regard, the configuration of the ink tanks according to the above embodiments may be applied to tanks that contain liquid that is to be supplied to liquid ejection systems other than a printer. For example, it may be applied to a detergent tank for supplying detergent to a detergent ejection apparatus for ejecting liquid detergent.

T16. Modification 16:

In the above sixteenth embodiment, the detection member 171 is configured to be linearly displaced in the arrow Z direction in accordance with the position of the liquid surface of the ink IN by being supported by the holding portion 172. In this regard, the detection member 171 need only be configured to be displaced in accordance with the position of the liquid surface of the ink IN, and may not be configured to be linearly displaced. For example, the detection member 171 may be configured to be rotationally displaced in accordance with the position of the liquid surface of the ink IN by being held by a holding portion capable of pivoting, such as a hinge mechanism.

T17. Modification 17:

In the above sixteenth embodiment, the amount of remaining ink IN in the lower portion 122A is detected by optically detecting the position of the detection member 171 that is displaced in accordance with the position of the liquid surface of the ink IN, using the light emitting element 173 and the light receiving element 174. In this regard, the position of the liquid surface of the ink IN in the lower portion 122A may be detected using an optical element such as an image sensor, without using the detection member 171. Alternatively, a configuration may also be employed in which it is optically detected whether or not a predetermined amount of the ink IN is present in the lower portion 122A by arranging, in place of the detection member 171, a prism as a detection member in the lower portion 122A such that the path of incident light is different between a state where the prism is immersed in the ink IN and a state where the prism is not immersed therein. The above configuration may also be applied to the seventeenth embodiment and the eighteenth embodiment.

T18. Modification 18:

In the above fifteenth embodiment, the electrode pins 140*a* and 140*b* are each provided with the chamfered portion 160 that is configured by an inclined surface. In this regard, the chamfered portion 160 may be configured by a curved surface that is formed between the leading end face and the side face. Furthermore, the electrode pins 140*a* and 140*b* may be configured such that the contact area with the ink IN is smaller on the leading end side by configuring the leading end faces of the electrode pins 140*a* and 140*b* with inclined surfaces having an inclination angle relative to the side faces of the electrode pins 140*a* and 140*b*.

The invention is not limited to the above embodiment, examples, and modifications, and can be achieved by various configurations without departing from the gist thereof. For example, the technical features in the embodiments, examples, and modifications corresponding to the technical features in the modes described in the summary of the invention can be replaced or combined as appropriate in order to solve some or all of the problems described above, or in order to achieve some or all of the above-described effects. A technical feature that is not described as essential in the specification can be deleted as appropriate.

The entire disclosures of Japanese Patent Applications No. 2015-049480, filed on Mar. 12, 2015, and No. 2016-018074, filed on Feb. 2, 2016, are expressly incorporated herein by reference.

What is claimed is:

1. A tank with which liquid can be supplied to a liquid ejection head, comprising:

a liquid containing portion capable of containing the liquid;

a liquid supply portion with which the liquid can be supplied to the liquid ejection head;

a liquid injection portion with which the liquid can be injected to the liquid containing portion; and an terminal member used for detecting the liquid contained in the liquid containing portion, wherein, the liquid containing portion has a visual check portion that enables a position of a liquid surface of the liquid contained in the liquid containing portion to be visually checked from the outside in a liquid supply posture, which is a posture at the time of supplying the liquid from the tank to the liquid ejection head, the liquid supply portion is connected to a lower portion of the liquid containing portion, the lower portion being located below a lower end of the visual check portion in the liquid supply posture, and at least a part of the terminal member is arranged in the lower portion.

2. The tank according to claim 1, wherein the lower portion is constituted by a step portion in which, in the liquid supply posture, a cross-sectional area of an internal space in a horizontal cross-section becomes small stepwise in a gravity direction, or an inclined portion in which the cross-sectional area becomes smaller on a lower side in the gravity direction, and at least a part of the terminal member is arranged below an upper end of the step portion or below an upper end of the inclined portion in the liquid supply posture.

3. The tank according to claim 1, wherein the liquid containing portion has a bottom wall portion that inclines downward in the liquid supply posture as a wall portion constituting an inclined portion in which a cross-sectional area of an internal space in a horizontal cross-section becomes smaller on a lower side in a gravity direction, and the liquid supply portion is connected to the liquid containing portion at a lower end portion of the bottom wall portion.

4. The tank according to claim 3, wherein the liquid containing portion has a first side wall portion and a second side wall portion that oppose each other in a horizontal direction with the bottom wall portion therebetween, and the bottom wall portion has a portion that inclines downward in a direction extending from the first side wall portion toward the second side wall portion.

5. The tank according to claim 4, wherein the visual check portion is provided in the first side wall portion, and at least a part of the terminal member is located below a lower end portion of the first side wall portion in the liquid supply posture.

6. The tank according to claim 4, wherein the terminal member is arranged between the second side wall portion and an intermediate position between the first side wall portion and the second side wall portion.

7. The tank according to claim 1, wherein the terminal member extends from above the lower portion toward the lower portion in the liquid supply posture.

8. The tank according to claim 7, wherein, in the liquid supply posture, the terminal member is held by an upper wall portion extending in a direction intersecting the gravity direction above the liquid containing portion, and extends toward the lower portion from the upper wall portion.

9. The tank according to claim 8, wherein the terminal member includes a first terminal member and a second terminal member, and a lower end portion of the first terminal member and a lower end portion of the second terminal member are arranged in the lower portion, and the lower end portion of the second terminal member is located above the lower end portion of the first terminal member in the liquid supply posture.

10. The tank according to claim 9, wherein the first terminal member and the second terminal member are metal pins that have different lengths, the first terminal member and the second terminal member are inserted in the liquid containing portion from above the liquid containing portion in the liquid supply posture, and an upper end portion of the first terminal member and an upper end portion of the second terminal member that are arranged above the liquid containing portion are located at the same height position in the liquid supply posture.

11. The tank according to claim 9, wherein the first terminal member and the second terminal member are metal pins that have the same length, the first terminal member and the second terminal member are inserted in the liquid containing portion from above the liquid containing portion in the liquid supply posture, and an upper end portion of the first terminal member and an upper end portion of the second terminal member that are arranged above the liquid containing portion are located at different height positions in the liquid supply posture.

12. The tank according to claim 8, wherein the terminal member includes a first terminal member and a second terminal member, and a lower end portion of the first terminal member and a lower end portion of the second terminal member are arranged in the lower portion, and the lower end portion of the first terminal member and the lower end portion of the second terminal member are located at the same height position in the liquid supply posture.

13. A liquid ejection apparatus comprising:

a liquid ejection head that ejects liquid;

a liquid container that has a liquid containing portion which contains the liquid, and a liquid supply portion for causing the liquid that is to be supplied to the liquid ejection head to flow out, and that is fixed to the liquid ejection apparatus, the liquid being supplied to the liquid containing portion by a user of the liquid ejection apparatus;

a control portion that executes liquid detection processing for detecting whether or not the liquid is present at a predetermined position in the liquid containing portion; and a liquid detecting portion that is provided in the liquid containing portion and is used for detecting whether or not the liquid is present in the liquid detection processing, wherein the liquid container has:

a first portion in which a visual check portion is provided, the visual check portion enabling the user to view and check whether or not the liquid is present in the liquid containing portion when the liquid ejection apparatus is in a use state, which is a state of being used by the user; and a second portion in which the liquid is present even after the liquid has been consumed to an extent to which the liquid disappears from an area of the visual check portion, and the predetermined position at which it is detected whether or not the liquid is present by the control portion is a position included in the second portion.

14. The liquid ejection apparatus according to claim 13, further comprising:

a casing portion that houses the liquid container, wherein, in the liquid container, at least a wall portion that constitutes the first portion is constituted by a material through which the position of the liquid surface of the liquid contained inside can be visually checked, the casing portion is provided with a window portion through which the user views the visual check portion in the first portion from the outside of the casing portion, the window portion being provided in a portion that faces the first portion, and the area is defined by the window portion.

15. The liquid supply apparatus according to claim 13, wherein the liquid detecting portion is one of an terminal for detecting electrical resistance of the liquid in the second portion, and a displacement member that is displaced in accordance with whether or not the liquid is present in the second portion.

16. The liquid ejection apparatus according to claim 15, wherein the liquid detecting portion is the displacement member, the liquid ejection apparatus further includes an optical sensor that optically detects a displacement of the displacement member, and the control portion detects whether or not the liquid is present at the predetermined position, using a result of the detection with the optical sensor.

17. The liquid ejection apparatus according to claim 13, wherein, when the liquid ejection apparatus is in the use state, the second portion is located below the first portion in a gravity direction.

18. The liquid ejection apparatus according to claim 13, wherein the liquid supply portion is provided above the second portion in a gravity direction.

* * * * *